US008863545B2

(12) United States Patent
Fujimoto et al.

(10) Patent No.: US 8,863,545 B2
(45) Date of Patent: Oct. 21, 2014

(54) REFRIGERATION APPARATUS

(75) Inventors: Shuji Fujimoto, Sakai (JP); Atsushi Yoshimi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 947 days.

(21) Appl. No.: 12/990,528

(22) PCT Filed: Apr. 30, 2009

(86) PCT No.: PCT/JP2009/058439

§ 371 (c)(1),
(2), (4) Date: Nov. 1, 2010

(87) PCT Pub. No.: WO2009/136581

PCT Pub. Date: Nov. 12, 2009

(65) Prior Publication Data

US 2011/0048055 A1 Mar. 3, 2011

(30) Foreign Application Priority Data

May 8, 2008 (JP) ..... 2008-122330

(51) Int. Cl.
*F25B 13/00* (2006.01)
*F25B 41/00* (2006.01)

(Continued)

(52) U.S. Cl.
CPC . *F25B 1/10* (2013.01); *F25B 13/00* (2013.01); *F25B 45/00* (2013.01); *F25B 2313/0272* (2013.01); *F25B 2313/02741* (2013.01);

(Continued)

(58) Field of Classification Search
CPC ..... F25B 2600/022; F25B 2600/027; F25B 2600/0271; F25B 2600/2501; F25B 2600/2523; F25B 2400/0409; F25B 2400/0411; F25B 2400/0415
USPC ..... 62/324.6, 196.1, 196.2, 197, 160, 204, 62/208, 510, 509; 236/12.1
See application file for complete search history.

(56) References Cited

U.S. PATENT DOCUMENTS 6,848,268 B1 2/2005 Memory et al.
7,316,120 B2 * 1/2008 Aoki et al. ..... 62/324.4

(Continued)

FOREIGN PATENT DOCUMENTS

CN 1708663 A 12/2005
CN 1808016 A 7/2006

(Continued)

OTHER PUBLICATIONS

International Search Report of corresponding PCT Application No. PCT/JP2009/058439, Jan. 12, 2011.

(Continued)

*Primary Examiner* — Frantz Jules
*Assistant Examiner* — Erik Mendoza-Wilkenfe
(74) *Attorney, Agent, or Firm* — Global IP Counselors

(57) ABSTRACT

A refrigeration apparatus includes a multi-stage compression mechanism, heat source-side and usage side heat exchangers each operable as a radiator/evaporator, a switching mechanism switchable between cooling and heating operation states, a second-stage injection tube, an intermediate heat exchanger and an intermediate heat exchanger bypass tube. The intermediate heat exchanger bypass tube ensures that refrigerant discharged from the first-stage compression element and drawn into the second-stage compression element is not cooled by the intermediate heat exchanger during a heating operation. Injection rate optimization controls a flow rate of refrigerant returned to the second-stage compression element through the second-stage injection tube so that an injection ratio is greater during the heating operation than during a cooling operation. The injection ratio is a ratio of flow rate of the refrigerant returned to the second-stage compression element through the second-stage injection tube relative to flow rate of the refrigerant discharged from the compression mechanism.

9 Claims, 21 Drawing Sheets

(51) Int. Cl.

| | |
|---|---|
| ***F25B 41/04*** | (2006.01) |
| ***F25B 39/04*** | (2006.01) |
| ***F25B 39/02*** | (2006.01) |
| ***F25B 1/10*** | (2006.01) |
| ***F25B 45/00*** | (2006.01) |

(52) U.S. Cl.

CPC ..... *F25B 2400/04* (2013.01); *F25B 2400/072* (2013.01); *F25B 2400/23* (2013.01)

USPC ..... 62/324.6; 62/196.1; 62/196.2; 62/197; 62/204; 62/208; 62/510; 62/509; 236/12.1

(56) References Cited

U.S. PATENT DOCUMENTS

| | | | | |
|---|---|---|---|---|
| 2004/0200233 | A1 | 10/2004 | Funakoshi et al. | |
| 2005/0150248 | A1* | 7/2005 | Manole | 62/513 |
| 2005/0183447 | A1* | 8/2005 | Matsumoto et al. | 62/470 |
| 2006/0137385 | A1 | 6/2006 | Take et al. | |
| 2006/0174639 | A1* | 8/2006 | Lee et al. | 62/160 |
| 2006/0191288 | A1 | 8/2006 | Radermacher et al. | |
| 2009/0025405 | A1* | 1/2009 | Yanik | 62/117 |

FOREIGN PATENT DOCUMENTS

| | | | |
|---|---|---|---|
| CN | 1864037 | A | 11/2006 |
| JP | 3-67958 | A | 3/1991 |
| JP | 08-20138 | B2 | 3/1996 |
| JP | 2001-133058 | A | 5/2001 |
| JP | 2004-301453 | A | 10/2004 |
| JP | 2006-177597 | A | 7/2006 |
| JP | 2006177597 | * | 7/2006 |
| JP | 2006-242557 | A | 9/2006 |
| JP | 2007-232263 | A | 9/2007 |

OTHER PUBLICATIONS

International Preliminary Report of corresponding PCT Application No. PCT/JP2009/058439, Jan. 12, 2011.

* cited by examiner

REFRIGERATION APPARATUS

CROSS-REFERENCE TO RELATED APPLICATIONS

This U.S. National stage application claims priority under 35 U.S.C. §119(a) to Japanese Patent Application No. 2008-122330, filed in Japan on May 8, 2008, the entire contents of which are hereby incorporated herein by reference.

TECHNICAL FIELD

The present invention relates to a refrigeration apparatus, and particularly relates to a refrigeration apparatus for performing a multi-stage compression-type refrigeration cycle having a refrigerant circuit which can switch between a cooling operation and a heating operation and which is capable of intermediate pressure injection.

BACKGROUND ART

As one conventional example of a refrigeration apparatus for performing a multi-stage compression-type refrigeration cycle having a refrigerant circuit which can switch between a cooling operation and a heating operation and which is capable of intermediate pressure injection, Japanese Laid-open Patent Application No. 2007-232263 discloses an air-conditioning apparatus for performing a two-stage compression-type refrigeration cycle having a refrigerant circuit which can switch between an air-cooling operation and an air-warming operation and which is capable of intermediate pressure injection. This air-conditioning apparatus has primarily a compressor having two compression elements, one first-stage and one second-stage, connected in series, a four-way switching valve, an outdoor heat exchanger, an indoor heat exchanger, and a second-stage injection tube for returning to the second-stage compression element some of the refrigerant whose heat has been radiated in the outdoor heat exchanger or the indoor heat exchanger.

SUMMARY

A refrigeration apparatus according to a first aspect of the present invention comprises a compression mechanism, a heat source-side heat exchanger which functions as a radiator or evaporator of refrigerant, a usage-side heat exchanger which functions as an evaporator or radiator of refrigerant, a switching mechanism, a second-stage injection tube, an intermediate heat exchanger, and an intermediate heat exchanger bypass tube. The compression mechanism has a plurality of compression elements and is configured so that the refrigerant discharged from the first-stage compression element, which is one of a plurality of compression elements, is sequentially compressed by the second-stage compression element. As used herein, the term "compression mechanism" refers to a compressor in which a plurality of compression elements are integrally incorporated, or a configuration that includes a compression mechanism in which a single compression element is incorporated and/or a plurality of compression mechanisms in which a plurality of compression elements have been incorporated are connected together. The phrase "the refrigerant discharged from a first-stage compression element, which is one of the plurality of compression elements, is sequentially compressed by a second-stage compression element" does not mean merely that two compression elements connected in series are included, namely, the "first-stage compression element" and the "second-stage compression element;" but means that a plurality of compression elements are connected in series and the relationship between the compression elements is the same as the relationship between the aforementioned "first-stage compression element" and "second-stage compression element." The switching mechanism is a mechanism for switching between a cooling operation state, in which the refrigerant is circulated through the compression mechanism, the heat source-side heat exchanger, and the usage-side heat exchanger in a stated order; and a heating operation state, in which the refrigerant is circulated through the compression mechanism, the usage-side heat exchanger, and the heat source-side heat exchanger in a stated order. The second-stage injection tube is a refrigerant tube for branching off the refrigerant whose heat has been radiated in the heat source-side heat exchanger or the usage-side heat exchanger and returning the refrigerant to the second-stage compression element. The intermediate heat exchanger is provided to an intermediate refrigerant tube for drawing into the second-stage compression element refrigerant discharged from the first-stage compression element, and is a heat exchanger which functions as a cooler of refrigerant discharged from the first-stage compression element and drawn into the second-stage compression element during the cooling operation in which the switching mechanism is in the cooling operation state. The intermediate heat exchanger bypass tube is a refrigerant tube connected to the intermediate refrigerant tube so as to bypass the intermediate heat exchanger, and is used to ensure that the refrigerant discharged from the first-stage compression element and drawn into the second-stage compression element is not cooled by the intermediate heat exchanger during the heating operation in which the switching mechanism is in the heating operation state. In this refrigeration apparatus, injection rate optimization control is performed for controlling the flow rate of the refrigerant returned to the second-stage compression element through the second-stage injection tube, so that the injection ratio, which is the ratio of the flow rate of the refrigerant returned to the second-stage compression element through the second-stage injection tube relative to the flow rate of the refrigerant discharged from the compression mechanism, is greater during the heating operation than during the cooling operation.

In a conventional air-conditioning apparatus, intermediate pressure injection is performed in which some of the refrigerant whose heat has been radiated in the outdoor heat exchanger or the indoor heat exchanger after the refrigerant has been discharged from the second-stage compression element of the compressor is returned to the second-stage compression element through the second-stage injection tube, whereby this refrigerant is mixed with intermediate-pressure refrigerant in the refrigeration cycle, which is discharged from the first-stage compression element of the compressor and drawn into the second-stage compression element; the temperature of the refrigerant discharged from the second-stage compression element is reduced, the power consumption of the compressor is reduced, and operating efficiency can be improved.

However, in such an air-conditioning apparatus, to further reduce the power consumption of the compressor and/or improve operating efficiency, it is preferable to provide a configuration for further reducing the temperature of the refrigerant discharged from the second-stage compression element and reducing heat radiation loss in the outdoor heat exchanger and/or the indoor heat exchanger in addition to intermediate pressure injection. Particularly in cases in which refrigerant that operates in a supercritical range is used, such as carbon dioxide, the critical temperature thereof (e.g., the critical temperature of carbon dioxide is about 31° C.) is about the same as the temperature of water and/or air as the cooling source of the outdoor heat exchanger functioning as a radiator of the refrigerant, which is low compared to R22, R410A, and other refrigerants, and the apparatus therefore operates in a state in which the high pressure of the refrigeration cycle is higher than the critical pressure of the refrigerant so that the refrigerant can be cooled by the water and/or air in the outdoor heat exchanger. As a result, since the refrigerant discharged from the second-stage compression element of the compressor has a high temperature, there is a large difference in temperature between the refrigerant and the water or air as a cooling source in the outdoor heat exchanger functioning as a refrigerant radiator, and the outdoor heat exchanger has much heat radiation loss, which poses a problem in making it difficult to achieve a high operating efficiency.

As a countermeasure to this, in this refrigeration apparatus, when no intermediate heat exchanger bypass tube is provided and only an intermediate heat exchanger is provided, the cooling effect by the intermediate heat exchanger on the refrigerant admitted into the second-stage compression element is added to the cooling effect by the intermediate pressure injection using the second-stage injection tube on the refrigerant drawn into the second-stage compression element, and the temperature of the refrigerant ultimately discharged from the compression mechanism can therefore be kept lower than in cases in which an intermediate heat exchanger is not provided. The heat radiation loss in the heat source-side heat exchanger functioning as a radiator of refrigerant is thereby reduced during the cooling operation, and operating efficiency can be further improved over cases in which only intermediate pressure injection is used. However, during the heating operation, if the intermediate heat exchanger is not provided, the heat that should be useable in the usage-side heat exchanger is radiated to the exterior from the intermediate heat exchanger, and operating efficiency therefore decreases.

Therefore, in this refrigeration apparatus, an intermediate heat exchanger bypass tube is provided in addition to the intermediate heat exchanger, and during the heating operation in which the switching mechanism is in the heating operation state, the refrigerant discharged from the first-stage compression element and drawn into the second-stage compression element is not cooled by the intermediate heat exchanger. Thereby, in this refrigeration apparatus, the temperature of the refrigerant discharged from the compression mechanism can be kept even lower during the cooling operation, and heat radiation to the exterior can be suppressed so that the heat can be used in the usage-side heat exchanger during the heating operation. That is, in this refrigeration apparatus, heat radiation loss in the heat source-side heat exchanger functioning as a radiator of refrigerant can be reduced and the operating efficiency can be improved during the cooling operation, and heat radiation to the exterior can be suppressed to prevent a decrease in operating efficiency during the heating operation.

However, as described above, the intermediate heat exchanger and the intermediate heat exchanger bypass tube are provided in addition to the intermediate pressure injection configuration using the second-stage injection tube, and during the heating operation in which the switching mechanism is in the heating operation state, the cooling effect by the intermediate heat exchanger on the refrigerant drawn into the second-stage compression element is not achieved when the refrigerant discharged from the first-stage compression element and drawn into the second-stage compression element is not cooled by the intermediate heat exchanger, and a problem is encountered in that the coefficient of performance does not improve proportionately.

In view whereof, injection rate optimization control is performed in this refrigeration apparatus for controlling the flow rate of the refrigerant returned to the second-stage compression element through the second-stage injection tube, so that the injection ratio, which is the ratio of the flow rate of the refrigerant returned to the second-stage compression element through the second-stage injection tube relative to the flow rate of the refrigerant discharged from the compression mechanism, is greater during the heating operation than during the cooling operation. The cooling effect by the intermediate pressure injection using the second-stage injection tube on the refrigerant drawn into the second-stage compression element is thereby greater during the heating operation than during the cooling operation, and the temperature of the refrigerant discharged from the compression mechanism can therefore be kept even lower while heat radiation to the exterior is suppressed, even during the heating operation in which the intermediate heat exchanger has no cooling effect on the refrigerant drawn into the second-stage compression element, and the coefficient of performance can thereby be improved.

The refrigeration apparatus according to a second aspect of the present invention is the refrigeration apparatus according to the first aspect of the present invention, wherein the injection rate optimization control is to control the flow rate of the refrigerant returned to the second-stage compression element through the second-stage injection tube so that the degree of superheating of the refrigerant drawn into the second-stage compression element reaches a target value, and the target value of the degree of superheating during the heating operation is set to be equal to or less than the target value of the degree of superheating during the cooling operation.

In this refrigeration apparatus, since injection rate optimization control involves controlling the flow rate of the refrigerant returned to the second-stage compression element through the second-stage injection tube so that the degree of superheating of the refrigerant admitted into the second-stage compression element reaches a target value, and the target value of the degree of superheating during the heating operation is set to be equal to or less than the target value of the degree of superheating during the cooling operation; the injection ratio, which is the ratio of the flow rate of the refrigerant returned to the second-stage compression element through the second-stage injection tube relative to the flow rate of the refrigerant discharged from the compression mechanism, is greater during the heating operation than during the cooling operation. The cooling effect by the intermediate pressure injection using the second-stage injection tube on the refrigerant drawn into the second-stage compression element is thereby greater during the heating operation than during the cooling operation, and the temperature of the refrigerant discharged from the compression mechanism can therefore be kept even lower while heat radiation to the exterior is suppressed, even during the heating operation in which the intermediate heat exchanger has no cooling effect on the refrigerant drawn into the second-stage compression element, and the coefficient of performance can thereby be improved.

The refrigeration apparatus according to a third aspect of the present invention is the refrigeration apparatus according to the first aspect of the present invention, further comprising a gas-liquid separator for performing gas-liquid separation on refrigerant whose heat has been radiated in the heat source-side heat exchanger or the usage-side heat exchanger. The second-stage injection tube has a first second-stage injection tube for returning the gas refrigerant resulting from gas-liquid separation in the gas-liquid separator to the second-stage compression element, and a second second-stage injection tube for branching off refrigerant from between the gas-liquid separator and the heat source-side heat exchanger or usage-side heat exchanger functioning as a radiator and returning the refrigerant to the second-stage compression element. The injection rate optimization control is to control the flow rate of refrigerant returned to the second-stage compression element through the second second-stage injection tube so that the degree of superheating of the refrigerant drawn into the second-stage compression element reaches a target value, the target value of the degree of superheating during the heating operation being set so as to be equal to or less than the target value of the degree of superheating during the cooling operation.

In this refrigeration apparatus, so-called intermediate pressure injection by the gas-liquid separator is used to perform gas-liquid separation on the refrigerant whose heat has been radiated in the heat source-side heat exchanger or the usage-side heat exchanger, and to return the gas refrigerant resulting from this gas-liquid separation to the second-stage compression element through the first second-stage injection tube.

However, with intermediate pressure injection by the gas-liquid separator, the flow rate of refrigerant that can be returned to the second-stage compression element through the first second-stage injection tube is determined by the liquid-gas ratio of refrigerant flowing into the gas-liquid separator, and it is therefore difficult to control the flow rate of refrigerant returning to the second-stage compression element through the first second-stage injection tube.

In view of this, this refrigeration apparatus has a configuration in which a second second-stage injection tube is provided for branching off refrigerant from between the gas-liquid separator and the heat source-side heat exchanger or usage-side heat exchanger functioning as a radiator and returning the refrigerant to the second-stage compression element, and in addition to intermediate pressure injection by the gas-liquid separator, liquid injection is performed for returning the liquid refrigerant to the second-stage compression element with the use of the second second-stage injection tube. The method used as injection rate optimization control involves controlling the flow rate of refrigerant returned to the second-stage compression element through the second second-stage injection tube so that the degree of superheating of the refrigerant drawn into the second-stage compression element reaches a target value, wherein the target value of the degree of superheating during the heating operation is set so as to be equal to or less than the target value of the degree of superheating during the cooling operation; therefore, the injection ratio, which is the ratio of the flow rate of the refrigerant returned to the second-stage compression element through the second-stage injection tube (both the first second-stage injection tube and the second second-stage injection tube herein) relative to the flow rate of refrigerant discharged from the compression mechanism, is greater during the heating operation than during the cooling operation. Thereby, in this refrigeration apparatus, the cooling effect by intermediate pressure injection using the second-stage injection tube on the refrigerant drawn into the second-stage compression element is greater during the heating operation than during the cooling operation, and it is therefore possible to keep the temperature of the refrigerant discharged from the compression mechanism even lower and to improve the coefficient of performance while suppressing heat radiation to the exterior, even during the heating operation during which the intermediate heat exchanger has no cooling effect on the refrigerant drawn into the second-stage compression element.

The refrigeration apparatus according to a fourth aspect of the present invention is the refrigeration apparatus according to the second or third aspect of the present invention, wherein the target value of the degree of superheating during the heating operation is set to the same value as the target value of the degree of superheating during the cooling operation.

In the refrigeration apparatus which performs intermediate pressure injection, when the ratio of the flow rate of the refrigerant returned to the second-stage compression element through the second-stage injection tube relative to the flow rate of the refrigerant discharged from the compression mechanism is designated as the injection ratio, there is an optimum injection ratio at which the coefficient of performance reaches a maximum. With this refrigeration apparatus, the optimum injection ratio during the heating operation tends to be greater than the optimum injection ratio during the cooling operation, and the reason for this tendency is believed to be because the intermediate heat exchanger is not used during the heating operation. That is, in this refrigeration apparatus, the optimum injection ratio during the heating operation is believed to be greater by an amount equivalent to the cooling effect by the intermediate heat exchanger because the refrigerant drawn into the second-stage compression element is cooled by intermediate pressure injection alone during the heating operation, in comparison with the cooling operation in which both the intermediate heat exchanger and intermediate pressure injection are used.

In view whereof, the target value of the degree of superheating during the heating operation is set in this refrigeration apparatus to the same value as the target value of the degree of superheating during the cooling operation, whereby the refrigerant drawn into the second-stage compression element during the heating operation is cooled by intermediate pressure injection during the heating operation to the same degree of superheating as that of the cooling operation for cooling the refrigerant by the intermediate heat exchanger and by intermediate pressure injection, and the injection ratio is greater during the heating operation than during the cooling operation by an amount equivalent to the cooling effect by the intermediate heat exchanger. Thereby, in this refrigeration apparatus, in cases in which the target value of the degree of superheating during the cooling operation is set near a value corresponding to the optimum injection ratio at which the coefficient of performance during the cooling operation reaches a maximum, the injection ratio during the heating operation as well approaches the optimum injection ratio at which the coefficient of performance during the heating operation reaches a maximum, and intermediate pressure injection can be performed at the optimum injection ratio at which the coefficient of performance reaches a maximum during both the cooling operation and the heating operation.

The refrigeration apparatus according to a fifth aspect of the present invention is the refrigeration apparatus according to the first aspect of the present invention, further comprising an economizer heat exchanger for performing heat exchange between the refrigerant whose heat has been radiated in the heat source-side heat exchanger or the usage-side heat exchanger and the refrigerant flowing through the second-stage injection tube. The injection rate optimization control is to control the flow rate of refrigerant returned to the second-stage compression element through the second-stage injection tube so that the degree of superheating of the refrigerant in the second-stage injection tube-side outlet of the economizer heat exchanger reaches a target value, the target value of the degree of superheating during the heating operation being set so as to be less than the target value of the degree of superheating during the cooling operation.

This refrigeration apparatus has a configuration in which heat exchange is performed in the economizer heat exchanger between the refrigerant whose heat has been released in the heat source-side heat exchanger or the usage-side heat exchanger and the refrigerant flowing through the second-stage injection tube, and so-called intermediate pressure injection by the economizer heat exchanger is performed for returning the refrigerant flowing through the second-stage injection tube after undergoing this heat exchange to the second-stage compression element. The method used as injection rate optimization control involves controlling the flow rate of refrigerant returned to the second-stage compression element through the second-stage injection tube so that the degree of superheating of the refrigerant in the outlet of the second-stage injection tube of the economizer heat exchanger reaches a target value, wherein the target value of the degree of superheating during the heating operation is set so as to be less than the target value of the degree of superheating during the cooling operation; therefore, the injection ratio, which is the ratio of the flow rate of the refrigerant returned to the second-stage compression element through the second-stage injection tube relative to the flow rate of refrigerant discharged from the compression mechanism, is greater during the heating operation than during the cooling operation. Thereby, in this refrigeration apparatus, the cooling effect by intermediate pressure injection by the economizer heat exchanger on the refrigerant drawn into the second-stage compression element is greater during the heating operation than during the cooling operation, and it is therefore possible to keep the temperature of the refrigerant discharged from the compression mechanism even lower and to improve the coefficient of performance while suppressing heat radiation to the exterior, even during the heating operation during which the intermediate heat exchanger has no cooling effect on the refrigerant drawn into the second-stage compression element.

The refrigeration apparatus according to a sixth aspect of the present invention is the refrigeration apparatus according to the fifth aspect of the present invention, wherein the target value of the degree of superheating during the heating operation is set to a value which is 5° C. to 10° C. less than the target value of the degree of superheating during the cooling operation.

In the refrigeration apparatus which performs intermediate pressure injection, when the ratio of the flow rate of the refrigerant returned to the second-stage compression element through the second-stage injection tube relative to the flow rate of the refrigerant discharged from the compression mechanism is designated as the injection ratio, there is an optimum injection ratio at which the coefficient of performance reaches a maximum. With this refrigeration apparatus, the optimum injection ratio during the heating operation tends to be greater than the optimum injection ratio during the cooling operation, and the reason for this tendency is believed to be because the intermediate heat exchanger is not used during the heating operation. That is, in this refrigeration apparatus, the optimum injection ratio during the heating operation is believed to be greater by an amount equivalent to the cooling effect by the intermediate heat exchanger because the refrigerant drawn into the second-stage compression element is cooled by intermediate pressure injection alone during the heating operation, in comparison with the cooling operation in which both the intermediate heat exchanger and intermediate pressure injection are used.

In view whereof, the target value of the degree of superheating during the heating operation is set in this refrigeration apparatus to a value which is less than the target value of the degree of superheating during the cooling operation by 5° C. to 10° C., whereby the refrigerant admitted into the second-stage compression element during the heating operation is cooled by intermediate pressure injection during the heating operation to approximately the same degree of superheating as that of the cooling operation for cooling the refrigerant by the intermediate heat exchanger and by intermediate pressure injection, and the injection ratio is greater during the heating operation than during the cooling operation by an amount equivalent to the cooling effect by the intermediate heat exchanger. Thereby, in this refrigeration apparatus, in cases in which the target value of the degree of superheating during the cooling operation is set near a value corresponding to the optimum injection ratio at which the coefficient of performance during the cooling operation reaches a maximum, the injection ratio during the heating operation as well approaches the optimum injection ratio at which the coefficient of performance during the heating operation reaches a maximum, and intermediate pressure injection can be performed at the optimum injection ratio at which the coefficient of performance reaches a maximum during both the cooling operation and the heating operation.

The refrigeration apparatus according to a seventh aspect of the present invention is the refrigeration apparatus according to the first aspect of the present invention, further comprising a gas-liquid separator for performing gas-liquid separation on the refrigerant whose heat has been radiated in the usage-side heat exchanger during the heating operation. The second-stage injection tube has a first second-stage injection tube for returning the gas refrigerant resulting from gas-liquid separation in the gas-liquid separator to the second-stage compression element during the heating operation, a second second-stage injection tube for branching off refrigerant from between the usage-side heat exchanger and the gas-liquid separator and returning the refrigerant to the second-stage compression element during the heating operation, and a third second-stage injection tube for branching off the refrigerant whose heat has been radiated in the heat source-side heat exchanger and returning the refrigerant to the second-stage compression element during the cooling operation. The refrigeration apparatus also further comprises an economizer heat exchanger for performing heat exchange between the refrigerant whose heat has been radiated in the heat source-side heat exchanger and the refrigerant flowing through the third second-stage injection tube during the cooling operation. The injection rate optimization control is to control the flow rate of refrigerant returned to the second-stage compression element through the third second-stage injection tube during the cooling operation so that the degree of superheating of the refrigerant drawn into the second-stage compression element reaches a target value, and also to control the flow rate of refrigerant returned to the second-stage compression element through the second second-stage injection tube during the heating operation so that the degree of superheating of the refrigerant drawn into the second-stage compression element reaches a target value, the target value of the degree of superheating during the heating operation being set so as to be equal to or less than the target value of the degree of superheating during the cooling operation.

For example, in the refrigeration apparatus according to the third or fourth aspect, wherein intermediate pressure injection is performed by the gas-liquid separator and liquid injection is performed by the second second-stage injection tube, another possibility is to configure the refrigeration apparatus to have a plurality of usage-side heat exchangers connected in parallel to each other, and to provide expansion mechanisms so as to correspond to the usage-side heat exchangers in order to control the flow rates of refrigerant flowing through the usage-side heat exchangers and make it possible to obtain the refrigeration loads required in the usage-side heat exchangers. In this case, the flow rates of refrigerant passing through the usage-side heat exchangers during the heating operation are established for the most part by the opening degrees of the expansion mechanisms provided corresponding to the usage-side heat exchangers, but at this time, the opening degrees of the expansion mechanisms fluctuate not only according to the flow rates of the refrigerant flowing through the usage-side heat exchangers but also according to the distribution of the flow rates among the plurality of usage-side heat exchangers, and there are cases in which the opening degrees differ greatly among the plurality of expansion mechanisms or the opening degrees of the expansion mechanisms are comparatively small; therefore, cases could arise in which the pressure of the gas-liquid separator decreases excessively due to the opening degree control of the expansion mechanisms during the heating operation. Therefore, since intermediate pressure injection by the gas-liquid separator can still be used even under conditions in which the pressure difference between the pressure of the gas-liquid separator and the intermediate pressure in the refrigeration cycle is small, this intermediate pressure injection is advantageous when there is a high risk of the pressure of the gas-liquid separator decreasing excessively, as in the heating operation in this configuration.

In the refrigeration apparatus according to the fifth or sixth aspect, in which intermediate pressure injection is performed by the economizer heat exchanger, another possibility is to configure the refrigeration apparatus to have a plurality of usage-side heat exchangers connected in parallel to each other, and to provide expansion mechanisms so as to correspond to the usage-side heat exchangers in order to control the flow rates of the refrigerant flowing through the usage-side heat exchangers and achieve the refrigeration loads required in the usage-side heat exchangers. In this case, during the cooling operation, because of the condition that it be possible to use the pressure difference between the high pressure in the refrigeration cycle and the nearly intermediate pressure of the refrigeration cycle without performing a severe depressurizing operation until the time that the refrigerant whose heat has been radiated in the heat source-side heat exchanger flows into the economizer heat exchanger, the quantity of heat exchanged in the economizer heat exchanger increases and the flow rate of refrigerant that can return to the second-stage compression element increases; therefore, the application of this configuration is more advantageous than intermediate pressure injection by the gas-liquid separator.

Thus, assuming that the configuration has a plurality of usage-side heat exchangers connected in parallel to each other, and also that the configuration has expansion mechanisms provided so as to correspond to the usage-side heat exchangers in order to control the flow rates of refrigerant flowing through the usage-side heat exchangers and make it possible to obtain the refrigeration loads required in the usage-side heat exchangers; the refrigeration apparatus is preferably configured in the manner of this refrigeration apparatus, which is that during the heating operation, the refrigerant whose heat has been radiated in the usage-side heat exchangers undergoes gas-liquid separation in the gas-liquid separator, and so-called intermediate pressure injection by the gas-liquid separator and liquid injection by the second second-stage injection tube are performed for passing the gas refrigerant resulting from gas-liquid separation through the first second-stage injection tube and returning the refrigerant to the second-stage compression element; while during the cooling operation, heat exchange is performed in the economizer heat exchanger between the refrigerant whose heat has been radiated in the heat source-side heat exchanger and the refrigerant flowing through the second-stage injection tube; and so-called intermediate pressure injection is performed by the economizer heat exchanger for returning to the second-stage compression element the refrigerant that flows through the second-stage injection tube after having undergone this heat exchange. The method used as injection rate optimization control involves controlling the flow rate of refrigerant returned to the second-stage compression element through the third second-stage injection tube during the cooling operation so that the degree of superheating of the refrigerant drawn into the second-stage injection tube reaches a target value, and also controlling the flow rate of the refrigerant returned to the second-stage compression element through the second second-stage injection tube during the heating operation so that the degree of superheating of the refrigerant drawn into the second-stage compression element reaches a target value, wherein the target value of the degree of superheating during the heating operation is set so as to be equal to or less than the target value of the degree of superheating during the cooling operation; therefore, the injection ratio, which is the ratio of the flow rate of the refrigerant returned to the second-stage compression element through the second-stage injection tube (the third second-stage injection tube during the cooling operation, and both the first second-stage injection tube and second second-stage injection tube during the heating operation) relative to the flow rate of refrigerant discharged from the compression mechanism, is greater during the heating operation than during the cooling operation. Thereby, in this refrigeration apparatus, the cooling effect by intermediate pressure injection using the second-stage injection tube on the refrigerant drawn into the second-stage compression element is greater during the heating operation than during the cooling operation, and it is therefore possible to keep the temperature of the refrigerant discharged from the compression mechanism even lower and to improve the coefficient of performance while suppressing heat radiation to the exterior, even during the heating operation during which the intermediate heat exchanger has no cooling effect on the refrigerant drawn into the second-stage compression element.

The refrigeration apparatus according to an eighth aspect of the present invention is the refrigeration apparatus according to the seventh aspect of the present invention, wherein the target value of the degree of superheating during the heating operation is set to the same value as the target value of the degree of superheating during the cooling operation.

In the refrigeration apparatus which performs intermediate pressure injection, when the ratio of the flow rate of the refrigerant returned to the second-stage compression element through the second-stage injection tube relative to the flow rate of the refrigerant discharged from the compression mechanism is designated as the injection ratio, there is an optimum injection ratio at which the coefficient of performance reaches a maximum. With this refrigeration apparatus, the optimum injection ratio during the heating operation tends to be greater than the optimum injection ratio during the cooling operation, and the reason for this tendency is believed to be because the intermediate heat exchanger is not used during the heating operation. That is, in this refrigeration apparatus, the optimum injection ratio during the heating operation is believed to be greater by an amount equivalent to the cooling effect by the intermediate heat exchanger because the refrigerant drawn into the second-stage compression element is cooled by intermediate pressure injection alone during the heating operation, in comparison with the cooling operation in which both the intermediate heat exchanger and intermediate pressure injection are used.

In view of this, the target value of the degree of superheating during the heating operation is set in this refrigeration apparatus to the same value as the target value of the degree of superheating during the cooling operation, whereby the refrigerant drawn into the second-stage compression element during the heating operation is cooled by intermediate pressure injection during the heating operation to the same degree of superheating as that of the cooling operation for cooling the refrigerant by the intermediate heat exchanger and by intermediate pressure injection, and the injection ratio is greater during the heating operation than during the cooling operation by an amount equivalent to the cooling effect by the intermediate heat exchanger. Thereby, in this refrigeration apparatus, in cases in which the target value of the degree of superheating during the cooling operation is set near a value corresponding to the optimum injection ratio at which the coefficient of performance during the cooling operation reaches a maximum, the injection ratio during the heating operation as well approaches the optimum injection ratio at which the coefficient of performance during the heating operation reaches a maximum, and intermediate pressure injection can be performed at the optimum injection ratio at which the coefficient of performance reaches a maximum during both the cooling operation and the heating operation.

DESCRIPTION OF EMBODIMENTS

Embodiments of the refrigeration apparatus according to the present invention are described hereinbelow with reference to the drawings.

(1) Configuration of Air-conditioning Apparatus

Figure 1:
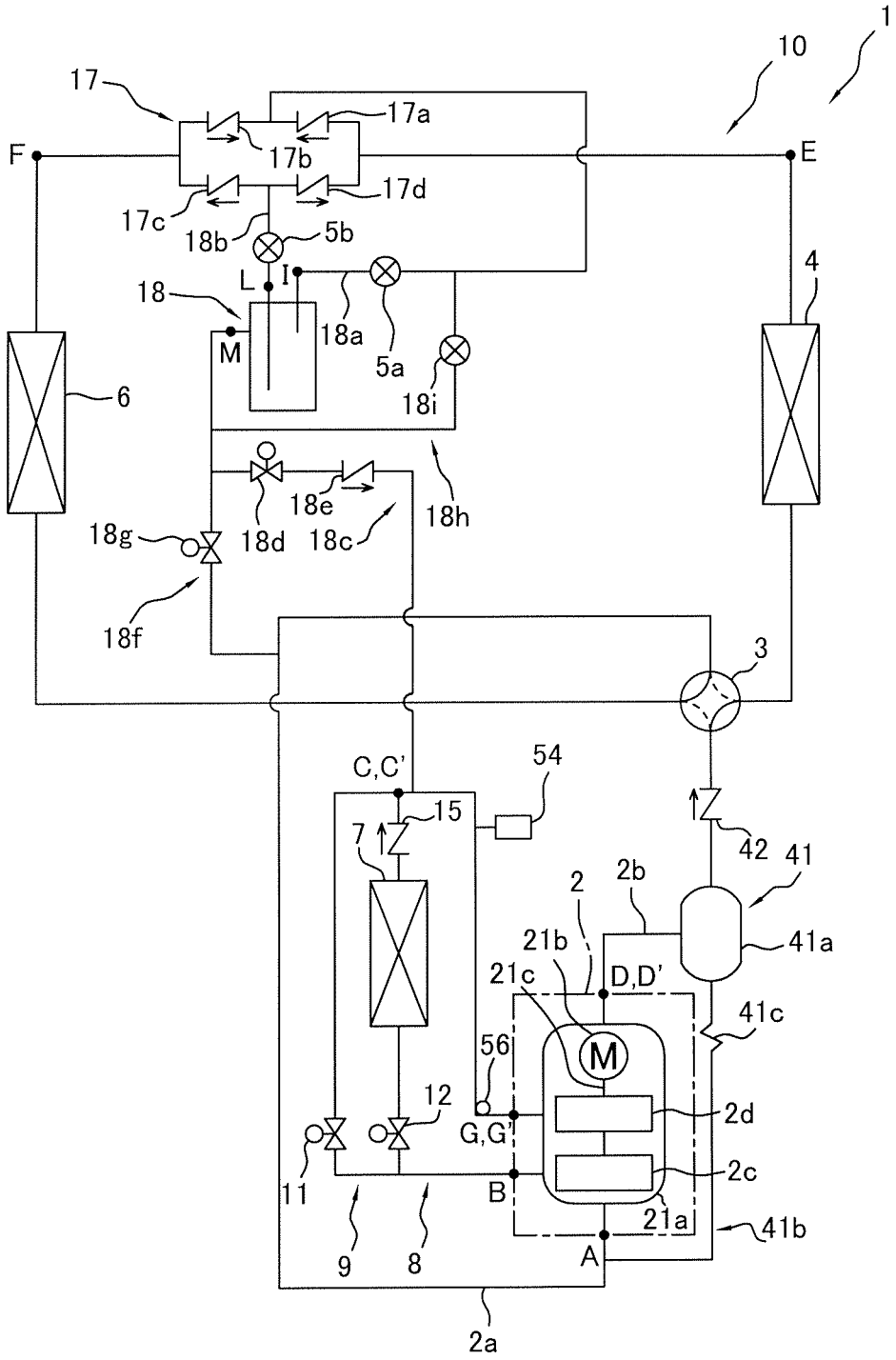
FIG. 1 is a schematic structural diagram of an air-conditioning apparatus as an embodiment of the refrigeration apparatus according to the present invention.

FIG. 1 is a schematic structural diagram of an air-conditioning apparatus 1 as an embodiment of the refrigeration apparatus according to the present invention. The air-conditioning apparatus 1 has a refrigerant circuit 10 configured to be capable of switching between an air-cooling operation and an air-warming operation, and the apparatus performs a two-stage compression refrigeration cycle by using a refrigerant (carbon dioxide in this case) for operating in a supercritical range.

The refrigerant circuit 10 of the air-conditioning apparatus 1 has primarily a compression mechanism 2, a switching mechanism 3, a heat source-side heat exchanger 4, a bridge circuit 17, a first expansion mechanism 5*a*, a receiver 18 as a gas-liquid separator, a first second-stage injection tube 18*c*, a liquid injection tube 18*h* as a second second-stage injection tube, a second expansion mechanism 5*b*, a usage-side heat exchanger 6, and an intermediate heat exchanger 7.

In the present embodiment, the compression mechanism 2 is configured from a compressor 21 which uses two compression elements to subject a refrigerant to two-stage compression. The compressor 21 has a hermetic structure in which a compressor drive motor 21*b*, a drive shaft 21*c*, and compression elements 2*c*, 2*d* are housed within a casing 21*a*. The compressor drive motor 21*b* is linked to the drive shaft 21*c*. The drive shaft 21*c* is linked to the two compression elements 2*c*, 2*d*. Specifically, the compressor 21 has a so-called single-shaft two-stage compression structure in which the two compression elements 2*c*, 2*d* are linked to a single drive shaft 21*c* and the two compression elements 2*c*, 2*d* are both rotatably driven by the compressor drive motor 21*b*. In the present embodiment, the compression elements 2*c*, 2*d* are rotary elements, scroll elements, or another type of positive displacement compression elements. The compressor 21 is configured so as to draw refrigerant through an intake tube 2*a*, to discharge this refrigerant to an intermediate refrigerant tube 8 after the refrigerant has been compressed by the compression element 2*c*, to draw the refrigerant discharged to the intermediate refrigerant tube 8 into the compression element 2*d*, and to discharge the refrigerant to a discharge tube 2*b* after the refrigerant has been further compressed. The intermediate refrigerant tube 8 is a refrigerant tube for taking refrigerant into the compression element 2*d* connected to the second-stage side of the compression element 2*c* after the refrigerant has been discharged from the compression element 2*c* connected to the first-stage side of the compression element 2*c*. The discharge tube 2*b* is a refrigerant tube for feeding refrigerant discharged from the compression mechanism 2 to the switching mechanism 3, and the discharge tube 2*b* is provided with an oil separation mechanism 41 and a non-return mechanism 42. The oil separation mechanism 41 is a mechanism for separating refrigerator oil accompanying the refrigerant from the refrigerant discharged from the compression mechanism 2 and returning the oil to the intake side of the compression mechanism 2, and the oil separation mechanism 41 has primarily an oil separator 41*a* for separating refrigerator oil accompanying the refrigerant from the refrigerant discharged from the compression mechanism 2, and an oil return tube 41*b* connected to the oil separator 41*a* for returning the refrigerator oil separated from the refrigerant to the intake tube 2*a* of the compression mechanism 2. The oil return tube 41*b* is provided with a depressurization mechanism 41*c* for depressurizing the refrigerator oil flowing through the oil return tube 41*b*. A capillary tube is used for the depressurization mechanism 41*c* in the present embodiment. The non-return mechanism 42 is a mechanism for allowing the flow of refrigerant from the discharge side of the compression mechanism 2 to the switching mechanism 3 and for blocking the flow of refrigerant from the switching mechanism 3 to the discharge side of the compression mechanism 2, and a non-return valve is used in the present embodiment.

Thus, in the present embodiment, the compression mechanism 2 has two compression elements 2*c*, 2*d* and is configured so that among these compression elements 2*c*, 2*d*, refrigerant discharged from the first-stage compression element is compressed in sequence by the second-stage compression element.

The switching mechanism 3 is a mechanism for switching the direction of refrigerant flow in the refrigerant circuit 10. In order to allow the heat source-side heat exchanger 4 to function as a cooler of refrigerant compressed by the compression mechanism 2 and to allow the usage-side heat exchanger 6 to function as a heater of refrigerant cooled in the heat source-side heat exchanger 4 during the air-cooling operation, the switching mechanism 3 is capable of connecting the discharge side of the compression mechanism 2 and one end of the heat source-side heat exchanger 4 and also connecting the intake side of the compressor 21 and the usage-side heat exchanger 6 (refer to the solid lines of the switching mechanism 3 in FIG. 1, this state of the switching mechanism 3 is hereinbelow referred to as the "cooling operation state"). In order to allow the usage-side heat exchanger 6 to function as a cooler of refrigerant compressed by the compression mechanism 2 and to allow the heat source-side heat exchanger 4 to function as a heater of refrigerant cooled in the usage-side heat exchanger 6 during the air-warming operation, the switching mechanism 3 is capable of connecting the discharge side of the compression mechanism 2 and the usage-side heat exchanger 6 and also of connecting the intake side of the compression mechanism 2 and one end of the heat source-side heat exchanger 4 (refer to the dashed lines of the switching mechanism 3 in FIG. 1, this state of the switching mechanism 3 is hereinbelow referred to as the "heating operation state"). In the present embodiment, the switching mechanism 3 is a four-way switching valve connected to the intake side of the compression mechanism 2, the discharge side of the compression mechanism 2, the heat source-side heat exchanger 4, and the usage-side heat exchanger 6. The switching mechanism 3 is not limited to a four-way switching valve, and may be configured so as to have a function for switching the direction of the flow of the refrigerant in the same manner as described above by using, e.g., a combination of a plurality of electromagnetic valves.

Thus, focusing solely on the compression mechanism 2, the heat source-side heat exchanger 4, the first expansion mechanism 5*a*, the receiver 18, the second expansion mechanism 5*b*, and the usage-side heat exchanger 6 constituting the refrigerant circuit 10; the switching mechanism 3 is configured to be capable of switching between a cooling operation state in which the refrigerant is circulated sequentially through the compression mechanism 2, the heat source-side heat exchanger 4, the first expansion mechanism 5*a*, the receiver 18, the second expansion mechanism 5*b*, and the usage-side heat exchanger 6; and a heating operation state in which the refrigerant is circulated sequentially through the compression mechanism 2, the usage-side heat exchanger 6, the first expansion mechanism 5*a*, the receiver 18, the second expansion mechanism 5*b*, and the heat source-side heat exchanger 4.

The heat source-side heat exchanger 4 is a heat exchanger that functions as a radiator or an evaporator of refrigerant. One end of the heat source-side heat exchanger 4 is connected to the switching mechanism 3, and the other end is connected to the first expansion mechanism 5*a* via the bridge circuit 17. The heat source-side heat exchanger 4 is a heat exchanger that uses water and/or air as a heat source (i.e., a cooling source or a heating source).

The bridge circuit 17 is disposed between the heat source-side heat exchanger 4 and the usage-side heat exchanger 6, and is connected to a receiver inlet tube 18*a* connected to the inlet of the receiver 18 and to a receiver outlet tube 18*b* connected to the outlet of the receiver 18. The bridge circuit 17 has four non-return valves 17*a*, 17*b*, 17*c*, and 17*d* in the present embodiment. The inlet non-return valve 17*a* is a non-return valve that allows only the flow of refrigerant from the heat source-side heat exchanger 4 to the receiver inlet tube 18*a*. The inlet non-return valve 17*b* is a non-return valve that allows only the flow of refrigerant from the usage-side heat exchanger 6 to the receiver inlet tube 18*a*. In other words, the inlet non-return valves 17*a*, 17*b* have a function for allowing refrigerant to flow from one among the heat source-side heat exchanger 4 or the usage-side heat exchanger 6 to the receiver inlet tube 18*a*. The outlet non-return valve 17*c* is a non-return valve that allows only the flow of refrigerant from the receiver outlet tube 18*b* to the usage-side heat exchanger 6. The outlet non-return valve 17*d* is a non-return valve that allows only the flow of refrigerant from the receiver outlet tube 18*b* to the heat source-side heat exchanger 4. In other words, the outlet non-return valves 17*c*, 17*d* have a function for allowing refrigerant to flow from the receiver outlet tube 18*b* to the heat source-side heat exchanger 4 or the usage-side heat exchanger 6.

The first expansion mechanism 5*a* is a mechanism for depressurizing the refrigerant, is provided to the receiver inlet tube 18*a*, and is an electrically driven expansion valve in the present embodiment. In the present embodiment, during the air-cooling operation, the first expansion mechanism 5*a* depressurizes the high-pressure refrigerant in the refrigeration cycle that has been cooled in the heat source-side heat exchanger 4 nearly to the saturation pressure of the refrigerant before the refrigerant is fed to the usage-side heat exchanger 6 via the receiver 18; and during the air-warming operation, the first expansion mechanism 5*a* depressurizes the high-pressure refrigerant in the refrigeration cycle that has been cooled in the usage-side heat exchanger 6 nearly to the saturation pressure of the refrigerant before the refrigerant is fed to the heat source-side heat exchanger 4 via the receiver 18.

The receiver 18 is a container provided in order to temporarily retain the refrigerant that has been depressurized by the first expansion mechanism 5*a* so as to allow storage of excess refrigerant produced according to the operation states, such as the quantity of refrigerant circulating in the refrigerant circuit 10 being different between the air-cooling operation and the air-warming operation, and the inlet of the receiver 18 is connected to the receiver inlet tube 18*a*, while the outlet is connected to the receiver outlet tube 18*b*. Also connected to the receiver 18 is a first intake return tube 18*f* capable of withdrawing refrigerant from inside the receiver 18 and returning the refrigerant to the intake tube 2*a* of the compression mechanism 2 (i.e., to the intake side of the compression element 2*c* on the first-stage side of the compression mechanism 2).

The first second-stage injection tube 18*c* is a refrigerant tube capable of performing intermediate pressure injection for returning the gas refrigerant that has been separated from the liquid by the receiver 18 as a gas-liquid separator to the second-stage compression element 2*d* of the compression mechanism 2, and in the present embodiment, the first second-stage injection tube 18*c* is provided so as to connect the top part of the receiver 18 and the intermediate refrigerant tube 8 (i.e., the intake side of the second-stage compression element 2*d* of the compression mechanism 2). The first second-stage injection tube 18*c* is provided with a first second-stage injection on/off valve 18*d* and a first second-stage injection non-return mechanism 18*e*. The first second-stage injection on/off valve 18*d* is a valve capable of being controlled to open and close, and is an electromagnetic valve in the present embodiment. The first second-stage injection non-return mechanism 18*e* is a mechanism for allowing refrigerant to flow from the receiver 18 to the second-stage compression element 2*d* and blocking refrigerant from flowing from the second-stage compression element 2*d* to the receiver 18, and a non-return valve is used in the present embodiment.

The first intake return tube 18*f* is a refrigerant tube capable of withdrawing refrigerant from the receiver 18 and returning the refrigerant to the first-stage compression element 2*c* of the compression mechanism 2, and in the present embodiment, the first intake return tube 18*f* is provided so as to connect the top part of the receiver 18 and the intake tube 2*a* (i.e. the intake side of the first-stage compression element 2*c* of the compression mechanism 2). A first intake return on/off valve 18*g* is provided to this first intake return tube 18*f*. The first intake return on/off valve 18*g* is an electric valve capable of being controlled to open and close, and is an electromagnetic valve in the present embodiment.

Thus, when the first second-stage injection tube 18*c* and/or the first intake return tube 18*f* is used by opening the first second-stage injection on/off valve 18*d* and/or the first intake return on/off valve 18*g*, the receiver 18 functions as a gas-liquid separator for performing gas-liquid separation between the first expansion mechanism 5*a* and the second expansion mechanism 5*b* on the refrigerant flowing between the heat source-side heat exchanger 4 and the usage-side heat exchanger 6, and the gas refrigerant resulting from gas-liquid separation in the receiver 18 can primarily be returned from the top part of the receiver 18 to the second-stage compression element 2*d* and/or the first-stage compression element 2*c* of the compression mechanism 2.

The second expansion mechanism 5*b* is a mechanism provided to the receiver outlet tube 18*b* and used for depressurizing the refrigerant, and is an electrically driven expansion valve in the present embodiment. One end of the second expansion mechanism 5*b* is connected to the receiver 18 and the other end is connected to the usage-side heat exchanger 6 via the bridge circuit 17. In the present embodiment, during the air-cooling operation, the second expansion mechanism 5*b* further depressurizes the refrigerant depressurized by the first expansion mechanism 5*a* to a low pressure in the refrigeration cycle before the refrigerant is fed to the usage-side heat exchanger 6 via the receiver 18; and during the air-warming operation, the second expansion mechanism 5*b* further depressurizes the refrigerant depressurized by the first expansion mechanism 5*a* to a low pressure in the refrigeration cycle before the refrigerant is fed to the heat source-side heat exchanger 4 via the receiver 18.

The usage-side heat exchanger 6 is a heat exchanger that functions as an evaporator or radiator of refrigerant. One end of the usage-side heat exchanger 6 is connected to the first expansion mechanism 5*a* via the bridge circuit 17, and the other end is connected to the switching mechanism 3. The usage-side heat exchanger 6 is a heat exchanger that uses water and/or air as a heat source (i.e., a cooling source or a heating source).

Thus, when the switching mechanism 3 is brought to the cooling operation state by the bridge circuit 17, the receiver 18, the receiver inlet tube 18*a*, and the receiver outlet tube 18*b*, the high-pressure refrigerant cooled in the heat source-side heat exchanger 4 can be fed to the usage-side heat exchanger 6 through the inlet non-return valve 17*a* of the bridge circuit 17, the first expansion mechanism 5*a* of the receiver inlet tube 18*a*, the receiver 18, the second expansion mechanism 5*b* of the receiver outlet tube 18*b*, and the outlet non-return valve 17*c* of the bridge circuit 17. When the switching mechanism 3 is brought to the heating operation state, the high-pressure refrigerant cooled in the usage-side heat exchanger 6 can be fed to the heat source-side heat exchanger 4 through the inlet non-return valve 17*b* of the bridge circuit 17, the first expansion mechanism 5*a* of the receiver inlet tube 18*a*, the receiver 18, the second expansion mechanism 5*b* of the receiver outlet tube 18*b*, and the outlet non-return valve 17*d* of the bridge circuit 17.

The intermediate heat exchanger 7 is provided to the intermediate refrigerant tube 8, and in the present embodiment, the intermediate heat exchanger 7 is a heat exchanger capable of functioning as a cooler of the refrigerant discharged from the first-stage compression element 2*c* and admitted into the compression element 2*d* during the air-cooling operation.

The intermediate heat exchanger 7 is a heat exchanger that uses water and/or air as a heat source (herein a cooling source). Thus, it is acceptable to say that the intermediate heat exchanger 7 is a cooler that uses an external heat source, meaning that the intermediate heat exchanger 7 does not use the refrigerant that circulates through the refrigerant circuit 10.

An intermediate heat exchanger bypass tube 9 is connected to the intermediate refrigerant tube 8 so as to bypass the intermediate heat exchanger 7. This intermediate heat exchanger bypass tube 9 is a refrigerant tube for limiting the flow rate of refrigerant flowing through the intermediate heat exchanger 7. The intermediate heat exchanger bypass tube 9 is provided with an intermediate heat exchanger bypass on/off valve 11. The intermediate heat exchanger bypass on/off valve 11 is an electromagnetic valve in the present embodiment. In the present embodiment, the intermediate heat exchanger bypass on/off valve 11 essentially is controlled so as to close when the switching mechanism 3 is set for the cooling operation, and to open when the switching mechanism 3 is set for the heating operation. In other words, the intermediate heat exchanger bypass on/off valve 11 is closed when the air-cooling operation is performed and opened when the air-warming operation is performed.

The intermediate refrigerant tube 8 is also provided with an intermediate heat exchanger on/off valve 12 in the portion extending from the connection with the first-stage compression element 2*c* side end of the intermediate heat exchanger bypass tube 9 to the first-stage compression element 2*c* side end of the intermediate heat exchanger 7. This intermediate heat exchanger on/off valve 12 is a mechanism for limiting the flow rate of refrigerant flowing through the intermediate heat exchanger 7. The intermediate heat exchanger on/off valve 12 is an electromagnetic valve in the present embodiment. In the present embodiment, the intermediate heat exchanger on/off valve 12 is essentially controlled so as to open when the switching mechanism 3 is in the cooling operation state and to close when the switching mechanism 3 is in the heating operation state. In other words, the intermediate heat exchanger on/off valve 12 is controlled so as to open when the air-cooling operation is performed and close when the air-warming operation is performed.

The intermediate refrigerant tube 8 is also provided with a non-return mechanism 15 for allowing refrigerant to flow from the discharge side of the first-stage compression element 2*c* to the intake side of the second-stage compression element 2*d* and for blocking the refrigerant from flowing from the intake side of the second-stage compression element 2*d* to the discharge side of the first-stage compression element 2*c*. The non-return mechanism 15 is a non-return valve in the present embodiment. In the present embodiment, the non-return mechanism 15 is provided in the portion of the intermediate refrigerant tube 8 extending from the end of the intermediate heat exchanger 7 on the side near the second-stage compression element 2*d* to the end of the intermediate heat exchanger bypass tube 9 on the side near the second-stage compression element 2*d*.

The liquid injection tube 18*h* is a refrigerant tube which functions as a second second-stage injection tube for branching off refrigerant from between the receiver 18 and the heat source-side heat exchanger 4 or usage-side heat exchanger 6 functioning as a radiator of refrigerant and returning the refrigerant to the second-stage compression element 2*d* when the first second-stage injection tube 18*c* is used, i.e., when intermediate pressure injection is performed by the receiver 18 as a gas-liquid separator. The liquid injection tube 18*h* here is provided so as to connect the portion of the receiver inlet tube 18*a* upstream of the first expansion mechanism 5*a* and the intermediate refrigerant tube 8 (i.e., the intake side of the second-stage compression element 2*d* of the compression mechanism 2). The first second-stage injection tube 18*c* and the liquid injection tube 18*h* here are integrated in the portion near the intermediate refrigerant tube 8 (more specifically, from the portion of the first second-stage injection tube 18*c* where the first second-stage injection on/off valve 18*d* and the first second-stage injection non-return mechanism 18*e* are provided to the portion connecting with the intermediate refrigerant tube 8). The liquid injection tube 18*h* is provided with a liquid injection valve 18*i* as a second second-stage injection valve. The liquid injection valve 18*i* is a valve whose opening degree can be controlled, and is an electrically driven expansion valve in the present embodiment.

Thus, the air-conditioning apparatus 1 of the present embodiment has a configuration for performing a two-stage compression-type refrigeration cycle having a refrigerant circuit 10 capable of switching between a cooling operation and a heating operation and also capable of intermediate pressure injection via the receiver 18 as a gas-liquid separator, wherein providing the intermediate heat exchanger 7 and the intermediate heat exchanger bypass tube 9 ensures that the refrigerant discharged from the first-stage compression element 2*c* and admitted into the second-stage compression element 2*d* is cooled by the intermediate heat exchanger 7 during the air-cooling operation and also that the refrigerant discharged from the first-stage compression element 2*c* and admitted into the second-stage compression element 2*d* is not cooled by the intermediate heat exchanger 7 during the air-warming operation, and the liquid injection tube 18*h* as a second second-stage injection tube is also provided for branching off the refrigerant from between the receiver 18 and the heat source-side heat exchanger 4 or usage-side heat exchanger 6 as a radiator and returning the refrigerant to the second-stage compression element 2*d* when the first second-stage injection tube 18*c* is used, whereby injection rate optimization control described hereinafter is performed.

Furthermore, the air-conditioning apparatus 1 is provided with various sensors. Specifically, the intermediate refrigerant tube 8 is provided with an intermediate pressure sensor 54 for detecting the intermediate pressure during the refrigeration cycle, which is the pressure of the refrigerant that flows through the intermediate refrigerant tube 8. At a position in the intermediate refrigerant tube 8 nearer to the second-stage compression element 2*d* than the portion where the first second-stage injection tube 18*c* is connected, an intermediate temperature sensor 56 is provided for detecting the temperature of the refrigerant in the intake side of the second-stage compression element 2*d*. Though not shown in the drawings, the air-conditioning apparatus 1 also has a controller for controlling the actions of the compression mechanism 2, the switching mechanism 3, the expansion mechanisms 5*a*, 5*b*, the intermediate heat exchanger bypass on/off valve 11, the intermediate heat exchanger on/off valve 12, the first second-stage injection on/off valve 18*d*, the liquid injection valve 18*i*, the first intake return on/off valve 18*g*, and the other components constituting the air-conditioning apparatus 1.

(2) Action of the Air-conditioning Apparatus

Figure 2:
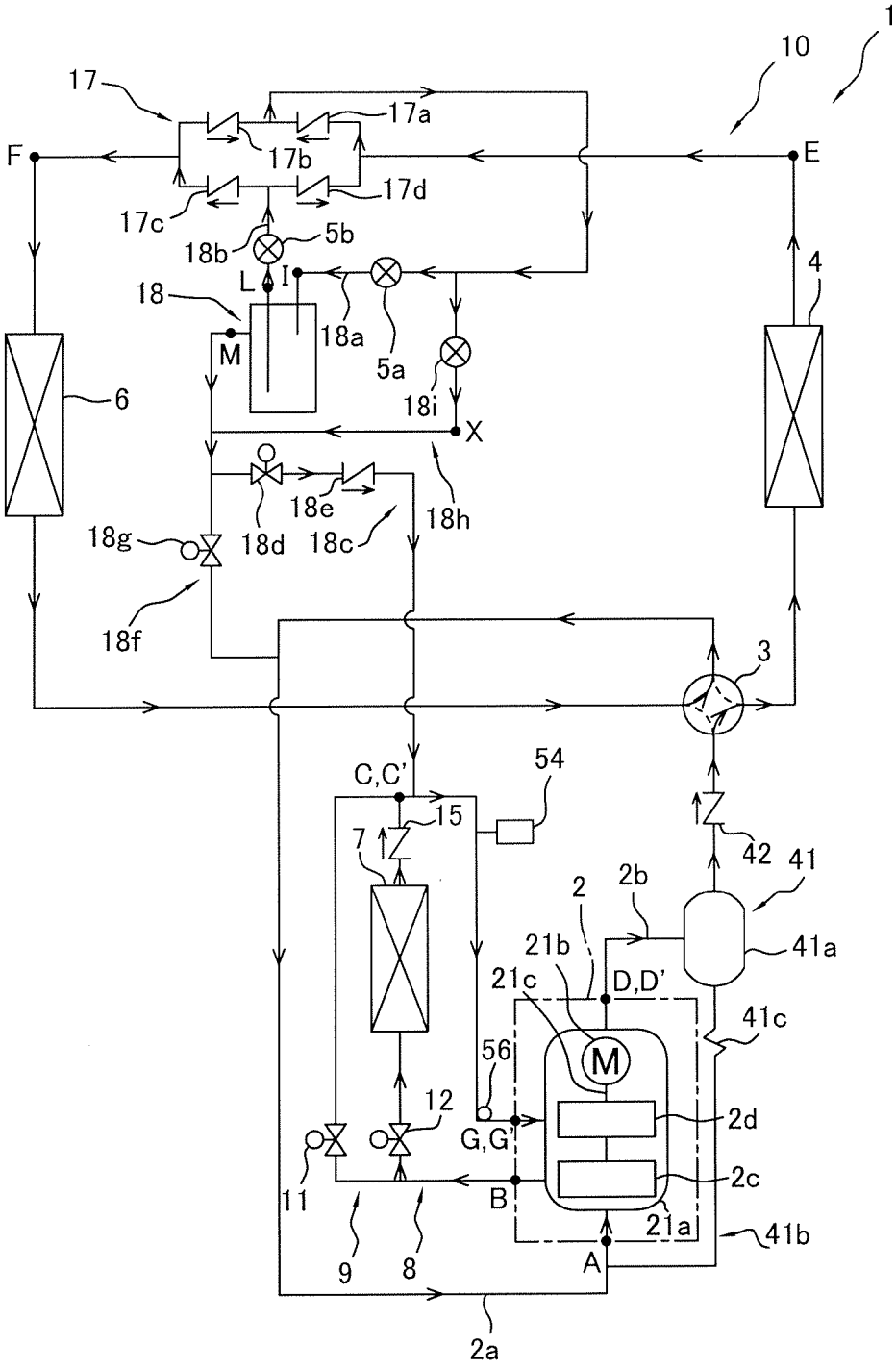
FIG. 2 is a diagram showing the flow of refrigerant within the air-conditioning apparatus during the air-cooling operation.
Figure 3:
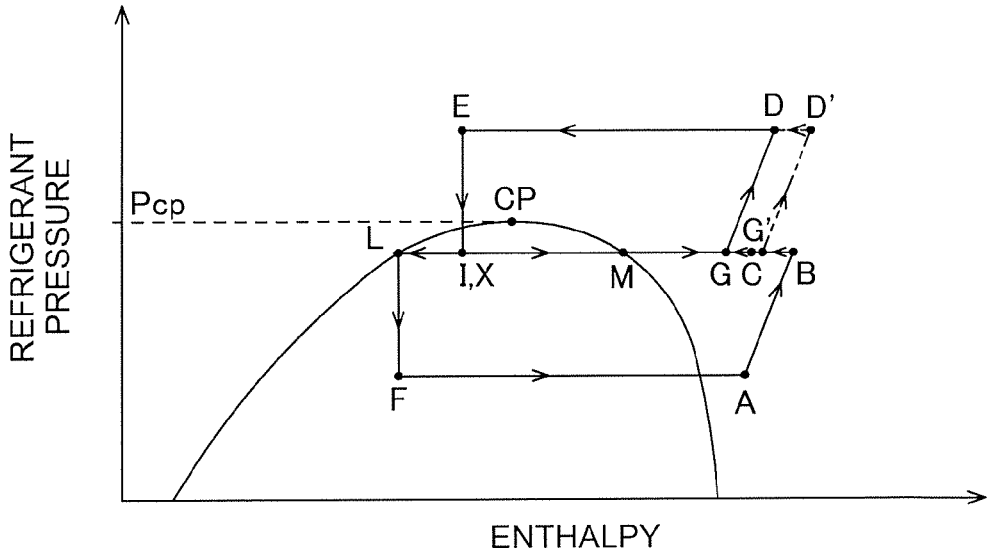
FIG. 3 is a pressure-enthalpy graph representing the refrigeration cycle during the air-cooling operation.
Figure 4:
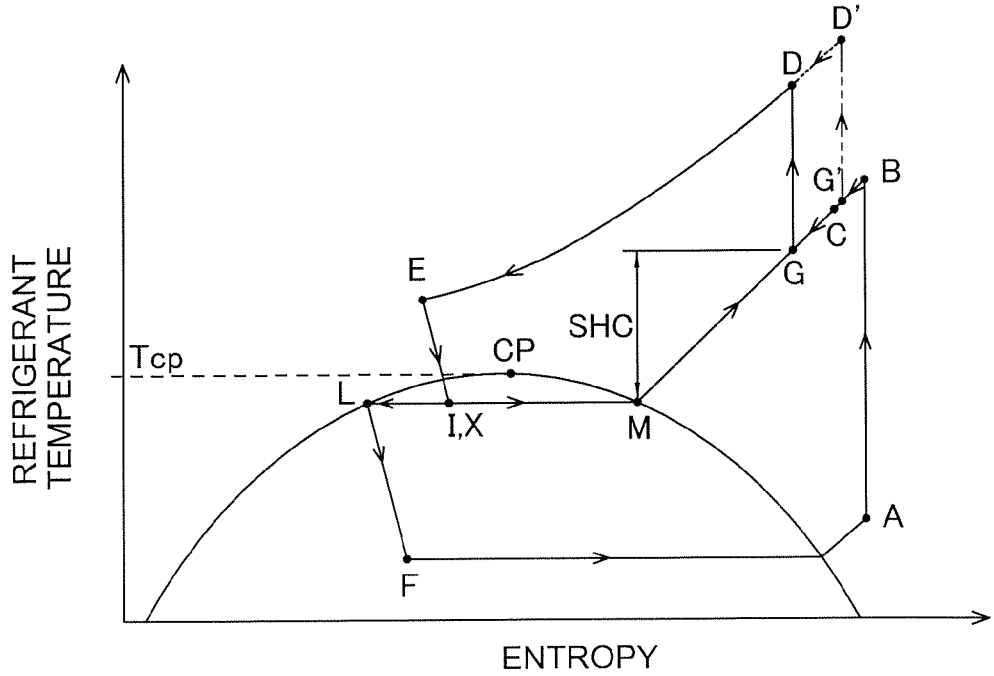
FIG. 4 is a temperature-entropy graph representing the refrigeration cycle during the air-cooling operation.
Figure 5:
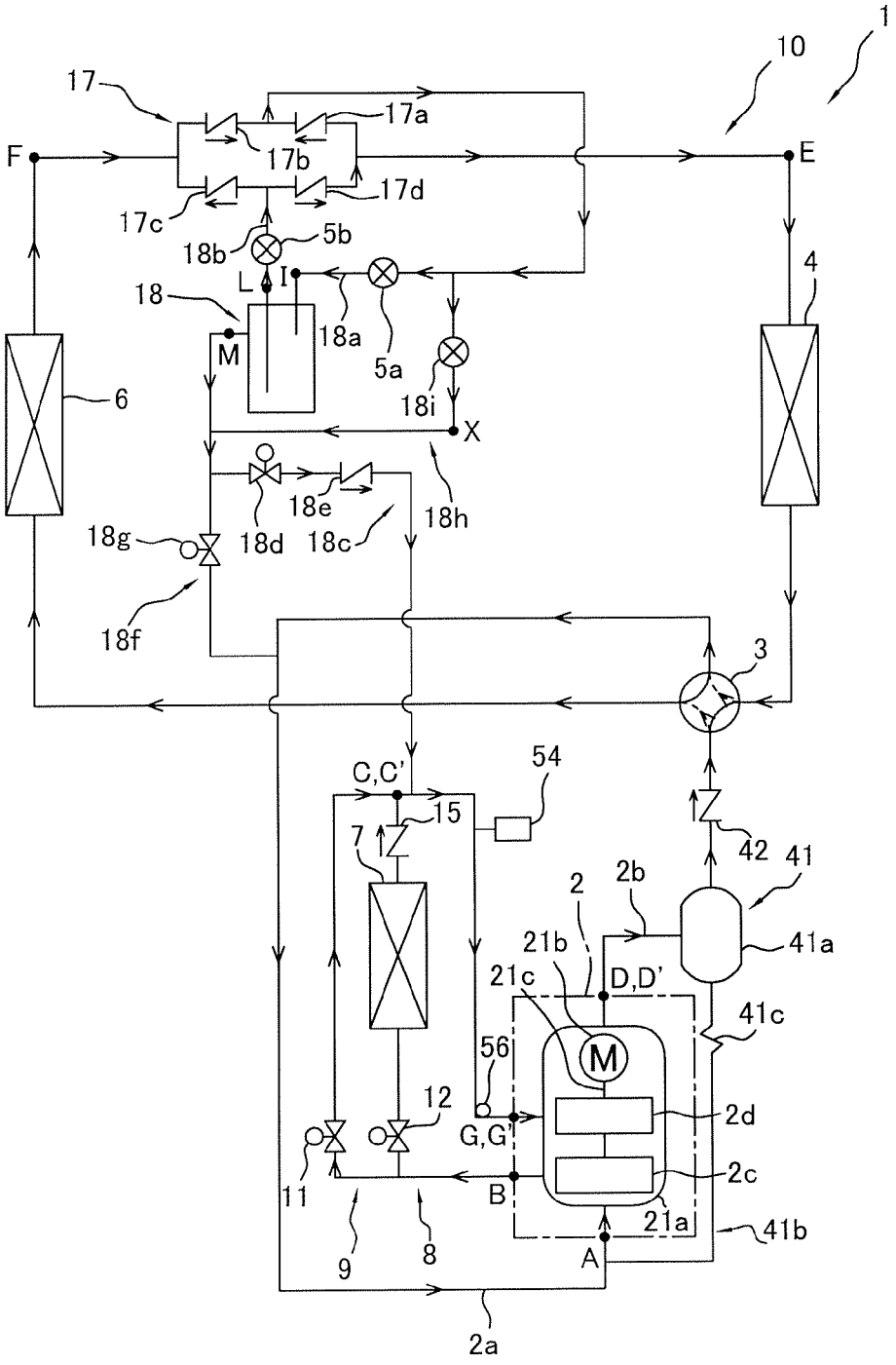
FIG. 5 is a diagram showing the flow of refrigerant within the air-conditioning apparatus during the air-warming operation.
Figure 6:
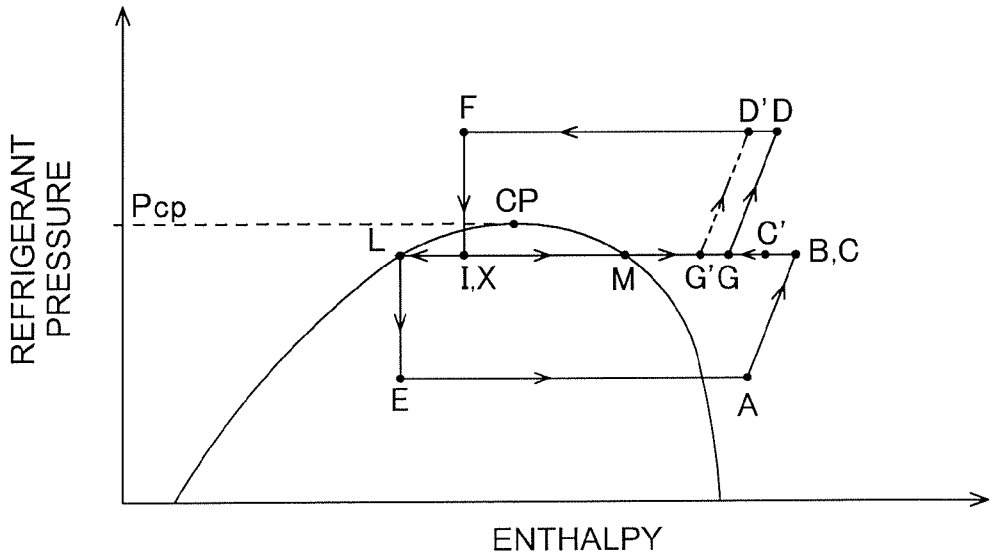
FIG. 6 is a pressure-enthalpy graph representing the refrigeration cycle during the air-warming operation.
Figure 7:
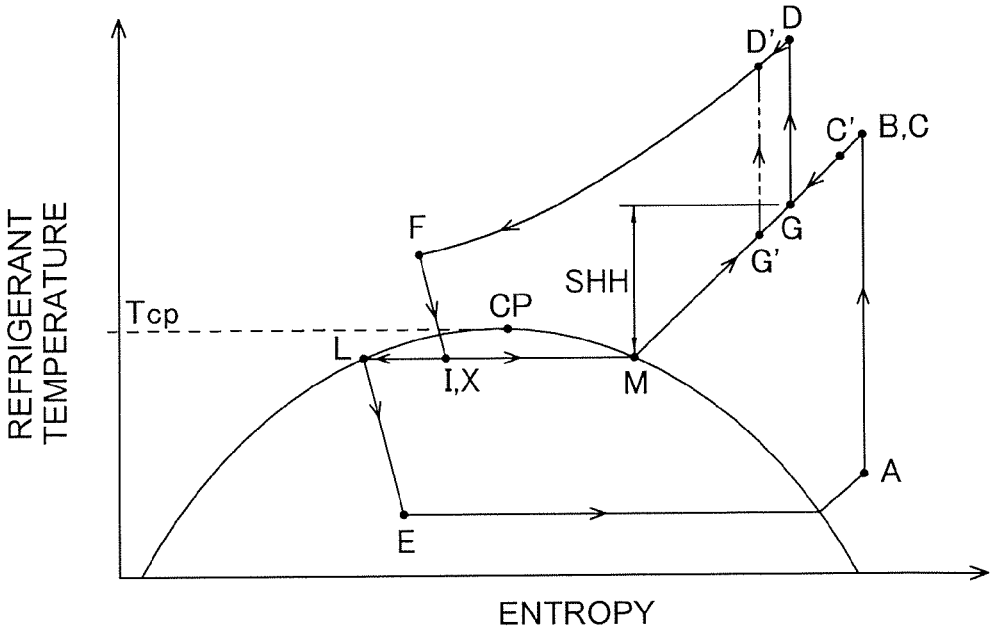
FIG. 7 is a temperature-entropy graph representing the refrigeration cycle during the air-warming operation.
Figure 8:
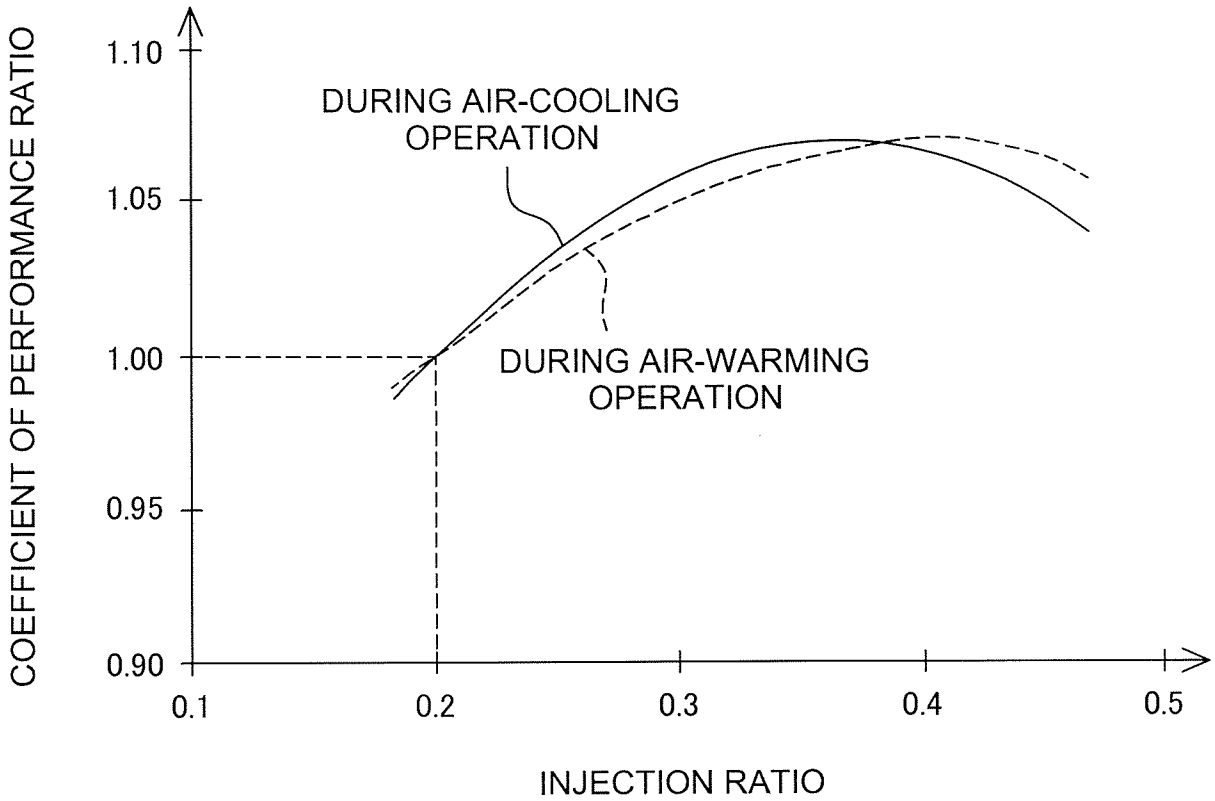
FIG. 8 is a graph showing the relationship of the injection ratio to both the coefficient of performance ratio in the air-cooling operation and the coefficient of performance ratio in the air-warming operation.

Next, the action of the air-conditioning apparatus 1 of the present embodiment will be described using FIGS. 1 through 8. FIG. 2 is a diagram showing the flow of refrigerant within the air-conditioning apparatus 1 during the air-cooling operation, FIG. 3 is a pressure-enthalpy graph representing the refrigeration cycle during the air-cooling operation, FIG. 4 is a temperature-entropy graph representing the refrigeration cycle during the air-cooling operation, FIG. 5 is a diagram showing the flow of refrigerant within the air-conditioning apparatus 1 during the air-warming operation, FIG. 6 is a pressure-enthalpy graph representing the refrigeration cycle during the air-warming operation, FIG. 7 is a temperature-entropy graph representing the refrigeration cycle during the air-warming operation, and FIG. 8 is a graph showing the relationship of the injection ratio to both the coefficient of performance ratio in the air-cooling operation and the coefficient of performance ratio in the air-warming operation. Operation controls during the following air-cooling operation and air-warming operation are performed by the aforementioned controller (not shown). In the following description, the term "high pressure" means a high pressure in the refrigeration cycle (specifically, the pressure at points D, D', and E in FIGS. 3 and 4, and the pressure at points D, D', and F in FIGS. 6 and 7), the term "low pressure" means a low pressure in the refrigeration cycle (specifically, the pressure at points A and F in FIGS. 3 and 4, and the pressure at points A and E in FIGS. 6 and 7), and the term "intermediate pressure" means an intermediate pressure in the refrigeration cycle (specifically, the pressure at points B, C, C', G, G', I, L, M, and X in FIGS. 3, 4, 6, and 7).

<Air-cooling Operation>

During the air-cooling operation, the switching mechanism 3 is brought to the cooling operation state shown by the solid lines in FIGS. 1 and 2. The opening degrees of the first expansion mechanism 5*a* and the second expansion mechanism 5*b* are adjusted. Since the switching mechanism 3 is set to a cooling operation state, the intermediate heat exchanger on/off valve 12 of the intermediate refrigerant tube 8 is opened and the intermediate heat exchanger bypass on/off valve 11 of the intermediate heat exchanger bypass tube 9 is closed, thereby putting the intermediate heat exchanger 7 into a state of functioning as a cooler. The first second-stage injection on/off valve 18*d* is opened, and the opening degree of the liquid injection valve 18*i* is adjusted. More specifically, in the present embodiment, the liquid injection valve 18*i* undergoes so-called degree of superheating control in which the flow rate of refrigerant returning to the second-stage compression element 2*d* through the liquid injection tube 18*h* is controlled so that the degree of superheating SH of the refrigerant admitted into the second-stage compression element 2*d* (i.e., the refrigerant that has been discharged from the first-stage compression element 2*c*, passed through the intermediate heat exchanger 7, and mixed with the refrigerant returning to the second-stage compression element 2*d* through the first second-stage injection tube 18*c* and the liquid injection tube 18*h* as a second second-stage injection tube) reaches a target value SHC (see FIG. 4) during the air-cooling operation. In the present embodiment, the degree of superheating SH of the refrigerant admitted into the second-stage compression element 2*d* is obtained by converting the intermediate pressure detected by the intermediate pressure sensor 54 to a saturation temperature and subtracting this refrigerant saturation temperature value from the refrigerant temperature detected by the intermediate temperature sensor 56. Thus, during the air-cooling operation of the present embodiment, the flow rate of refrigerant returning to the second-stage compression element 2*d* through the second-stage injection tube (here, the first second-stage injection tube 18*c* and the liquid injection tube 18*h*) is controlled so that the degree of superheating SH of the refrigerant admitted into the second-stage compression element 2*d* reaches the target value SHC.

When the refrigerant circuit 10 is in this state, low-pressure refrigerant (refer to point A in FIGS. 1 through 4) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B in FIGS. 1 through 4). The intermediate-pressure refrigerant discharged from the first-stage compression element 2*c* is cooled by heat exchange with water or air as a cooling source in the intermediate heat exchanger 7 (refer to point C in FIGS. 1 through 4). This refrigerant cooled in the intermediate heat exchanger 7 is further cooled (refer to point G in FIGS. 1 through 4) by mixing with the refrigerant returning from the receiver 18 to the second-stage compression element 2*d* through the first second-stage injection tube 18*c* and the liquid injection tube 18*h* (refer to points M and X in FIGS. 1 through 4). Next, having been mixed with the refrigerant returning from the first second-stage injection tube 18*c* and the liquid injection tube 18*h* (i.e., intermediate pressure injection is carried out by the receiver 18 and the liquid injection tube 18*h* which acts as a gas-liquid separator), the intermediate-pressure refrigerant is drawn into and further compressed in the compression element 2*d* connected to the second-stage side of the compression element 2*c*, and the refrigerant is discharged from the compression mechanism 2 to the discharge tube 2*b* (refer to point D in FIGS. 1 through 4). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 3). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and once more drawn into the compression mechanism 2. Next, having been separated from the refrigeration oil in the oil separation mechanism 41, the high-pressure refrigerant is passed through the non-return mechanism 42 and the switching mechanism 3, and is fed to the heat source-side heat exchanger 4 functioning as a refrigerant radiator. The high-pressure refrigerant fed to the heat source-side heat exchanger 4 is cooled in the heat source-side heat exchanger 4 by heat exchange with water or air as a cooling source (refer to point E in FIGS. 1 through 4). The high-pressure refrigerant cooled in the heat source-side heat exchanger 4 flows through the inlet non-return valve 17*a* of the bridge circuit 17 into the receiver inlet tube 18*a*, and some of the refrigerant is branched off into the liquid injection tube 18*h*. The refrigerant flowing through the liquid injection tube 18*h* is depressurized to a nearly intermediate pressure in the liquid injection valve 18*i* (refer to point X in FIGS. 1 through 4), and is then mixed with the intermediate pressure refrigerant discharged from the first-stage compression element 2*c* as described above. The high-pressure refrigerant that has branched off in the liquid injection tube 18*h* is then depressurized to a nearly intermediate pressure by the first expansion mechanism 5*a* and temporarily retained and subjected to gas-liquid separation in the receiver 18 (refer to points I, L, and M in FIGS. 1 through 4). The gas refrigerant resulting from gas-liquid separation in the receiver 18 is then withdrawn from the top part of the receiver 18 by the first second-stage injection tube 18*c* and mixed with the intermediate-pressure refrigerant discharged from the first-stage compression element 2*c* as described above. The liquid refrigerant retained in the receiver 18 is fed to the receiver outlet tube 18*b* and is depressurized by the second expansion mechanism 5*b* to become a low-pressure gas-liquid two-phase refrigerant, and is then fed through the outlet non-return valve 17*c* of the bridge circuit 17 to the usage-side heat exchanger 6 functioning as a refrigerant evaporator (refer to point F in FIGS. 1 through 4). The low-pressure gas-liquid two-phase refrigerant fed to the usage-side heat exchanger 6 is heated by heat exchange with water or air as a heating source, and the refrigerant is evaporated as a result (refer to point A in FIGS. 1 through 4). The low-pressure refrigerant heated in the usage-side heat exchanger 6 is then drawn once more into the compression mechanism 2 via the switching mechanism 3. In this manner the air-cooling operation is performed.

Thus, in the air-conditioning apparatus 1 (refrigeration apparatus) of the present embodiment, in addition to the cooling effect on the refrigerant drawn into the second-stage compression element 2*d* due to the first second-stage injection tube 18*c* and the liquid injection tube 18*h* being provided and intermediate pressure injection being performed by the liquid injection tube 18*h* and/or the receiver 18 as a gas-liquid separator for branching off the refrigerant whose heat has been radiated in the heat source-side heat exchanger 4 and returning the refrigerant to the second-stage compression element 2*d*; the intermediate heat exchanger 7 is provided to the intermediate refrigerant tube 8 for drawing the refrigerant discharged from the first-stage compression element 2*c* into the second-stage compression element 2*d*, the intermediate heat exchanger on/off valve 12 is opened and the intermediate heat exchanger bypass on/off valve 11 is closed during the air-cooling operation, thereby bringing the intermediate heat exchanger 7 to a state of functioning as a cooler, and therefore adding a cooling effect by the intermediate heat exchanger 7 on the refrigerant drawn into the second-stage compression element 2*d*. The temperature of the refrigerant drawn into the compression element 2*d* on the second-stage side of the compression element 2*c* thereby decreases (refer to points G and G' in FIG. 4) and the temperature of the refrigerant ultimately discharged from the compression mechanism 2 can be kept lower (refer to points D and D' in FIG. 4) than in cases in which the intermediate heat exchanger 7 is not provided and/or cases in which the intermediate heat exchanger 7 is not used (in this case, the refrigeration cycle is performed in the following sequence in FIGS. 3 and 4: point A→point B→point G'→point D'→point E→point I, X→point L→point F). In this air-conditioning apparatus 1, heat radiation loss in the heat source-side heat exchanger 4 functioning as a radiator of refrigerant thereby decreases during the air-cooling operation, and operating efficiency can therefore be further improved in comparison with cases in which only intermediate pressure injection is used.

Moreover, in the air-conditioning apparatus 1 of the present embodiment, since intermediate pressure injection by the receiver 18 as a gas-liquid separator is used, the flow rate of the refrigerant that can be returned to the second-stage compression element 2*d* through the first second-stage injection tube 18*c* is determined according to the liquid-gas ratio of the refrigerant flowing into the receiver 18, and it is difficult to actively control the flow rate of the refrigerant returning to the second-stage compression element 2*d* through the first second-stage injection tube 18*c*; therefore, the liquid injection tube 18*h* is provided in addition to the first second-stage injection tube 18*c*. It is thereby possible in this air-conditioning apparatus 1 to actively control the flow rate of the refrigerant returning to the second-stage compression element 2*d* through the first second-stage injection tube 18*c* and the liquid injection tube 18*h* by adjusting the opening degree of the liquid injection valve 18*i* of the liquid injection tube 18*h*, and the degree of superheating SH of the refrigerant admitted into the second-stage compression element 2*d* can be fixed at the target value SHC during the air-cooling operation. In the air-conditioning apparatus 1 of the present embodiment, a relationship such as is shown in FIG. 8 exists between the injection ratio, which is the ratio of the flow rate of the refrigerant returning to the second-stage compression element 2*d* through the second-stage injection tube (here, both the first second-stage injection tube 18*c* and the liquid injection tube 18*h* as the second second-stage injection tube) relative to the flow rate of the refrigerant discharged from the compression mechanism 2, and the coefficient of performance ratio (a value expressing the coefficient of performance for other injection ratios when the coefficient of performance for an injection ratio of 0.20 is 1), wherein the optimum injection ratio at which the coefficient of performance reaches a maximum during the air-cooling operation is 0.3 to 0.4. Therefore, in the present embodiment, the target value SHC during the air-cooling operation of the degree of superheating SH of the refrigerant admitted into the second-stage compression element 2*d* is set so as to comply with the optimum injection ratio during the air-cooling operation, and the coefficient of performance can be brought to nearly its maximum value during the air-cooling operation by adjusting the opening degree of the liquid injection valve 18*i*.

<Air-warming Operation>

During the air-warming operation, the switching mechanism 3 is brought to the heating operation state shown by the dashed lines in FIGS. 1 and 5. The opening degrees of the first expansion mechanism 5*a* and the second expansion mechanism 5*b* are also adjusted. Since the switching mechanism 3 is set to a heating operation state, the intermediate heat exchanger on/off valve 12 of the intermediate refrigerant tube 8 is closed and the intermediate heat exchanger bypass on/off valve 11 of the intermediate heat exchanger bypass tube 9 is opened, thereby putting the intermediate heat exchanger 7 into a state of not functioning as a cooler. Furthermore, the first second-stage injection on/off valve 18*d* is opened, and the opening degree of the liquid injection valve 18*i* is adjusted in the same manner as in the air-cooling operation. The target value during the air-warming operation of the degree of superheating SH of the refrigerant admitted into the second-stage compression element 2*d* is herein referred to as SHH (see FIG. 7).

When the refrigerant circuit 10 is in this state, low-pressure refrigerant (refer to point A in FIG. 1 and FIGS. 5 through 7) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B in FIG. 1, FIGS. 5, and 7). This intermediate-pressure refrigerant discharged from the first-stage compression element 2*c* passes through the intermediate heat exchanger bypass tube 9 (refer to point C in FIGS. 1 and 5 through 7) without passing through the intermediate heat exchanger 7 (i.e., without being cooled), unlike the air-cooling operation described above. This intermediate-pressure refrigerant that has passed through the intermediate heat exchanger bypass tube 9 without being cooled by the intermediate heat exchanger 7 is cooled (refer to point G in FIGS. 1 and 5 through 7) by mixing with the refrigerant returning from the receiver 18 to the second-stage compression element 2*d* through the first second-stage injection tube 18*c* and the liquid injection tube 18*h* (refer to points M and X in FIGS. 1 and 5 through 7). Next, having been mixed with the refrigerant returning from the first second-stage injection tube 18*c* and the liquid injection tube 18*h* (i.e., intermediate pressure injection is carried out by the receiver 18 and the liquid injection tube 18*h* which acts as a gas-liquid separator), the intermediate-pressure refrigerant is drawn into and further compressed in the compression element 2*d* connected to the second-stage side of the compression element 2*c*, and the refrigerant is discharged from the compression mechanism 2 to the discharge tube 2*b* (refer to point D in FIGS. 1, 5, and 7). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 6). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and once more drawn into the compression mechanism 2. Next, having been separated from the refrigeration oil in the oil separation mechanism 41, the high-pressure refrigerant is passed through the non-return mechanism 42 and the switching mechanism 3, fed to the usage-side heat exchanger 6 functioning as a radiator of refrigerant, and cooled by heat exchange with the water and/or air as a cooling source (refer to point F in FIGS. 1 and 5 through 7). The high-pressure refrigerant cooled in the usage-side heat exchanger 6 flows through the inlet non-return valve 17*b* of the bridge circuit 17 into the receiver inlet tube 18*a*, and some of the refrigerant is branched off to the liquid injection tube 18*h*. The refrigerant flowing through the liquid injection tube 18*h* is then depressurized to a nearly intermediate pressure in the liquid injection valve 18*i* (refer to point X in FIGS. 1 and 5 to 7), and is then mixed with the intermediate-pressure refrigerant discharged from the first-stage compression element 2*c* as described above. The high-pressure refrigerant that has branched off in the liquid injection tube 18*h* is depressurized to a nearly intermediate pressure by the first expansion mechanism 5*a*, temporarily retained in the receiver 18, and subjected to gas-liquid separation (refer to points I, L, and M in FIGS. 1 and 5 through 7). The gas refrigerant resulting from gas-liquid separation in the receiver 18 is withdrawn from the top part of the receiver 18 by the first second-stage injection tube 18*c* and mixed with the intermediate-pressure refrigerant discharged from the first-stage compression element 2*c* as described above. The liquid refrigerant retained in the receiver 18 is fed to the receiver outlet tube 18*b* and is depressurized by the second expansion mechanism 5*b* to become a low-pressure gas-liquid two-phase refrigerant, and is then fed through the outlet non-return valve 17*d* of the bridge circuit 17 to the heat source-side heat exchanger 4 functioning as a refrigerant evaporator (refer to point E in FIGS. 1, 5, and 7). The low-pressure gas-liquid two-phase refrigerant fed to the heat source-side heat exchanger 4 is heated by heat exchange with water or air as a heating source in the heat source-side heat exchanger 4, and the refrigerant evaporates as a result (refer to point A in FIGS. 1 and 5 through 7). The low-pressure refrigerant heated and evaporated in the heat source-side heat exchanger 4 is then drawn once more into the compression mechanism 2 via the switching mechanism 3. In this manner the air-warming operation is performed.

Thus, in the air-conditioning apparatus 1 (refrigeration apparatus) of the present embodiment, the intermediate heat exchanger 7 provided to the intermediate refrigerant tube 8 for drawing refrigerant discharged from the first-stage compression element 2*c* into the second-stage compression element 2*d* is brought to a state in which the intermediate heat exchanger 7 does not function as a cooler during the air-warming operation by closing the intermediate heat exchanger on/off valve 12 and opening the intermediate heat exchanger bypass on/off valve 11; therefore, the only effect of cooling the refrigerant admitted into the second-stage compression element 2*d* is from intermediate pressure injection by the liquid injection tube 18*h* and/or the receiver 18 as a gas-liquid separator for branching off the refrigerant whose heat has been radiated in the heat source-side heat exchanger 4 and returning the refrigerant to the second-stage compression element 2*d*, and in comparison with cases in which no intermediate heat exchanger on/off valve 12 and/or intermediate heat exchanger bypass on/off valve 11 is provided and only the intermediate heat exchanger 7 is provided, and/or cases in which the intermediate heat exchanger 7 is made to function as a cooler in the same manner as the air-cooling operation described above (in this case, the refrigeration cycle is performed in the following sequence in FIGS. 6 and 7: point A→point B→point C'→point G'→point D'→point F→point I, X→point L→point E), heat radiation from the intermediate heat exchanger 7 to the exterior is prevented, the decrease in the temperature of the refrigerant admitted into the second-stage compression element 2*d* is minimized (refer to points G and G' in FIG. 7), and the decrease in the temperature of the refrigerant ultimately discharged from the compression mechanism 2 can be minimized (refer to points D and D' in FIG. 7). Thereby, during the air-warming operation in this air-conditioning apparatus 1, heat radiation to the exterior can be suppressed and used in the usage-side heat exchanger 6 functioning as a radiator of refrigerant, and decreases in operating efficiency can be prevented.

However, as described above, the intermediate heat exchanger 7 and the intermediate heat exchanger bypass tube 9 are provided in addition to the intermediate pressure injection configuration using the second-stage injection tube (the first second-stage injection tube 18*c* and/or the liquid injection tube 18*h* here), and during the air-warming operation, the cooling effect by the intermediate heat exchanger 7 on the refrigerant drawn into the second-stage compression element 2*d* is not achieved when the refrigerant discharged from the first-stage compression element 2*c* and drawn into the second-stage compression element 2*d* is not cooled by the intermediate heat exchanger 7, and a problem is encountered in that the coefficient of performance during the air-warming operation does not improve proportionately.

In view of this, in the air-conditioning apparatus 1 of the present embodiment, injection rate optimization control is performed for controlling the flow rate of the refrigerant returned to the second-stage compression element 2*d* through the second-stage injection tube (the first second-stage injection tube 18*c* and the liquid injection tube 18*h* here), so that the injection ratio is greater during the heating operation than during the cooling operation.

More specifically, in the present embodiment, injection rate optimization control involves setting the target value SHH of the degree of superheating SH during the air-warming operation to be equal to or less than the target value SHC of the degree of superheating during the air-cooling operation, whereby the opening degree of the liquid injection valve 18*i* is greater than during the air-cooling operation, and increasing the flow rate of the refrigerant returned to the second-stage compression element 2*d* through the liquid injection tube 18*h* (i.e., the total flow rate of the refrigerant flowing through the first second-stage injection tube 18*c* and the liquid injection tube 18*h* as a second second-stage injection tube), whereby the injection ratio is greater during the air-warming operation than during the air-cooling operation. The cooling effect by the intermediate pressure injection using the second-stage injection tube (the first second-stage injection tube 18*c* and the liquid injection tube 18*h* here) on the refrigerant admitted into the second-stage compression element 2*d* is thereby greater during the air-warming operation than during the air-cooling operation, and the temperature of the refrigerant discharged from the compression mechanism 2 (refer to point D in FIG. 7) can therefore be kept even lower while heat radiation to the exterior is suppressed, even during the air-warming operation in which the intermediate heat exchanger 7 has no cooling effect on the refrigerant admitted into the second-stage compression element 2*d*, and the coefficient of performance can be improved.

The optimum injection ratio at which the coefficient of performance reaches a maximum tends to be a greater optimum injection ratio (0.35 to 0.45) during the air-warming operation than the optimum injection ratio (0.3 to 0.4) during the air-cooling operation as shown in FIG. 8, and the reason for this tendency is believed to be because the intermediate heat exchanger 7 is not used during the air-warming operation. That is, in this air-conditioning apparatus 1, the optimum injection ratio during the air-warming operation is believed to be greater by an amount equivalent to the cooling effect by the intermediate heat exchanger 7 because the refrigerant admitted into the second-stage compression element 2*d* is cooled by intermediate pressure injection alone during the air-warming operation, in comparison with the air-cooling operation in which both the intermediate heat exchanger 7 and intermediate pressure injection are used. Therefore, in the present embodiment, it is preferred that the target value SHH of the degree of superheating SH during the air-warming operation (see FIG. 7) be set to the same value as the target value SHC of the degree of superheating SH during the air-cooling operation, whereby the refrigerant drawn into the second-stage compression element 2*d* during the air-warming operation is cooled by intermediate pressure injection during the air-warming operation to the same degree of superheating SH as that of the air-cooling operation for cooling the refrigerant by the intermediate heat exchanger 7 and by intermediate pressure injection, and the injection ratio is greater during the air-warming operation than during the air-cooling operation by an amount equivalent to the cooling effect by the intermediate heat exchanger 7. Thereby, in this air-conditioning apparatus 1, in cases in which the target value SHC of the degree of superheating SH during the air-cooling operation is set near a value corresponding to the optimum injection ratio at which the coefficient of performance during the air-cooling operation reaches a maximum, the injection ratio during the air-warming operation as well approaches the optimum injection ratio at which the coefficient of performance during the air-warming operation reaches a maximum, and intermediate pressure injection can be performed at the optimum injection ratio at which the coefficient of performance reaches a maximum during both the air-cooling operation and the air-warming operation.

(3) Modification 1

In the embodiment described above, in the air-conditioning apparatus 1 configured to be capable of switching between the air-cooling operation and the air-warming operation via the switching mechanism 3, the first second-stage injection tube 18*c* is provided for performing intermediate pressure injection through the receiver 18 as a gas-liquid separator, and intermediate pressure injection is performed by the receiver 18 as a gas-liquid separator, but instead of intermediate pressure injection by the receiver 18, another possible option is to provide a third second-stage injection tube 19 and an economizer heat exchanger 20 and to perform intermediate pressure injection through the economizer heat exchanger 20.

Figure 9:
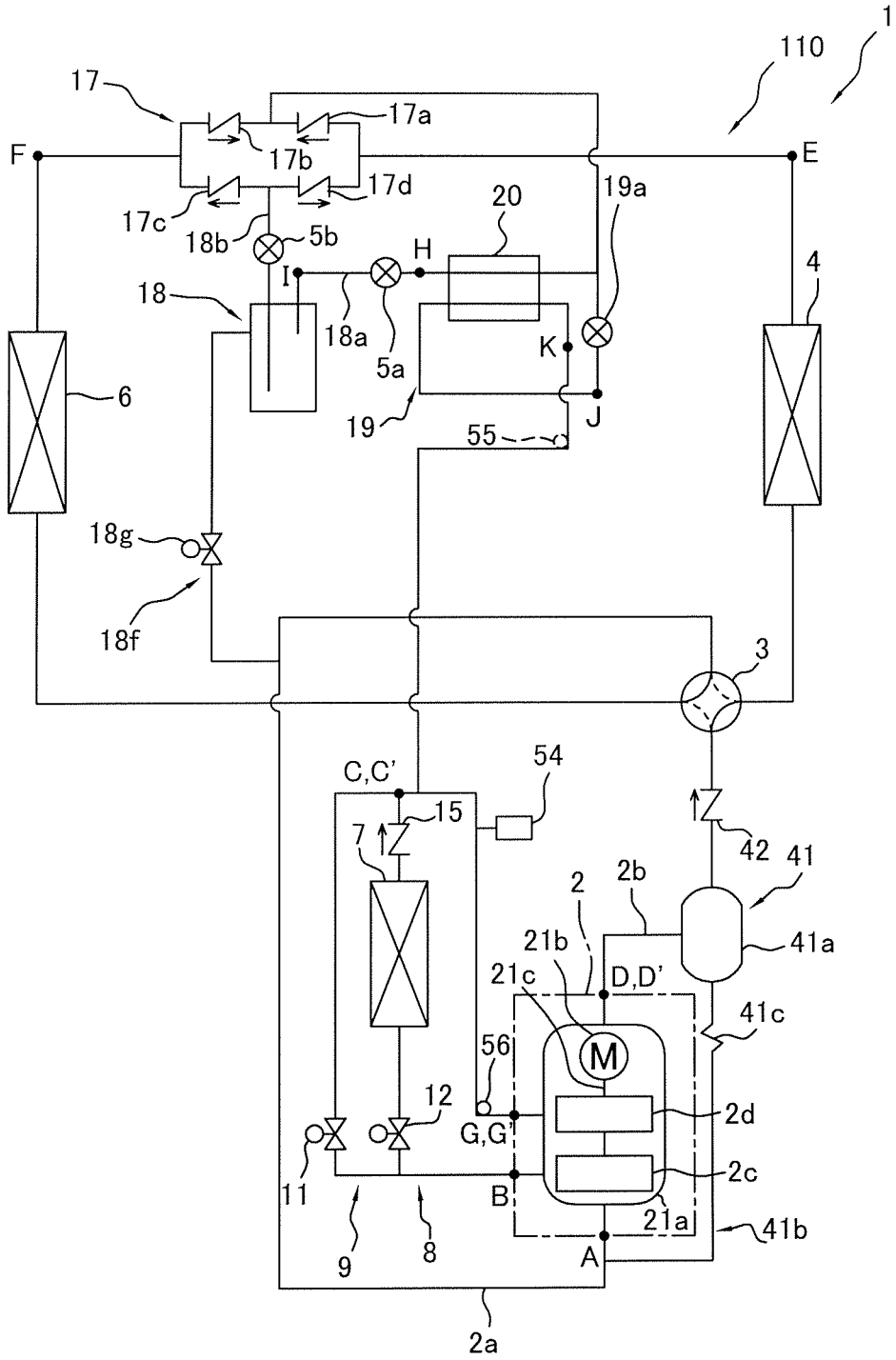
FIG. 9 is a schematic structural diagram of an air-conditioning apparatus according to Modification 1.

For example, as shown in FIG. 9, a refrigerant circuit 110 can be used which is provided with the third second-stage injection tube 19 and the economizer heat exchanger 20 instead of the first second-stage injection tube 18*c* in the embodiment described above.

The third second-stage injection tube 19 has a function for branching off and returning the refrigerant cooled in the heat source-side heat exchanger 4 or the usage-side heat exchanger 6 to the second-stage compression element 2*d* of the compression mechanism 2. In the present modification, the third second-stage injection tube 19 is provided so as to branch off refrigerant flowing through the receiver inlet tube 18*a* and return the refrigerant to the intake side of the second-stage compression element 2*d*. More specifically, the third second-stage injection tube 19 is provided so as to branch off and return the refrigerant from a position on the upstream side of the first expansion mechanism 5*a* of the receiver inlet tube 18*a* (i.e., between the heat source-side heat exchanger 4 and the first expansion mechanism 5*a* when the switching mechanism 3 is in the cooling operation state, or between the usage-side heat exchanger 6 and the first expansion mechanism 5*a* when the switching mechanism 3 is in the heating operation state) to a position on the downstream side of the intermediate heat exchanger 7 of the intermediate refrigerant tube 8. The third second-stage injection tube 19 is provided with a third second-stage injection valve 19*a* whose opening degree can be controlled. The third second-stage injection valve 19*a* is an electrically driven expansion valve in the present modification.

The economizer heat exchanger 20 is a heat exchanger for performing heat exchange between the refrigerant whose heat has been radiated in the heat source-side heat exchanger 4 or the usage-side heat exchanger 6 and the refrigerant flowing through the third second-stage injection tube 19 (more specifically, the refrigerant that has been depressurized to a nearly intermediate pressure in the third second-stage injection valve 19*a*). In the present modification, the economizer heat exchanger 20 is provided so as to perform heat exchange between the refrigerant flowing through a position in the receiver inlet tube 18*a* upstream of the first expansion mechanism 5*a* (i.e., between the heat source-side heat exchanger 4 and the first expansion mechanism 5*a* when the switching mechanism 3 is in the cooling operation state, or between the usage-side heat exchanger 6 and the first expansion mechanism 5*a* when the switching mechanism 3 is in the heating operation state) and the refrigerant flowing through the third second-stage injection tube 19, and the economizer heat exchanger 20 has flow passages whereby the two refrigerants flow in opposition to each other. In the present modification, the economizer heat exchanger 20 is provided upstream of the third second-stage injection tube 19 of the receiver inlet tube 18*a*. Therefore, the refrigerant whose heat has been radiated in the heat source-side heat exchanger 4 or usage-side heat exchanger 6 is branched off in the receiver inlet tube 18*a* into the third second-stage injection tube 19 before undergoing heat exchange in the economizer heat exchanger 20, and heat exchange is then conducted in the economizer heat exchanger 20 with the refrigerant flowing through the third second-stage injection tube 19.

In the embodiment described above, in view of the difficulty of actively controlling the flow rate of the refrigerant returning to the second-stage compression element 2*d* through the first second-stage injection tube 18*c*, the liquid injection tube 18*h* is provided so as to make it possible to actively control the flow rate of the refrigerant returning to the second-stage compression element 2*d* through the first second-stage injection tube 18*c* and the liquid injection tube 18*h*, but in the present modification, a configuration is used in which intermediate pressure injection through the economizer heat exchanger 20 is performed using the third second-stage injection tube 19 and the economizer heat exchanger 20, and since the flow rate of the refrigerant returning to the second-stage compression element 2*d* through the third second-stage injection tube 19 can be actively controlled, the liquid injection tube 18*h* is omitted unlike in the embodiment described above.

Figure 10:
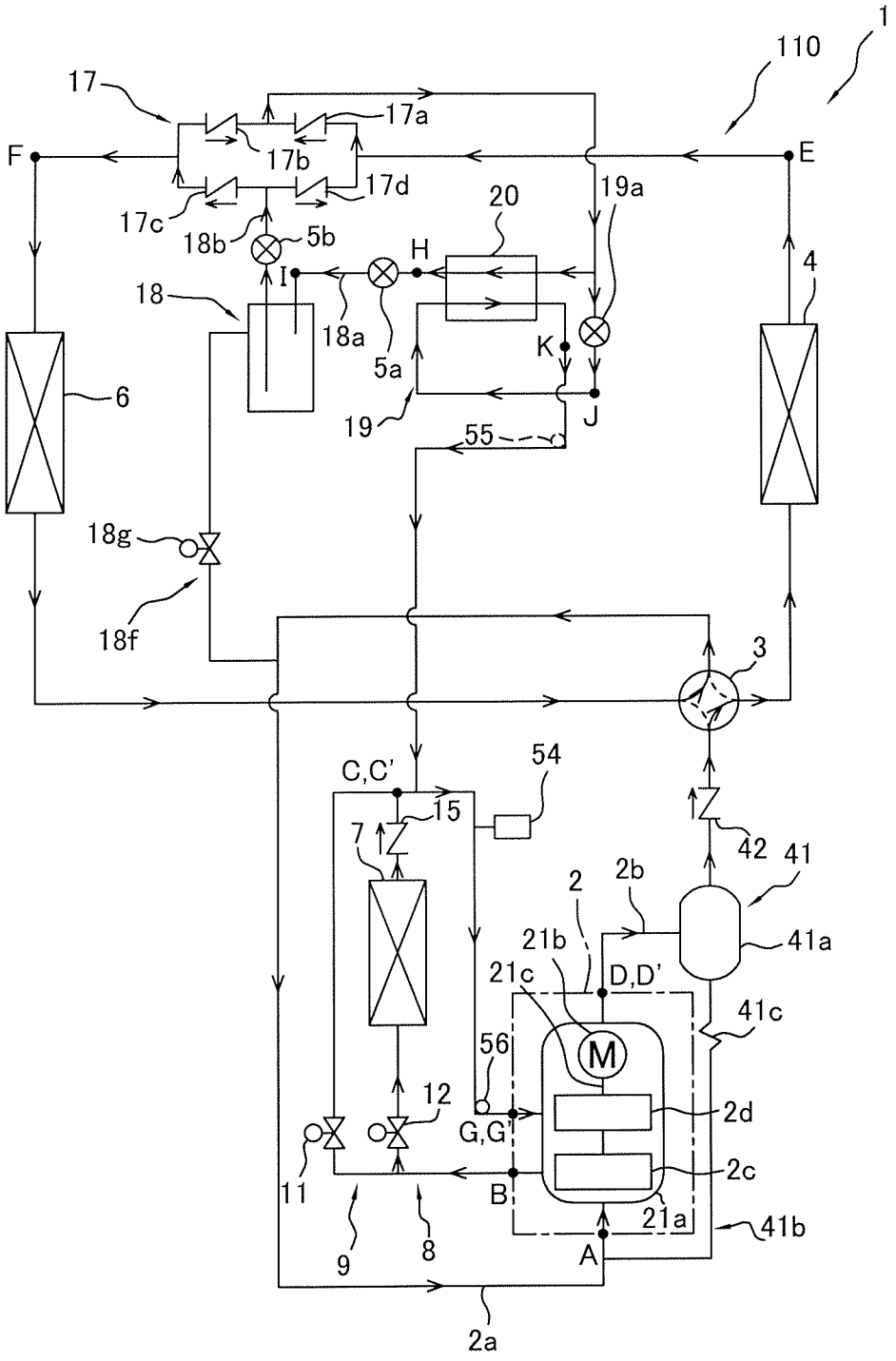
FIG. 10 is a diagram showing the flow of refrigerant within the air-conditioning apparatus during the air-cooling operation.
Figure 11:
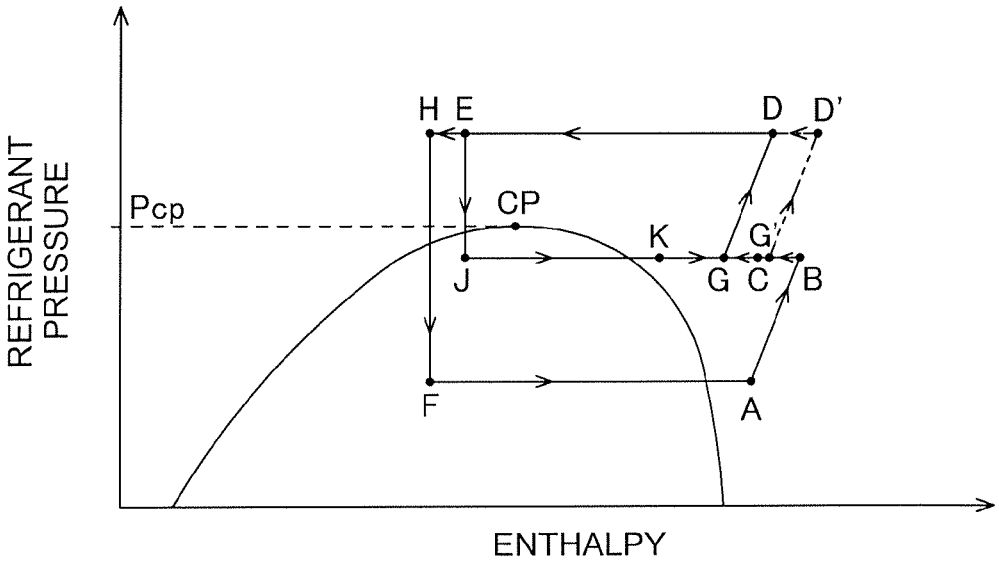
FIG. 11 is a pressure-enthalpy graph representing the refrigeration cycle during the air-cooling operation in the air-conditioning apparatus according to Modification 1.
Figure 12:
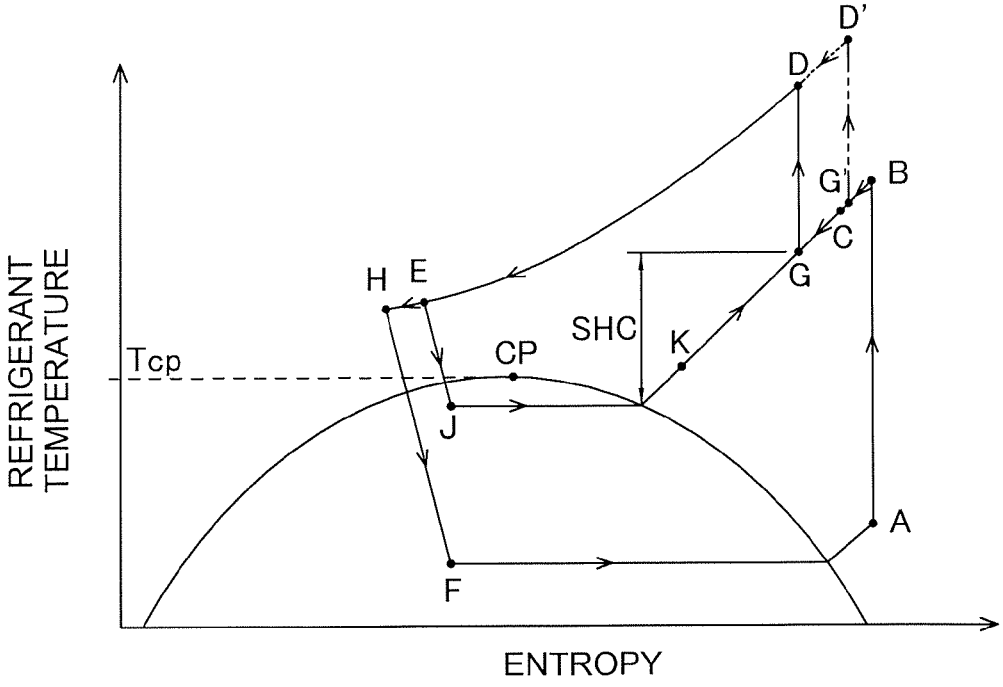
FIG. 12 is a temperature-entropy graph representing the refrigeration cycle during the air-cooling operation in the air-conditioning apparatus according to Modification 1.
Figure 13:
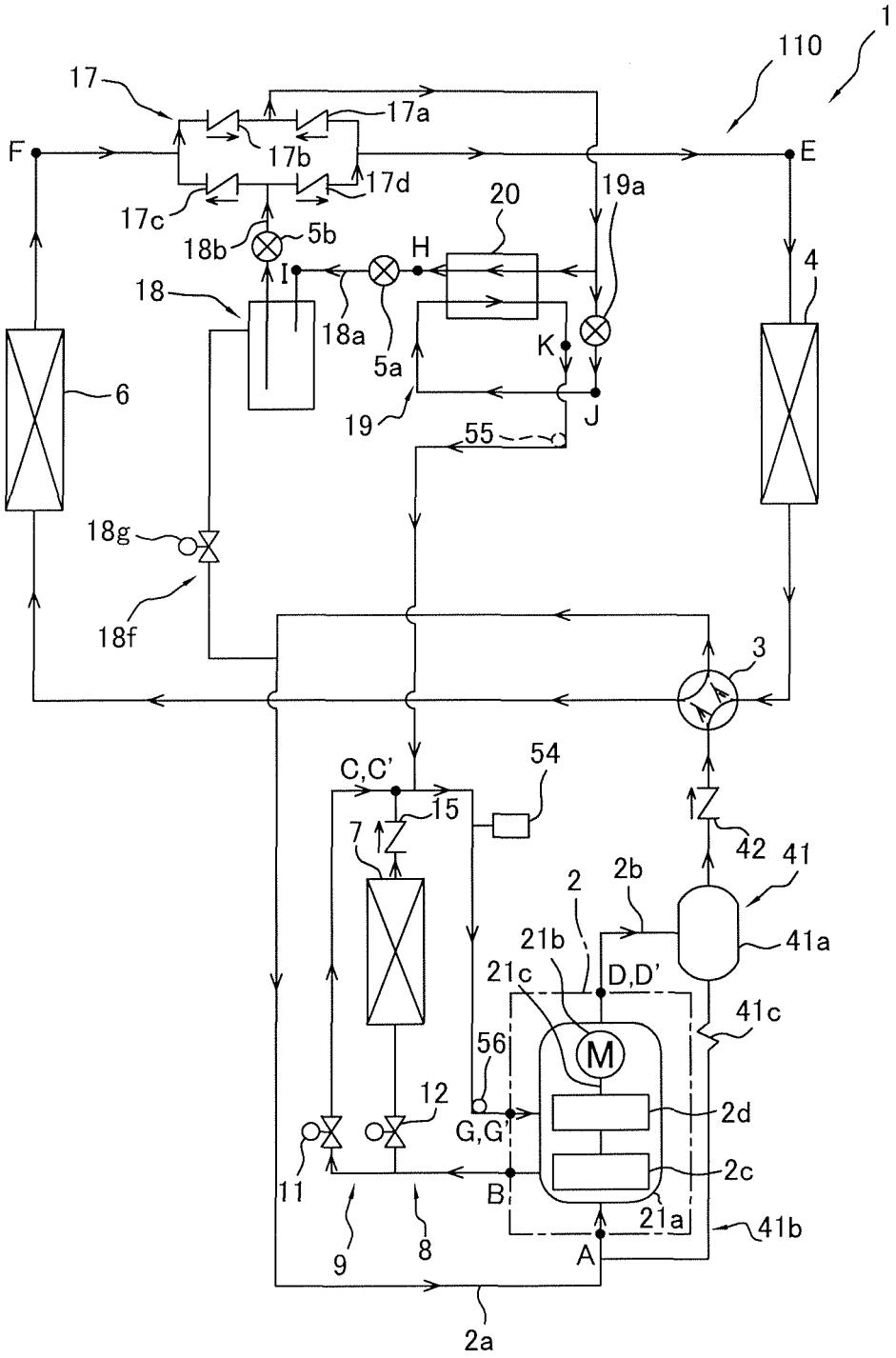
FIG. 13 is a diagram showing the flow of refrigerant within the air-conditioning apparatus during the air-warming operation.
Figure 14:
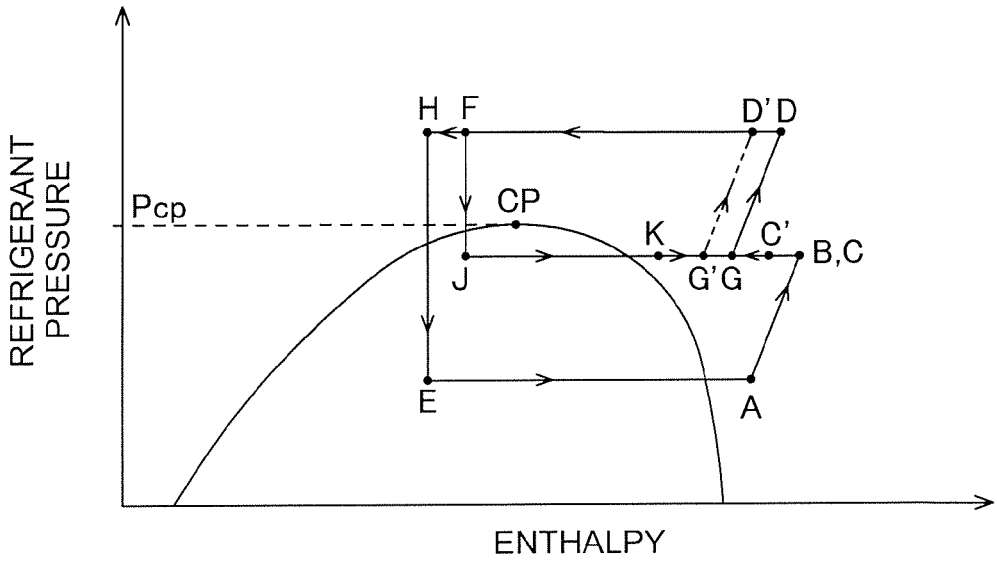
FIG. 14 is a pressure-enthalpy graph representing the refrigeration cycle during the air-warming operation in the air-conditioning apparatus according to Modification 1.
Figure 15:
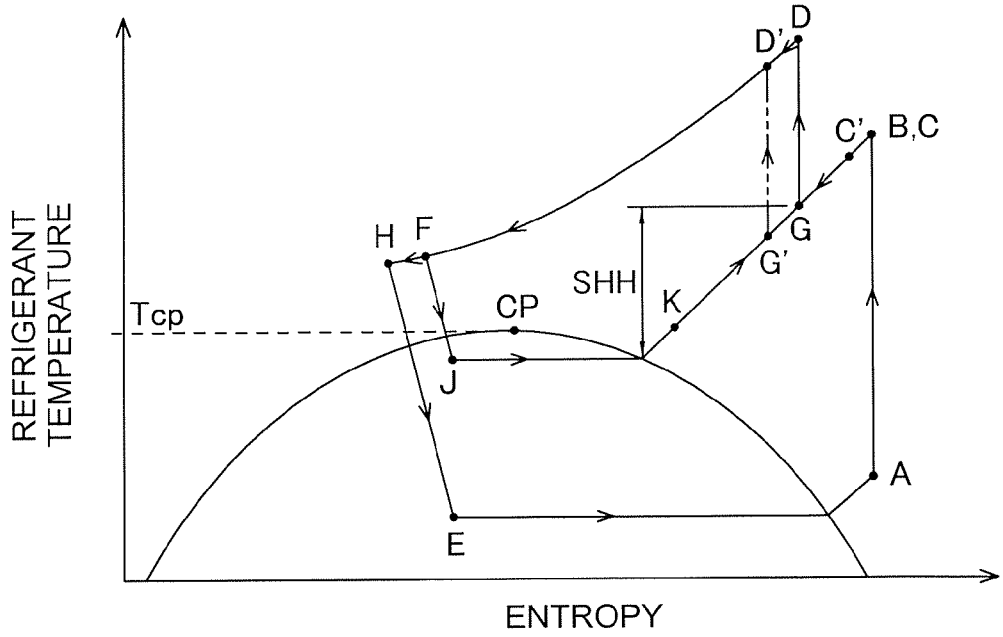
FIG. 15 is a temperature-entropy graph representing the refrigeration cycle during the air-warming operation in the air-conditioning apparatus according to Modification 1.

Next, the action of the air-conditioning apparatus 1 of the present modification will be described using FIGS. 9 through 15. FIG. 10 is a diagram showing the flow of refrigerant within the air-conditioning apparatus 1 during the air-cooling operation, FIG. 11 is a pressure-enthalpy graph representing the refrigeration cycle during the air-cooling operation, FIG. 12 is a temperature-entropy graph representing the refrigeration cycle during the air-cooling operation, FIG. 13 is a diagram showing the flow of refrigerant within the air-conditioning apparatus 1 during the air-warming operation, FIG. 14 is a pressure-enthalpy graph representing the refrigeration cycle during the air-warming operation, and FIG. 15 is a temperature-entropy graph representing the refrigeration cycle during the air-warming operation. Operation controls during the following air-cooling operation and air-warming operation are performed by the aforementioned controller (not shown). In the following description, the term "high pressure" means a high pressure in the refrigeration cycle (specifically, the pressure at points D, D', E, and H in FIGS. 11 and 12 and/or the pressure at points D, D', F, and H in FIGS. 14 and 15), the term "low pressure" means a low pressure in the refrigeration cycle (specifically, the pressure at points A and F in FIGS. 11 and 12 and/or the pressure at points A and E in FIGS. 14 and 15), and the term "intermediate pressure" means an intermediate pressure in the refrigeration cycle (specifically, the pressure at points B, C, C', G, G', J, and Kin FIGS. 11, 12, 14, and 15).

<Air-cooling Operation>

During the air-cooling operation, the switching mechanism 3 is brought to the cooling operation state shown by the solid lines in FIGS. 9 and 10. The opening degrees of the first expansion mechanism 5*a* and the second expansion mechanism 5*b* are adjusted. Since the switching mechanism 3 is set to a cooling operation state, the intermediate heat exchanger on/off valve 12 of the intermediate refrigerant tube 8 is opened and the intermediate heat exchanger bypass on/off valve 11 of the intermediate heat exchanger bypass tube 9 is closed, thereby putting the intermediate heat exchanger 7 into a state of functioning as a cooler. Furthermore, the opening degree of the third second-stage injection valve 19*a* is also adjusted. More specifically, in the present modification, so-called superheat degree control is performed wherein the third second-stage injection valve 19*a* controls the flow rate of the refrigerant returning to the second-stage compression element 2*d* through the third second-stage injection tube 19 so that the degree of superheating SH of the refrigerant being drawn into the second-stage compression element 2*d* (i.e., the refrigerant that has been mixed with the refrigerant discharged from the first-stage compression element 2*c*, passed through the intermediate heat exchanger 7, and returned to the second-stage compression element 2*d* through the third second-stage injection tube 19) reaches the target value SHC (see FIG. 12) during the air-cooling operation. In the present modification, the degree of superheating SH of the refrigerant being admitted into the second-stage compression element 2*d* is obtained by converting the intermediate pressure detected by the intermediate pressure sensor 54 to a saturation temperature and subtracting this refrigerant saturation temperature value from the refrigerant temperature detected by the intermediate temperature sensor 56. Thus, during the air-cooling operation of the present modification, the flow rate of the refrigerant returned to the second-stage compression element 2*d* through the third second-stage injection tube 19 is controlled so that the degree of superheating SH of the refrigerant being admitted into the second-stage compression element 2*d* reaches the target value SHC.

When the refrigerant circuit 110 is in this state, low-pressure refrigerant (refer to point A in FIGS. 9 through 12) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B in FIGS. 9 through 12). The intermediate-pressure refrigerant discharged from the first-stage compression element 2*c* is cooled by heat exchange with water or air as a cooling source in the intermediate heat exchanger 7 (refer to point C in FIGS. 9 through 12). The refrigerant cooled in the intermediate heat exchanger 7 is further cooled (refer to point G in FIGS. 9 through 12) by being mixed with refrigerant being returned from the third second-stage injection tube 19 to the second-stage compression element 2*d* (refer to point K in FIGS. 9 through 12). Next, having been mixed with the refrigerant returning from the third second-stage injection tube 19 (i.e., intermediate pressure injection is carried out by the economizer heat exchanger 20), the intermediate-pressure refrigerant is drawn into and further compressed in the compression element 2*d* connected to the second-stage side of the compression element 2*c*, and the refrigerant is discharged from the compression mechanism 2 to the discharge tube 2*b* (refer to point D in FIGS. 9 through 12). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 11). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and drawn once more into the compression mechanism 2. Next, having been separated from the refrigeration oil in the oil separation mechanism 41, the high-pressure refrigerant is passed through the non-return mechanism 42 and the switching mechanism 3, and is fed to the heat source-side heat exchanger 4 functioning as a refrigerant radiator. The high-pressure refrigerant fed to the heat source-side heat exchanger 4 is cooled in the heat source-side heat exchanger 4 by heat exchange with water or air as a cooling source (refer to point E in FIGS. 9 through 12). The high-pressure refrigerant cooled in the heat source-side heat exchanger 4 flows through the inlet non-return valve 17*a* of the bridge circuit 17 into the receiver inlet tube 18*a*, and some of the refrigerant is branched off into the third second-stage injection tube 19. The refrigerant flowing through the third second-stage injection tube 19 is depressurized to a nearly intermediate pressure in the third second-stage injection valve 19*a* and is then fed to the economizer heat exchanger 20 (refer to point J in FIGS. 9 through 12). The refrigerant branched off to the third second-stage injection tube 19 then flows into the economizer heat exchanger 20, where it is cooled by heat exchange with the refrigerant flowing through the third second-stage injection tube 19 (refer to point H in FIGS. 9 through 12). The refrigerant flowing through the third second-stage injection tube 19 is heated by heat exchange with the high-pressure refrigerant cooled in the heat source-side heat exchanger 4 as a radiator (refer to point K in FIGS. 9 through 12), and is mixed with the intermediate-pressure refrigerant discharged from the first-stage compression element 2*c* as described above. The high-pressure refrigerant cooled in the economizer heat exchanger 20 is depressurized to a nearly saturated pressure by the first expansion mechanism 5*a* and is temporarily retained in the receiver 18 (refer to point I in FIGS. 9 and 10). The refrigerant retained in the receiver 18 is fed to the receiver outlet tube 18*b* and is depressurized by the second expansion mechanism 5*b* to become a low-pressure gas-liquid two-phase refrigerant, and is then fed through the outlet non-return valve 17*c* of the bridge circuit 17 to the usage-side heat exchanger 6 functioning as a refrigerant evaporator (refer to point F in FIGS. 9 through 12). The low-pressure gas-liquid two-phase refrigerant fed to the usage-side heat exchanger 6 is heated by heat exchange with water or air as a heating source, and the refrigerant is evaporated as a result (refer to point A in FIGS. 9 through 12). The low-pressure refrigerant heated in the usage-side heat exchanger 6 is then drawn once more into the compression mechanism 2 via the switching mechanism 3. In this manner the air-cooling operation is performed.

Thus, the air-conditioning apparatus 1 of the present modification differs in that instead of the first second-stage injection tube 18*c* and the liquid injection tube 18*h*, the third second-stage injection tube 19 is provided and intermediate pressure injection is performed through the economizer heat exchanger 20 for branching off the refrigerant whose heat has been radiated in the heat source-side heat exchanger 4 and returning the refrigerant to the second-stage compression element 2*d*, but the same operational effects as those of the embodiment described above can be achieved during the air-cooling operation.

In the present modification, similar to FIG. 8 in the embodiment described above, there is an optimum injection ratio at which the coefficient of performance reaches a maximum during the air-cooling operation between the injection ratio, which is the ratio of the flow rate of the refrigerant returning to the second-stage compression element 2*d* through the third second-stage injection tube 19 relative to the flow rate of the refrigerant discharged from the compression mechanism 2, and the coefficient of performance ratio (a value expressing the coefficient of performance for other injection ratios when the coefficient of performance for an injection ratio of 0.20 is 1). Therefore, in the present modification as well, the target value SHC during the air-cooling operation of the degree of superheating SH of the refrigerant admitted into the second-stage compression element 2*d* is set so as to comply with the optimum injection ratio during the air-cooling operation and the opening degree of the third second-stage injection valve 19*a* is adjusted, thereby the coefficient of performance can be brought to nearly its maximum value during the air-cooling operation.

<Air-warming Operation>

During the air-warming operation, the switching mechanism 3 is brought to the heating operation state shown by the dashed lines in FIGS. 9 and 13. The opening degrees of the first expansion mechanism 5*a* and the second expansion mechanism 5*b* are adjusted. Since the switching mechanism 3 is set to a heating operation state, the intermediate heat exchanger on/off valve 12 of the intermediate refrigerant tube 8 is closed and the intermediate heat exchanger bypass on/off valve 11 of the intermediate heat exchanger bypass tube 9 is opened, thereby putting the intermediate heat exchanger 7 into a state of not functioning as a cooler. Furthermore, the opening degree of the third second-stage injection valve 19*a* is adjusted in the same manner as in the air-cooling operation. The target value during the air-warming operation of the degree of superheating SH of the refrigerant being admitted into the second-stage compression element 2*d* is denoted here as SHH (see FIG. 15).

When the refrigerant circuit 110 is in this state, low-pressure refrigerant (refer to point A in FIG. 9 and FIGS. 13 through 15) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B in FIG. 9, FIGS. 13 through 15). This intermediate-pressure refrigerant discharged from the first-stage compression element 2*c* passes through the intermediate heat exchanger bypass tube 9 (refer to point C in FIGS. 9 and 13 through 15) without passing through the intermediate heat exchanger 7 (i.e., without being cooled), unlike during the air-cooling operation described above. This intermediate-pressure refrigerant that has passed through the intermediate heat exchanger bypass tube 9 without being cooled by the intermediate heat exchanger 7 is cooled (refer to point G in FIGS. 9 and 13 through 15) by mixing with the refrigerant returned from the third second-stage injection tube 19 to the second-stage compression element 2*d* (refer to point K in FIGS. 9 and 13 through 15). Next, having been mixed with the refrigerant returning from the third second-stage injection tube 19 (i.e., intermediate pressure injection is carried out by the economizer heat exchanger 20), the intermediate-pressure refrigerant is drawn into and further compressed in the compression element 2*d* connected to the second-stage side of the compression element 2*c*, and the refrigerant is discharged from the compression mechanism 2 to the discharge tube 2*b* (refer to point D in FIGS. 9, 13 through 15). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 14). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and drawn once more the compression mechanism 2. Next, having been separated from the refrigeration oil in the oil separation mechanism 41, the high-pressure refrigerant is passed through the non-return mechanism 42 and the switching mechanism 3, fed to the usage-side heat exchanger 6 functioning as a radiator of refrigerant, and cooled by heat exchange with the water and/or air as a cooling source (refer to point F in FIGS. 9 and 13 through 15). The high-pressure refrigerant cooled in the usage-side heat exchanger 6 flows through the inlet non-return valve 17*b* of the bridge circuit 17 into the receiver inlet tube 18*a*, and some of the refrigerant is branched off into the third second-stage injection tube 19. The refrigerant flowing through the third second-stage injection tube 19 is depressurized to a nearly intermediate pressure in the third second-stage injection valve 19*a* and is then fed to the economizer heat exchanger 20 (refer to point J in FIGS. 9, 13, through 15). The refrigerant branched off to the third second-stage injection tube 19 then flows into the economizer heat exchanger 20, where it is cooled by heat exchange with the refrigerant flowing through the third second-stage injection tube 19 (refer to point H in FIGS. 9, 13 through 15). The refrigerant flowing through the third second-stage injection tube 19 is heated by heat exchange with the high-pressure refrigerant cooled in the usage-side heat exchanger 6 as a radiator (refer to point K in FIGS. 9 and 13 through 15), and is mixed with the intermediate-pressure refrigerant discharged from the first-stage compression element 2*c* as described above. The high-pressure refrigerant cooled in the economizer heat exchanger 20 is depressurized to a nearly saturated pressure by the first expansion mechanism 5*a* and is temporarily retained in the receiver 18 (refer to point I in FIGS. 9 and 13). The refrigerant retained in the receiver 18 is fed to the receiver outlet tube 18*b* and is depressurized by the second expansion mechanism 5*b* to become a low-pressure gas-liquid two-phase refrigerant, and is then fed through the outlet non-return valve 17*d* of the bridge circuit 17 to the heat source-side heat exchanger 4 functioning as a refrigerant evaporator (refer to point E in FIGS. 9, and 13 through 15). The low-pressure gas-liquid two-phase refrigerant fed to the heat source-side heat exchanger 4 is heated by heat exchange with water or air as a heating source in the heat source-side heat exchanger 4, and the refrigerant evaporates as a result (refer to point A in FIGS. 9, 13 through 15). The low-pressure refrigerant heated and evaporated in the heat source-side heat exchanger 4 is then drawn once more into the compression mechanism 2 via the switching mechanism 3. In this manner the air-warming operation is performed.

Thus, the air-conditioning apparatus 1 of the present modification differs in that instead of the first second-stage injection tube 18*c* and the liquid injection tube 18*h*, the third second-stage injection tube 19 is provided and intermediate pressure injection is performed through the economizer heat exchanger 20 for branching off the refrigerant whose heat has been radiated in the heat source-side heat exchanger 4 and returning the refrigerant to the second-stage compression element 2*d*, but the same operational effects as those of the embodiment described above can be achieved during the air-warming operation.

In the present modification as well, injection rate optimization control for controlling the flow rate of the refrigerant returned to the second-stage compression element 2*d* through the third second-stage injection tube 19 is performed so that the injection ratio is greater during the air-warming operation than during the air-cooling operation. More specifically, in the present modification, injection rate optimization control involves setting the target value SHH of the degree of superheating SH during the air-warming operation to be equal to or less than the target value SHC of the degree of superheating during the air-cooling operation, whereby the temperature of the refrigerant discharged from the compression mechanism 2 (refer to point D in FIG. 15) can be kept even lower while suppressing heat radiation to the exterior even during the air-warming operation in which the intermediate heat exchanger 7 has no cooling effect on the refrigerant drawn into the second-stage compression element 2*d*, and the coefficient of performance can be improved.

Furthermore, in the present modification, as in FIG. 8 in the embodiment described above, there is a tendency for the optimum injection ratio during the air-warming operation to be greater than the optimum injection ratio during the air-cooling operation by an amount equivalent to the cooling effect by the intermediate heat exchanger 7, and it is therefore preferable to set the target value SHH (see FIG. 15) of the degree of superheating SH during the air-warming operation to the same value as the target value SHC of the degree of superheating SH during the air-cooling operation. Thereby, in the present modification as well, when the target value SHC of the degree of superheating SH during the air-cooling operation is set near a value corresponding to the optimum injection ratio at which the coefficient of performance during the air-cooling operation reaches a maximum as described above, during the air-warming operation as well, the injection ratio approaches the optimum injection ratio at which the coefficient of performance during the air-warming operation reaches a maximum, and intermediate pressure injection can be performed at the optimum injection ratio at which the coefficient of performance reaches a maximum during both the air-cooling operation and the air-warming operation.

In the description above, the flow rate of the refrigerant returned to the second-stage compression element 2*d* through the third second-stage injection tube 19 is controlled so that the degree of superheating SH of the refrigerant drawn into the second-stage compression element 2*d* reaches the target value SHC and/or the target value SHH, but another possibility is that opening degree adjustment be used instead so as to bring the degree of superheating of the refrigerant in the outlet in the third second-stage injection tube 19 side of the economizer heat exchanger 20 to the target value. In this case, the degree of superheating of the refrigerant drawn into the second-stage compression element 2*d* is obtained by converting the intermediate pressure detected by the intermediate pressure sensor 54 to a saturation temperature and subtracting this refrigerant saturation temperature value from the temperature of the refrigerant in the outlet in the third second-stage injection tube 19 side of the economizer heat exchanger 20 as detected by an economizer outlet temperature sensor 55 (shown by dashed lines in FIGS. 9, 10, and 13). Though not used in the present modification, another possible option is to provide a temperature sensor to the inlet in the second second-stage injection tube 19 side of the economizer heat exchanger 20, and to obtain the degree of superheating of the refrigerant at the outlet in the second second-stage injection tube 19 side of the economizer heat exchanger 20 by subtracting the refrigerant temperature detected by this temperature sensor from the refrigerant temperature detected by the economizer outlet temperature sensor 55. In this case, it is preferable that the target value of the degree of superheating during the air-warming operation be set to a value smaller by 5° C. to 10° C. than the target value of the degree of superheating during the air-cooling operation (this value is equivalent to the cooling effect of the intermediate heat exchanger 7). Thereby, during the air-warming operation as well, the refrigerant admitted into the second-stage compression element 2*d* is cooled by intermediate pressure injection during the air-warming operation to the same degree of superheating SH as that of the air-cooling operation in which the refrigerant is cooled by the intermediate heat exchanger 7 and by intermediate pressure injection, and the injection ratio during the air-warming operation is greater than during the air-cooling operation by an amount equivalent to the cooling effect of the intermediate heat exchanger 7.

(4) Modification 2

In the refrigerant circuits 10 and 110 (FIGS. 1 and 9) in the embodiment and its modification described above, to reduce heat radiation loss in the heat source-side heat exchanger 4 during the air-cooling operation, the intermediate heat exchanger 7 which functions as a cooler of refrigerant discharged from the first-stage compression element 2*c* and drawn into the second-stage compression element 2*d* is provided to the intermediate refrigerant tube 8 for drawing refrigerant discharged from the first-stage compression element 2*c* into the second-stage compression element 2*d*, and to suppress heat radiation to the exterior and enable the heat to be used in the usage-side heat exchanger 6 functioning as a radiator of refrigerant during the air-warming operation, the intermediate heat exchanger bypass tube 9 for bypassing the intermediate heat exchanger 7 is provided, creating a state in which the intermediate heat exchanger 7 is not used during the air-warming operation. Therefore, the intermediate heat exchanger 7 is a device that is not used during the air-warming operation.

Figure 16:
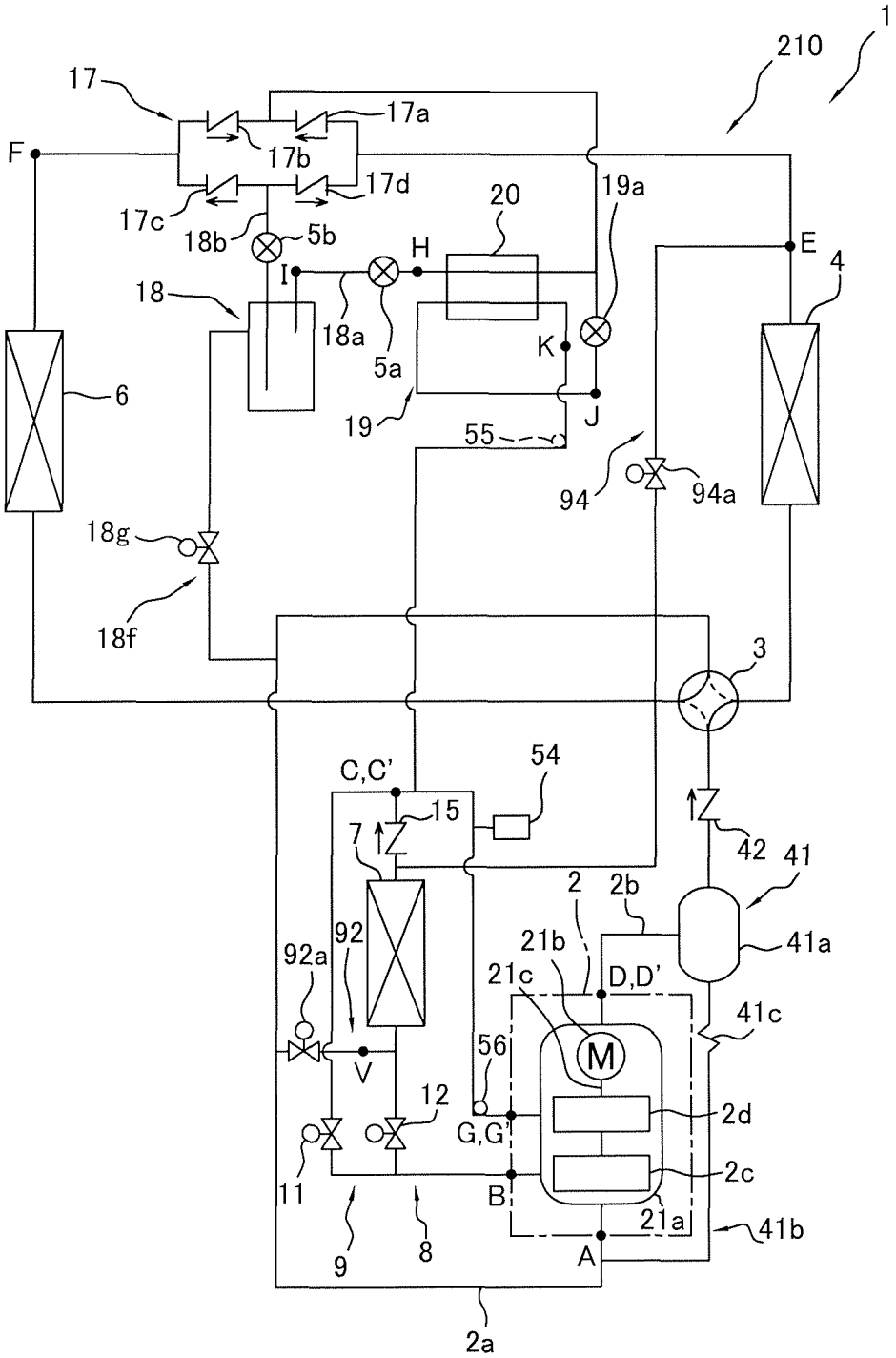
FIG. 16 is a schematic structural diagram of an air-conditioning apparatus according to Modification 2.

In view of this, to effectively use the intermediate heat exchanger 7 in the air-warming operation, the refrigerant circuit 110 of Modification 1 described above is configured in the present modification as a refrigerant circuit 210 by providing a second intake return tube 92 for connecting one end of the intermediate heat exchanger 7 and the intake side of the compression mechanism 2, and also providing an intermediate heat exchanger return tube 94 for connecting the other end of the intermediate heat exchanger 7 with the portion between the usage-side heat exchanger 6 and the heat source-side heat exchanger 4, as shown in FIG. 16.

The second intake return tube 92 is connected to one end of the intermediate heat exchanger 7 (the end near the first-stage compression element 2*c*), and the intermediate heat exchanger return tube 94 is connected to the other end of the intermediate heat exchanger 7 (the end near the second-stage compression element 2*d*). This second intake return tube 92 is a refrigerant tube for connecting one end of the intermediate heat exchanger 7 and the intake side of the compressor 2 (the intake tube 2*a*) during a state in which the refrigerant discharged from the first-stage compression element 2*c* is being drawn into the second-stage compression element 2*d* through the intermediate heat exchanger bypass tube 9. The intermediate heat exchanger return tube 94 is a refrigerant tube for connecting the portion between the usage-side heat exchanger 6 and the heat source-side heat exchanger 4 (the portion between the first expansion mechanism 5*a* as a heat source-side expansion mechanism which depressurizes the refrigerant to a low pressure in the refrigeration cycle and the heat source-side heat exchanger 4 as an evaporator) with the other end of the intermediate heat exchanger 7, when the refrigerant discharged from the first-stage compression element 2*c* is being drawn into the second-stage compression element 2*d* through the intermediate heat exchanger bypass tube 9 and the switching mechanism 3 has been set to the heating operation state. In the present modification, the second intake return tube 92 is connected at one end to the portion of the intermediate refrigerant tube 8 extending from the connection with the end of the intermediate heat exchanger bypass tube 9 near the first-stage compression element 2*c* to the end of the intermediate heat exchanger 7 near the first-stage compression element 2*c*, while the other end is connected to the intake side of the compressor 2 (the intake tube 2*a*). One end of the intermediate heat exchanger return tube 94 is connected to the portion extending from the first expansion mechanism 5*a* to the heat source-side heat exchanger 4, while the other end is connected to the portion of the intermediate refrigerant tube 8 extending from the end of the intermediate heat exchanger 7 near the first-stage compression element 2*c* to the non-return mechanism 15. The second intake return tube 92 is provided with a second intake return on/off valve 92*a*, and the intermediate heat exchanger return tube 94 is provided with an intermediate heat exchanger return on/off valve 94*a*. The second intake return on/off valve 92*a* and the intermediate heat exchanger return on/off valve 94*a* are electromagnetic valves in the present modification. In the present modification, the second intake return on/off valve 92*a* is essentially controlled so as to close when the switching mechanism 3 is set for the cooling operation state, and to open when the switching mechanism 3 is set for the heating operation state. The intermediate heat exchanger return on/off valve 94*a* essentially is controlled so as to close when the switching mechanism 3 is set for the cooling operation state, and to open when the switching mechanism 3 is set for the heating operation state.

Thus, in the present modification, owing primarily to the intermediate heat exchanger bypass tube 9, the second intake return tube 92, and the intermediate heat exchanger return tube 94, the intermediate-pressure refrigerant flowing through the intermediate refrigerant tube 8 can be cooled by the intermediate heat exchanger 7 during the air-cooling operation; and during the air-warming operation, the intermediate-pressure refrigerant flowing through the intermediate refrigerant tube 8 can be made to bypass the intermediate heat exchanger 7 via the intermediate heat exchanger bypass tube 9, and some of the refrigerant cooled in the usage-side heat exchanger 6 can be introduced into and evaporated in the intermediate heat exchanger 7 and returned to the intake side of the compression mechanism 2 by the second intake return tube 92 and the intermediate heat exchanger return tube 94.

Figure 17:
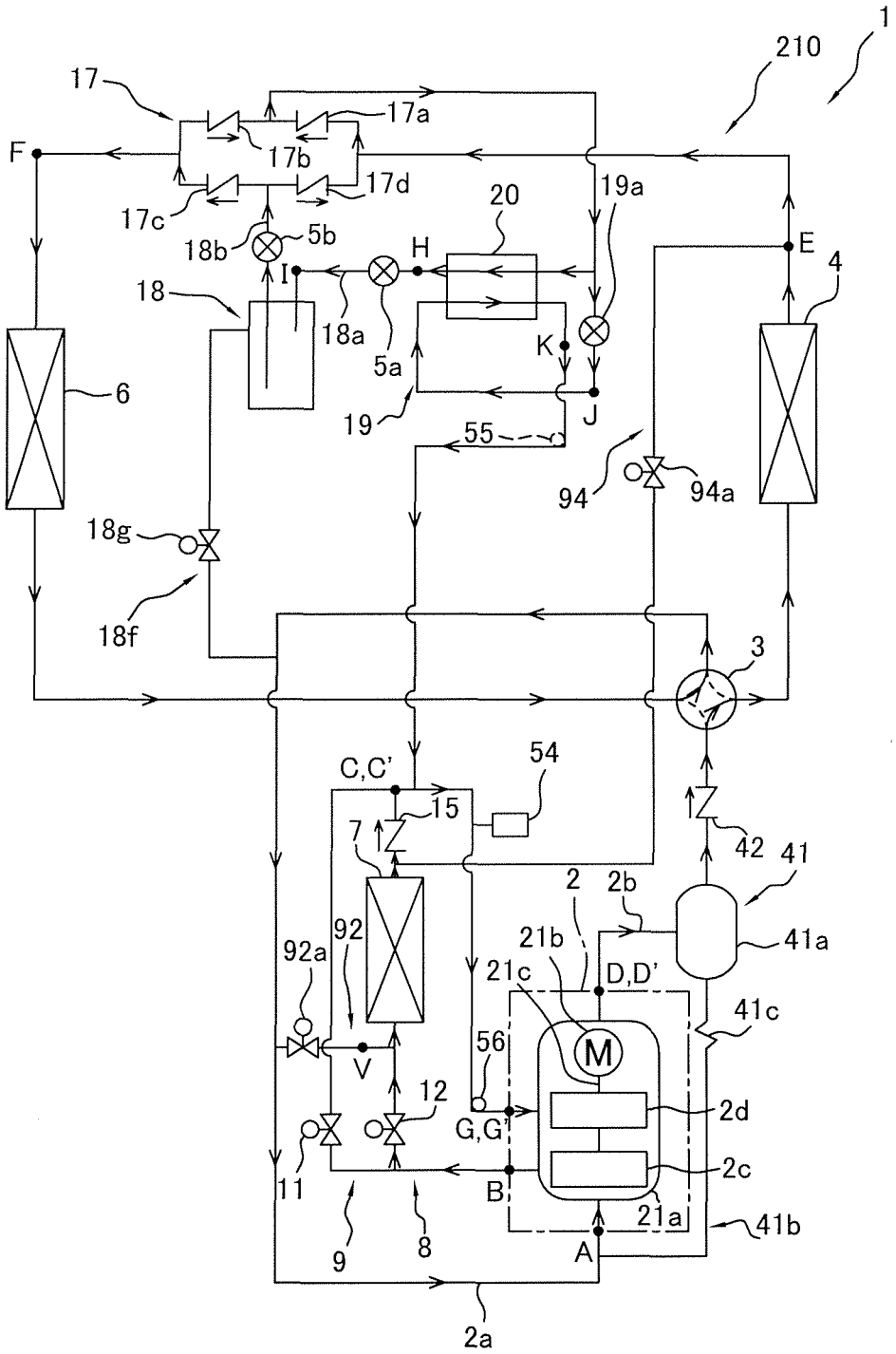
FIG. 17 is a diagram showing the flow of refrigerant within the air-conditioning apparatus during the air-cooling operation.
Figure 18:
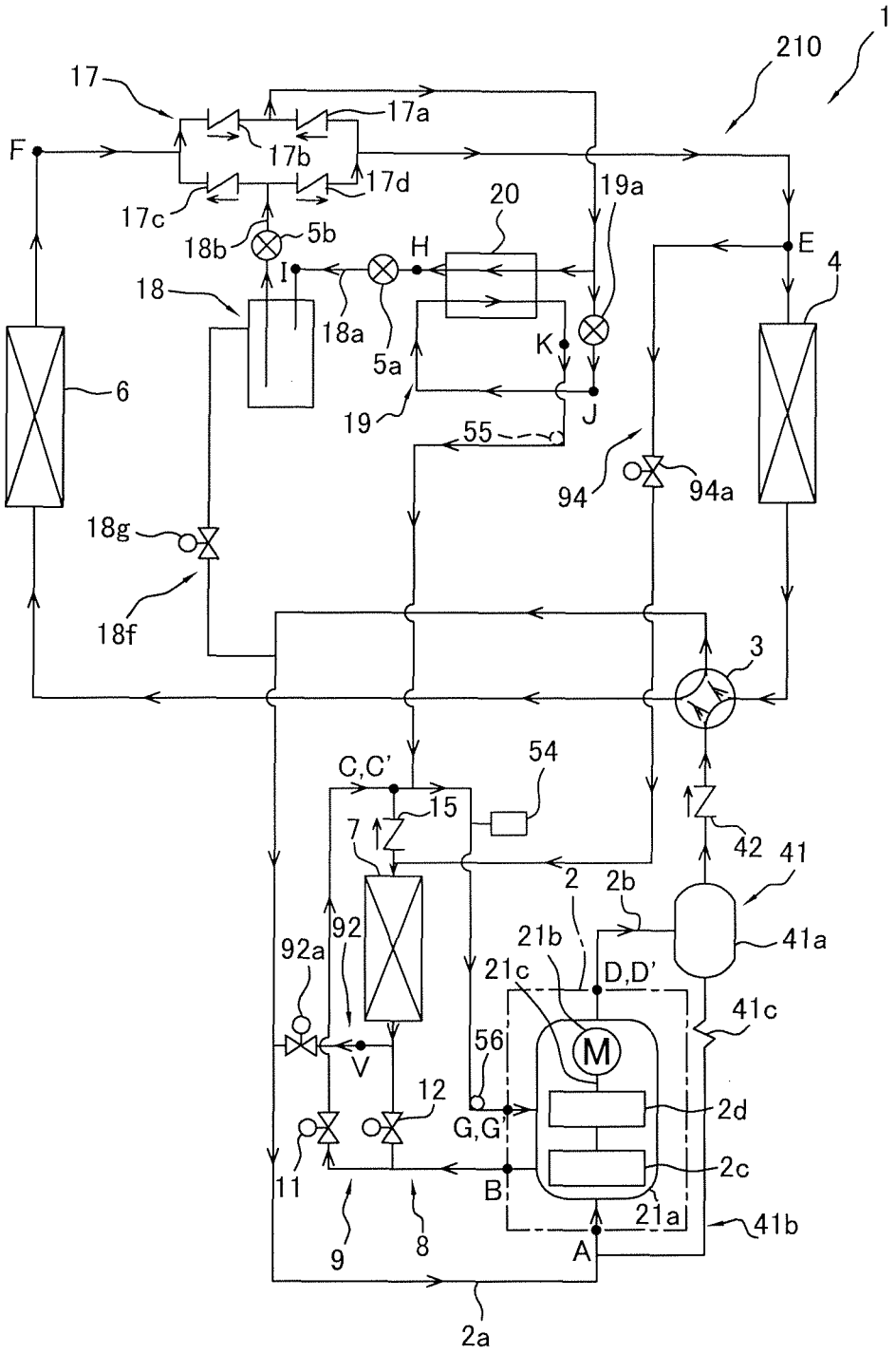
FIG. 18 is a diagram showing the flow of refrigerant within the air-conditioning apparatus during the air-warming operation.
Figure 19:
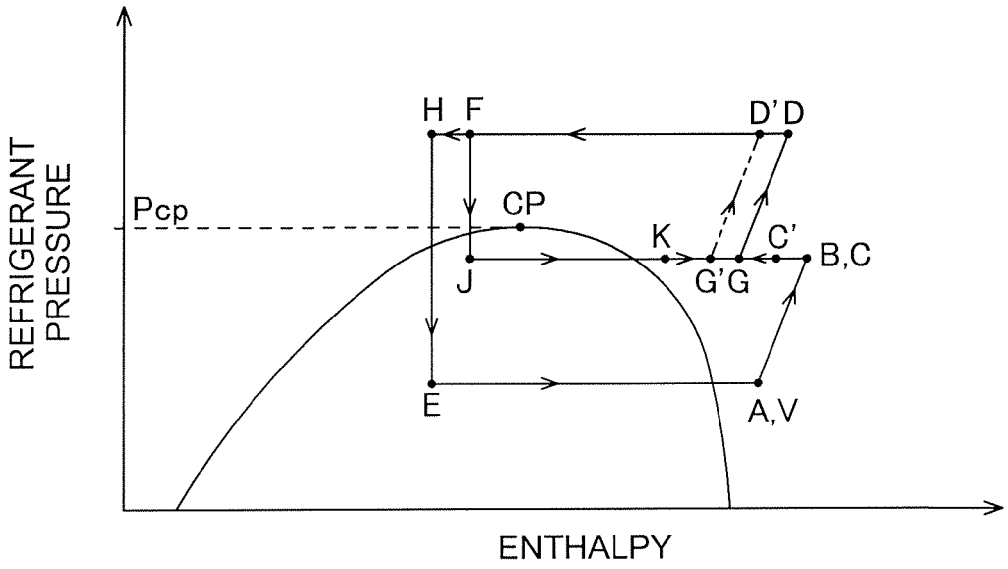
FIG. 19 is a pressure-enthalpy graph representing the refrigeration cycle during the air-warming operation in the air-conditioning apparatus according to Modification 2.
Figure 20:
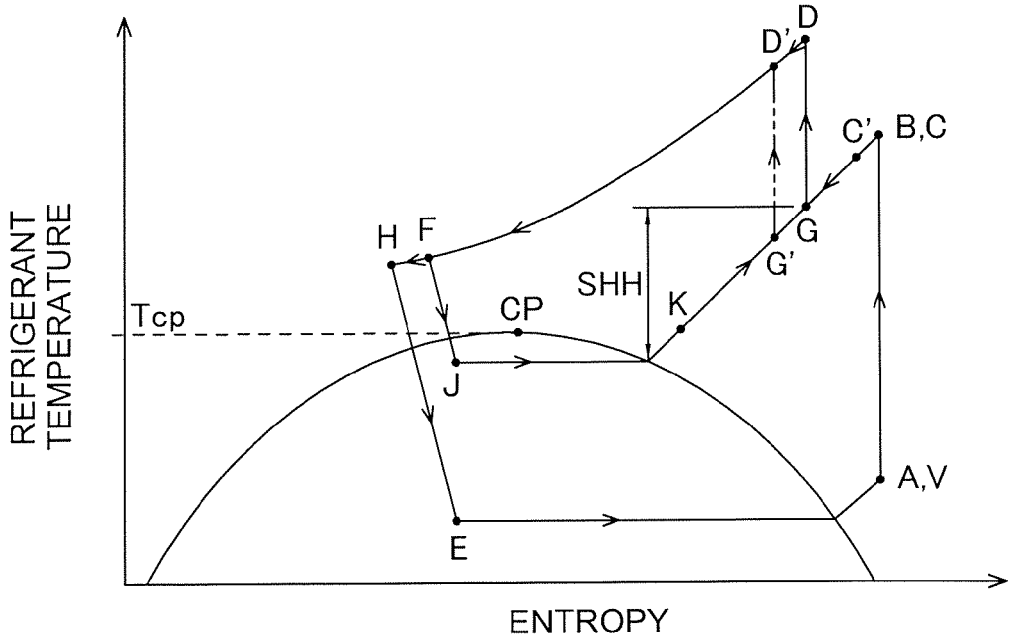
FIG. 20 is a temperature-entropy graph representing the refrigeration cycle during the air-warming operation in the air-conditioning apparatus according to Modification 2.

Next, the action of the air-conditioning apparatus 1 will be described using FIGS. 16, 17, 11, 12, and 18 through 20. FIG. 17 is a diagram showing the flow of refrigerant within the air-conditioning apparatus 1 during the air-cooling operation, FIG. 18 is a diagram showing the flow of refrigerant within the air-conditioning apparatus 1 during the air-warming operation, FIG. 19 is a pressure-enthalpy graph representing the refrigeration cycle during the air-warming operation, and FIG. 20 is a temperature-entropy graph representing the refrigeration cycle during the air-warming operation. Operation controls during the following air-cooling operation and air-warming operation are performed by the aforementioned controller (not shown). In the following description, the term "high pressure" means a high pressure in the refrigeration cycle (specifically, the pressure at points D, D', E, and H in FIGS. 11 and 12, and the pressure at points D, D', F, and H in FIGS. 19 and 20), the term "low pressure" means a low pressure in the refrigeration cycle (specifically, the pressure at points A and F in FIGS. 11 and 12, and the pressure at points A, E, and V in FIGS. 19 and 20), and the term "intermediate pressure" means an intermediate pressure in the refrigeration cycle (specifically, the pressure at points B, C, C', G, G', J, and K in FIGS. 11, 12, 19, and 20).

<Air-cooling Operation>

During the air-cooling operation, the switching mechanism 3 is brought to the cooling operation state shown by the solid lines in FIGS. 16 and 17. The opening degrees of the first expansion mechanism 5*a* and the second expansion mechanism 5*b* are adjusted. Since the switching mechanism 3 is set for the cooling operation state, the intermediate heat exchanger on/off valve 12 of the intermediate refrigerant tube 8 is opened and the intermediate heat exchanger bypass on/off valve 11 of the intermediate heat exchanger bypass tube 9 is closed, thereby creating a state in which the intermediate heat exchanger 7 functions as a cooler. Additionally, the second intake return on/off valve 92*a* of the second intake return tube 92 is closed, thereby creating a state in which the intermediate heat exchanger 7 and the intake side of the compression mechanism 2 are not connected, and the intermediate heat exchanger return on/off valve 94*a* of the intermediate heat exchanger return tube 94 is closed, thereby creating a state in which the intermediate heat exchanger 7 is not connected with the portion between the usage-side heat exchanger 6 and the heat source-side heat exchanger 4. Furthermore, the opening degree of the third second-stage injection valve 19*a* is adjusted in the same manner as in the air-cooling operation in Modification 1 described above.

When the refrigerant circuit 210 is in this state, low-pressure refrigerant (refer to point A in FIGS. 16, 17, 11, and 12) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B in FIGS. 16, 17, 11, and 12). The intermediate-pressure refrigerant discharged from the first-stage compression element 2*c* is cooled by heat exchange with water or air as a cooling source in the intermediate heat exchanger 7 (refer to point C in FIGS. 16, 17, 11, and 12). The refrigerant cooled in the intermediate heat exchanger 7 is further cooled (refer to point G in FIGS. 16, 17, 11, and 12) by being mixed with refrigerant being returned from the third second-stage injection tube 19 to the second-stage compression element 2*d* (refer to point K in FIGS. 16, 17, 11, and 12). Next, having been mixed with the refrigerant returning from the third second-stage injection tube 19 (i.e., intermediate pressure injection is carried out by the economizer heat exchanger 20), the intermediate-pressure refrigerant is drawn into and further compressed in the compression element 2*d* connected to the second-stage side of the compression element 2*c*, and the refrigerant is discharged from the compression mechanism 2 to the discharge tube 2*b* (refer to point D in FIGS. 16, 17, 11, and 12). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 11). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and drawn once more into the compression mechanism 2. Next, having been separated from the refrigeration oil in the oil separation mechanism 41, the high-pressure refrigerant is passed through the non-return mechanism 42 and the switching mechanism 3, and is fed to the heat source-side heat exchanger 4 functioning as a refrigerant radiator. The high-pressure refrigerant fed to the heat source-side heat exchanger 4 is cooled in the heat source-side heat exchanger 4 by heat exchange with water or air as a cooling source (refer to point E in FIGS. 16, 17, 11, and 12). The high-pressure refrigerant cooled in the heat source-side heat exchanger 4 flows through the inlet non-return valve 17*a* of the bridge circuit 17 into the receiver inlet tube 18*a*, and some of the refrigerant is branched off into the third second-stage injection tube 19. The refrigerant flowing through the third second-stage injection tube 19 is depressurized to a nearly intermediate pressure in the third second-stage injection valve 19*a* and is then fed to the economizer heat exchanger 20 (refer to point J in FIGS. 16, 17, 11, and 12). The refrigerant branched off to the third second-stage injection tube 19 then flows into the economizer heat exchanger 20, where it is cooled by heat exchange with the refrigerant flowing through the third second-stage injection tube 19 (refer to point H in FIGS. 16, 17, 11, and 12). The refrigerant flowing through the third second-stage injection tube 19 is heated by heat exchange with the high-pressure refrigerant cooled in the heat source-side heat exchanger 4 as a radiator (refer to point K in FIGS. 16, 17, 11, and 12), and is mixed with the intermediate-pressure refrigerant discharged from the first-stage compression element 2*c* as described above. The high-pressure refrigerant cooled in the economizer heat exchanger 20 is depressurized to a nearly saturated pressure by the first expansion mechanism 5*a* and is temporarily retained in the receiver 18 (refer to point I in FIGS. 16 and 17). The refrigerant retained in the receiver 18 is fed to the receiver outlet tube 18*b* and is depressurized by the second expansion mechanism 5*b* to become a low-pressure gas-liquid two-phase refrigerant, and is then fed through the outlet non-return valve 17*c* of the bridge circuit 17 to the usage-side heat exchanger 6 functioning as a refrigerant evaporator (refer to point F in FIGS. 16, 17, 11, and 12). The low-pressure gas-liquid two-phase refrigerant fed to the usage-side heat exchanger 6 is heated by heat exchange with water or air as a heating source, and the refrigerant evaporates as a result (refer to point A in FIGS. 16, 17, 11, and 12). The low-pressure refrigerant heated in the usage-side heat exchanger 6 is then drawn once more into the compression mechanism 2 via the switching mechanism 3. In this manner the air-cooling operation is performed.

Thus, in the air-conditioning apparatus 1 of the present modification, during the air-cooling operation, the same operational effects as those of Modification 1 described above are achieved.

<Air-warming Operation>

During the air-warming operation, the switching mechanism 3 is brought to the heating operation state shown by the dashed lines in FIGS. 16 and 18. The opening degrees of the first expansion mechanism 5*a* and the second expansion mechanism 5*b* are adjusted. Since the switching mechanism 3 is set to a heating operation state, the intermediate heat exchanger on/off valve 12 of the intermediate refrigerant tube 8 is closed and the intermediate heat exchanger bypass on/off valve 11 of the intermediate heat exchanger bypass tube 9 is opened, thereby creating a state in which the intermediate heat exchanger 7 does not function as a cooler Additionally, the second intake return on/off valve 92*a* of the second intake return tube 92 is opened, thereby creating a state in which the intermediate heat exchanger 7 and the intake side of the compression mechanism 2 are connected, and the intermediate heat exchanger return on/off valve 94*a* of the intermediate heat exchanger return tube 94 is also opened, thereby creating a state in which the intermediate heat exchanger 7 is connected with the portion between the usage-side heat exchanger 6 and the heat source-side heat exchanger 4. Furthermore, the opening degree of the third second-stage injection valve 19*a* is adjusted in the same manner as in the air-warming operation in Modification 1 described above.

When the refrigerant circuit 210 is in this state, low-pressure refrigerant (refer to point A in FIG. 16 and FIGS. 18 through 20) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B in FIG. 16, FIGS. 18 through 20). The intermediate-pressure refrigerant discharged from the first-stage compression element 2*c* passes through the intermediate heat exchanger bypass tube 9 (refer to point C in FIGS. 16 and 18 through 20) without passing through the intermediate heat exchanger 7 (i.e., without being cooled), unlike in the air-cooling operation described above. The intermediate-pressure refrigerant that has passed through the intermediate heat exchanger bypass tube 9 without being cooled by the intermediate heat exchanger 7 is cooled (refer to point G in FIGS. 16 and 18 through 20) by mixing with the refrigerant returned to the second-stage compression element 2*d* from the third second-stage injection tube 19 (refer to point K in FIGS. 16 and 18 through 20). Next, having been mixed with the refrigerant returning from the third second-stage injection tube 19 (i.e., intermediate pressure injection is carried out by the economizer heat exchanger 20), the intermediate-pressure refrigerant is drawn into and further compressed in the compression element 2*d* connected to the second-stage side of the compression element 2*c*, and the refrigerant is discharged from the compression mechanism 2 to the discharge tube 2*b* (refer to point D in FIGS. 16, 18 through 20). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 19). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and drawn once more into the compression mechanism 2. Next, having been separated from the refrigeration oil in the oil separation mechanism 41, the high-pressure refrigerant is passed through the non-return mechanism 42 and the switching mechanism 3, fed to the usage-side heat exchanger 6 functioning as a radiator of refrigerant, and cooled by heat exchange with water and/or air as a cooling source (refer to point F in FIGS. 16 and 18 through 20). The high-pressure refrigerant cooled in the usage-side heat exchanger 6 flows through the inlet non-return valve 17*b* of the bridge circuit 17 into the receiver inlet tube 18*a*, and some of the refrigerant is branched off into the third second-stage injection tube 19. The refrigerant flowing through the third second-stage injection tube 19 is depressurized to a nearly intermediate pressure in the third second-stage injection valve 19*a* and is then fed to the economizer heat exchanger 20 (refer to point J in FIGS. 16, and 18 through 20). The refrigerant branched off to the third second-stage injection tube 19 then flows into the economizer heat exchanger 20, where it is cooled by heat exchange with the refrigerant flowing through the third second-stage injection tube 19 (refer to point H in FIGS. 16, 18 through 20). The refrigerant flowing through the third second-stage injection tube 19 is heated by heat exchange with the high-pressure refrigerant cooled in the usage-side heat exchanger 6 as a radiator (refer to point K in FIGS. 16 and 18 through 20), and is mixed with the intermediate-pressure refrigerant discharged from the first-stage compression element 2*c* as described above. The high-pressure refrigerant cooled in the economizer heat exchanger 20 is depressurized to a nearly saturated pressure by the first expansion mechanism 5*a* and is temporarily retained in the receiver 18 (refer to point I in FIGS. 16 and 18). The refrigerant retained in the receiver 18 is fed to the receiver outlet tube 18*b* and is depressurized by the second expansion mechanism 5*b* to become a low-pressure gas-liquid two-phase refrigerant, which is then fed through the outlet non-return valve 17*d* of the bridge circuit 17 to the heat source-side heat exchanger 4 functioning as a refrigerant evaporator, and is also fed through the intermediate heat exchanger return tube 94 to the intermediate heat exchanger 7 functioning as a refrigerant evaporator (refer to point E in FIGS. 16 and 18 through 20). The low-pressure gas-liquid two-phase refrigerant fed to the heat source-side heat exchanger 4 is heated by heat exchange with water or air as a heating source in the heat source-side heat exchanger 4, and the refrigerant evaporates as a result (refer to point A in FIGS. 16 and 18 through 20). The low-pressure gas-liquid two-phase refrigerant fed to the intermediate heat exchanger 7 is also heated by heat exchange with water or air as a heating source, and the refrigerant evaporates as a result (refer to point V in FIGS. 16, 18 through 20). The low-pressure refrigerant heated and evaporated in the heat source-side heat exchanger 4 is then drawn once more into the compression mechanism 2 via the switching mechanism 3. The low-pressure refrigerant heated and evaporated in the intermediate heat exchanger 7 is then drawn once more into the compression mechanism 2 via the second intake return tube 92. In this manner the air-warming operation is performed.

Thus, during the air-warming operation in the air-conditioning apparatus 1 of the present modification, the same operational effects as those of Modification 1 described above are achieved, and the heat source-side heat exchanger 4 and the intermediate heat exchanger 7 are both made to function as evaporators of the refrigerant whose heat has been radiated in the usage-side heat exchanger 6 and are both effectively used during the air-warming operation, whereby the refrigerant evaporation capacity during the air-warming operation can be increased, and operating efficiency during the air-warming operation can be improved.

(5) Modification 3

In the refrigerant circuit 10 (see FIG. 1) in the embodiment described above, wherein intermediate pressure injection is performed by the receiver 18 as a gas-liquid separator and liquid injection is performed by the liquid injection tube 18*h* as a second second-stage injection tube, another possibility is to configure a refrigerant circuit to have a plurality of usage-side heat exchangers 6 connected in parallel to each other (see FIG. 21), and to provide usage-side expansion mechanisms 5*c* (see FIG. 21) so as to correspond to each of the usage-side heat exchangers 6 in order to control the flow rates of the refrigerant flowing through each of the usage-side heat exchangers 6 and achieve the refrigeration loads required in each of the usage-side heat exchangers 6. In this case, during the air-warming operation, the flow rates of the refrigerant passing through each of the usage-side heat exchangers 6 are determined for the most part by the opening degrees of the usage-side expansion mechanisms 5*c* provided corresponding to each of the usage-side heat exchangers 6, but at this time, the opening degrees of each of the usage-side expansion mechanisms 5*c* fluctuate not only according to the flow rates of the refrigerant flowing through each of the usage-side heat exchangers 6 but also according to the distribution of the flow rates among the plurality of usage-side heat exchangers 6, and there are cases in which the opening degrees differ greatly among the plurality of usage-side expansion mechanisms 5*c* or the opening degrees of the usage-side expansion mechanisms 5*c* are comparatively small; therefore, cases could arise in which the pressure of the receiver 18 as a gas-liquid separator decreases excessively due to the opening degree control of the usage-side expansion mechanisms 5*c* during the heating operation. Therefore, since intermediate pressure injection by the receiver 18 can still be used even under conditions in which the pressure difference between the pressure of the receiver 18 and the intermediate pressure in the refrigeration cycle is small, this intermediate pressure injection is advantageous when there is a high risk of the pressure of the receiver 18 decreasing excessively, as in the air-warming operation in this configuration.

In the refrigerant circuits 110 and 210 (see FIGS. 1 and 16) in Modifications 1 and 2 described above, in which intermediate pressure injection is performed by the economizer heat exchanger 20, another possibility is to configure the refrigerant circuit to have a plurality of usage-side heat exchangers 6 connected in parallel to each other (see FIG. 21), and to provide usage-side expansion mechanisms 5*c* (see FIG. 21) so as to correspond to each of the usage-side heat exchangers 6 in order to control the flow rates of the refrigerant flowing through the usage-side heat exchangers 6 and achieve the refrigeration loads required in each of the usage-side heat exchangers 6. In this case, during the air-cooling operation, because of the condition that it be possible to use the pressure difference between the high pressure in the refrigeration cycle and the nearly intermediate pressure of the refrigeration cycle without performing a severe depressurizing operation until the time that the refrigerant whose heat has been radiated in the heat source-side heat exchanger 4 flows into the economizer heat exchanger 20, the quantity of heat exchanged in the economizer heat exchanger 20 increases and the flow rate of refrigerant that can be returned to the second-stage compression element 2*d* increases; therefore, the application of this configuration is more advantageous than intermediate pressure injection by the receiver 18 as a gas-liquid separator.

Thus, assuming that the configuration has a plurality of usage-side heat exchangers 6 connected in parallel to each other, and also that the configuration has usage-side expansion mechanisms 5*c* provided so as to correspond to each of the usage-side heat exchangers 6 in order to control the flow rates of refrigerant flowing through each of the usage-side heat exchangers 6 and make it possible to obtain the refrigeration loads required in the usage-side heat exchangers 6; the refrigerant circuit is preferably configured in the manner of the air-conditioning apparatus 1 of the present modification, which is that during the air-warming operation, the refrigerant whose heat has been radiated in the usage-side heat exchangers 6 undergoes gas-liquid separation in the receiver 18, and intermediate pressure injection and liquid injection by the liquid injection tube 18*h* are performed for passing the gas refrigerant resulting from gas-liquid separation through the first second-stage injection tube 18*c* and returning the refrigerant to the second-stage compression element 2*d*; while during the air-cooling operation, heat exchange is performed in the economizer heat exchanger 20 between the refrigerant whose heat has been radiated in the heat source-side heat exchanger 4 and the refrigerant flowing through the third second-stage injection tube 19; and intermediate pressure injection is performed by the economizer heat exchanger 20 for returning to the second-stage compression element 2*d* the refrigerant that flows through the third second-stage injection tube 19 after having undergone this heat exchange.

When the objective is to perform air cooling and/or air heating corresponding to air-conditioning loads for a plurality of air-conditioned spaces, for example, the configuration has a plurality of usage-side heat exchangers 6 connected in parallel to each other, and the configuration has usage-side expansion mechanisms 5*c* provided between the receiver 18 and the usage-side heat exchangers 6 so as to correspond to each of the usage-side heat exchangers 6 in order to control the flow rates of refrigerant flowing through the usage-side heat exchangers 6 and make it possible to obtain the refrigeration loads required in each of the usage-side heat exchangers 6 as described above; during the air-cooling operation, the refrigerant that has been depressurized to a nearly saturated pressure by the first expansion mechanism 5*a* and temporarily retained in the receiver 18 (refer to point L in FIG. 21) is distributed among each of the usage-side expansion mechanisms 5*c*, but when the refrigerant fed from the receiver 18 to each of the usage-side expansion mechanisms 5*c* is in a gas-liquid two-phase state, there is a risk of the flows being uneven in the distribution to each of the usage-side expansion mechanisms 5*c*, and it is therefore preferable that the refrigerant fed from the receiver 18 to each of the usage-side expansion mechanisms 5*c* be brought as near as possible to a subcooled state.

Figure 21:
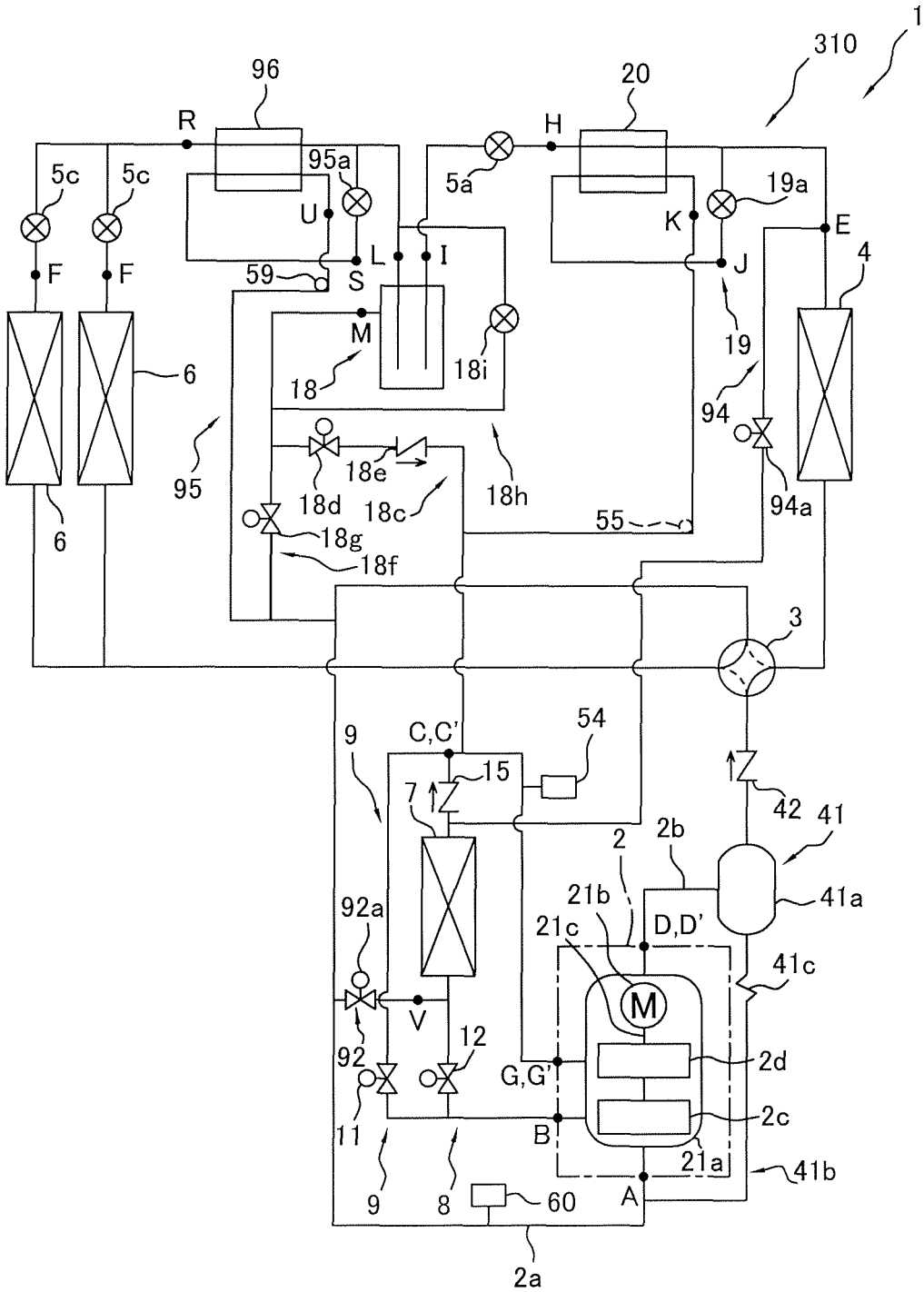
FIG. 21 is a schematic structural diagram of an air-conditioning apparatus according to Modification 3.

In view of this, the present modification is the configuration of Modification 2 described above (see FIG. 16) modified into a refrigerant circuit 310, wherein the first second-stage injection tube 18*c* is connected to the receiver 18 and the liquid injection tube 18*h* is connected between the usage-side expansion mechanisms 5*c* and the receiver 18 in order to enable intermediate pressure injection to be performed by the receiver 18 as a gas-liquid separator and liquid injection to be performed by the liquid injection tube 18*h*, intermediate pressure injection can be performed by the economizer heat exchanger 20 during the air-cooling operation, intermediate pressure injection can be performed by the receiver 18 as a gas-liquid separator during the air-warming operation, and the subcooling heat exchanger 96 as a cooler and a third intake return tube 95 are provided between the receiver 18 and the usage-side expansion mechanisms 5*c*, as shown in FIG. 21.

The third intake return tube 95 herein is a refrigerant tube for branching off the refrigerant fed from the heat source-side heat exchanger 4 as a radiator to the usage-side heat exchangers 6 as evaporators and returning the refrigerant to the intake side of the compression mechanism 2 (i.e., the intake tube 2*a*). In the present modification, the third intake return tube 95 is provided so as to branch off the refrigerant fed from the receiver 18 to the usage-side expansion mechanisms 5*c*. More specifically, the third intake return tube 95 is provided so as to branch off the refrigerant from a position upstream of the subcooling heat exchanger 96 (i.e., between the receiver 18 and the subcooling heat exchanger 96) and return the refrigerant to the intake tube 2*a*. This third intake return tube 95 is provided with a third intake return valve 95*a* whose opening degree can be controlled. The third intake return valve 95*a* is an electromagnetic valve in the present modification.

The subcooling heat exchanger 96 is a heat exchanger for performing heat exchange between the refrigerant fed from the heat source-side heat exchanger 4 as a radiator to the usage-side heat exchangers 6 as evaporators and the refrigerant flowing through the third intake return tube 95 (more specifically, the refrigerant that has been depressurized to a nearly low pressure in the third intake return valve 95*a*). In the present modification, the subcooling heat exchanger 96 is provided so as to perform heat exchange between the refrigerant flowing through a position upstream of the usage-side expansion mechanisms 5*c* (i.e., between the usage-side expansion mechanisms 5*c* and the position where the third intake return tube 95 branches off) and the refrigerant flowing through the third intake return tube 95. In the present modification, the subcooling heat exchanger 96 is provided farther downstream than the position where the third intake return tube 95 branches off. Therefore, the refrigerant cooled in the heat source-side heat exchanger 4 as a radiator branches off to the third intake return tube 95 after passing through the economizer heat exchanger 20 as a cooler, and then undergoes heat exchange in the subcooling heat exchanger 96 with the refrigerant flowing through the third intake return tube 95.

The first second-stage injection tube 18*c* and the third second-stage injection tube 19 are integrated at the portion near the intermediate refrigerant tube 8. The first intake return tube 18*f* and the third intake return tube 95 are integrated at the portion on the intake side of the compression mechanism 2. In the present modification, the usage-side expansion mechanisms 5*c* are electrically driven expansion valves. In the present modification, since the third second-stage injection tube 19 and the economizer heat exchanger 20 are used during the air-cooling operation while the first second-stage injection tube 18*c* and the liquid injection tube 18*h* are used during the air-warming operation as described above, there is no need for the direction of refrigerant flow to the economizer heat exchanger 20 to be constant between the air-cooling operation and the air-warming operation, and the bridge circuit 17 is therefore omitted to simplify the configuration of the refrigerant circuit 310.

An intake pressure sensor 60 for detecting the pressure of the refrigerant flowing through the intake side of the compression mechanism 2 is provided to either the intake tube 2*a* or the compression mechanism 2. The outlet of the subcooling heat exchanger 96 on the side near the third intake return tube 95 is provided with a subcooling heat exchange outlet temperature sensor 59 for detecting the temperature of the refrigerant in the outlet of the subcooling heat exchanger 96 on the side near the third intake return tube 95.

Figure 22:
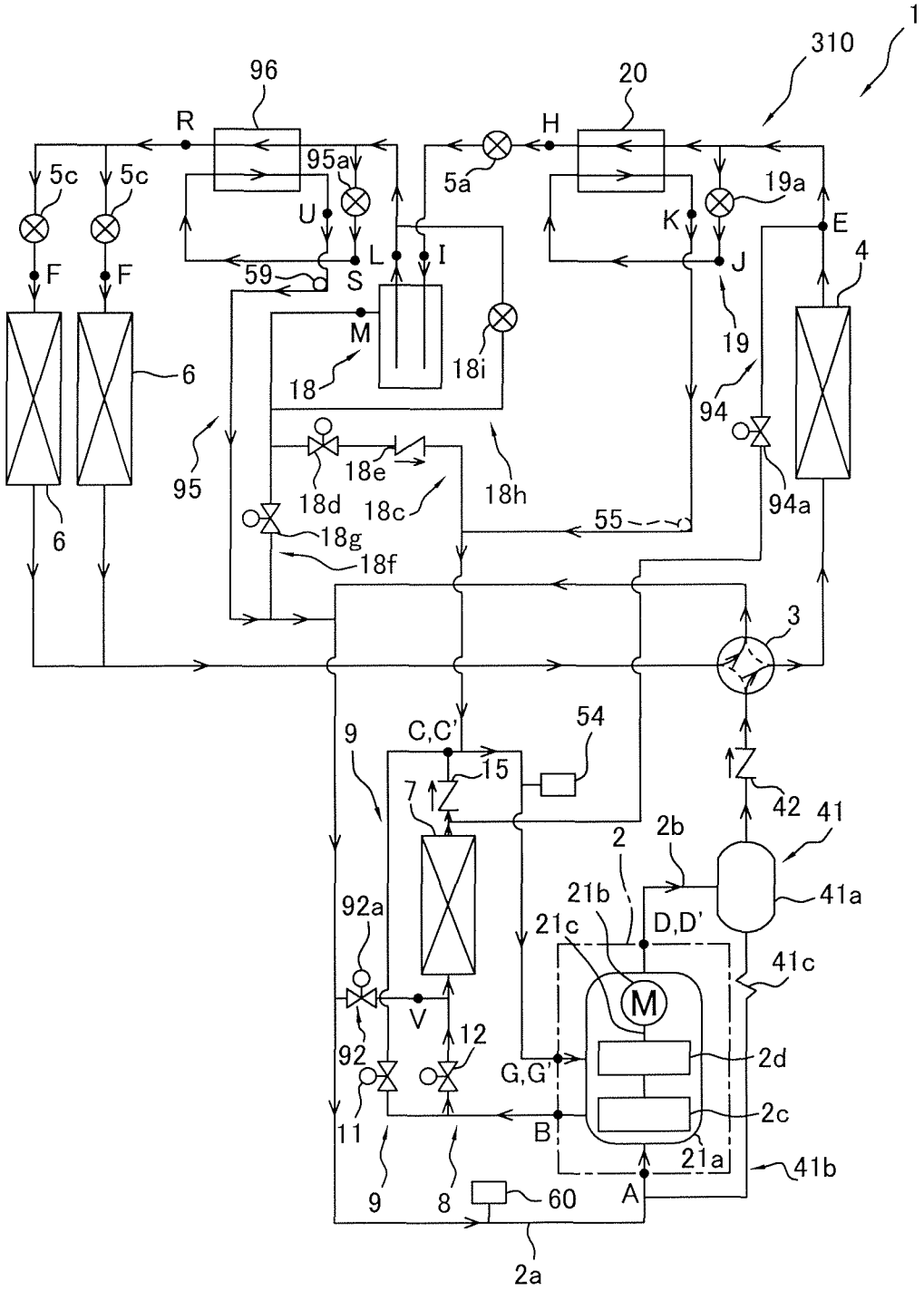
FIG. 22 is a diagram showing the flow of refrigerant within the air-conditioning apparatus during the air-cooling operation.
Figure 23:
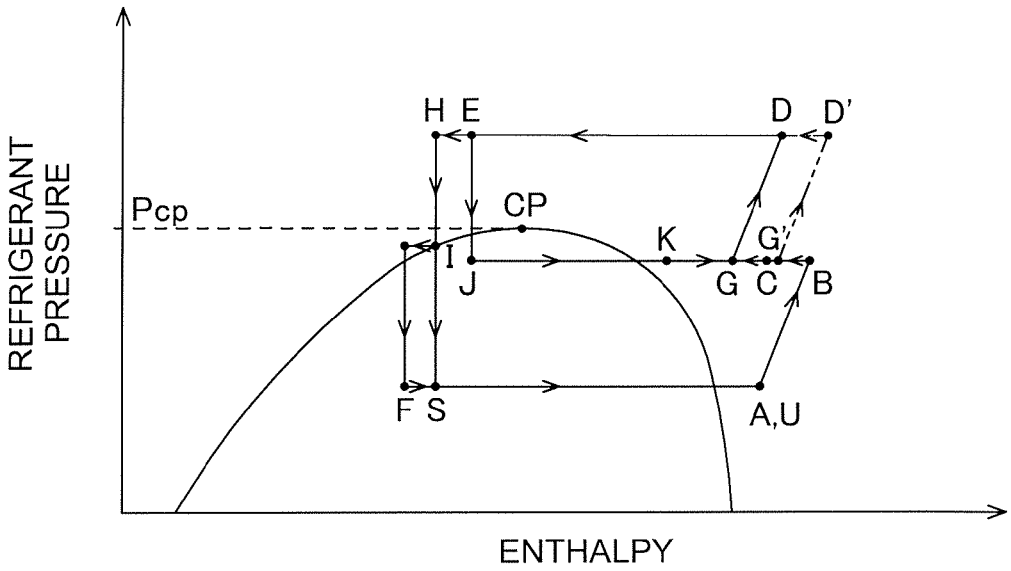
FIG. 23 is a pressure-enthalpy graph representing the refrigeration cycle during the air-cooling operation in the air-conditioning apparatus according to Modification 3.
Figure 24:
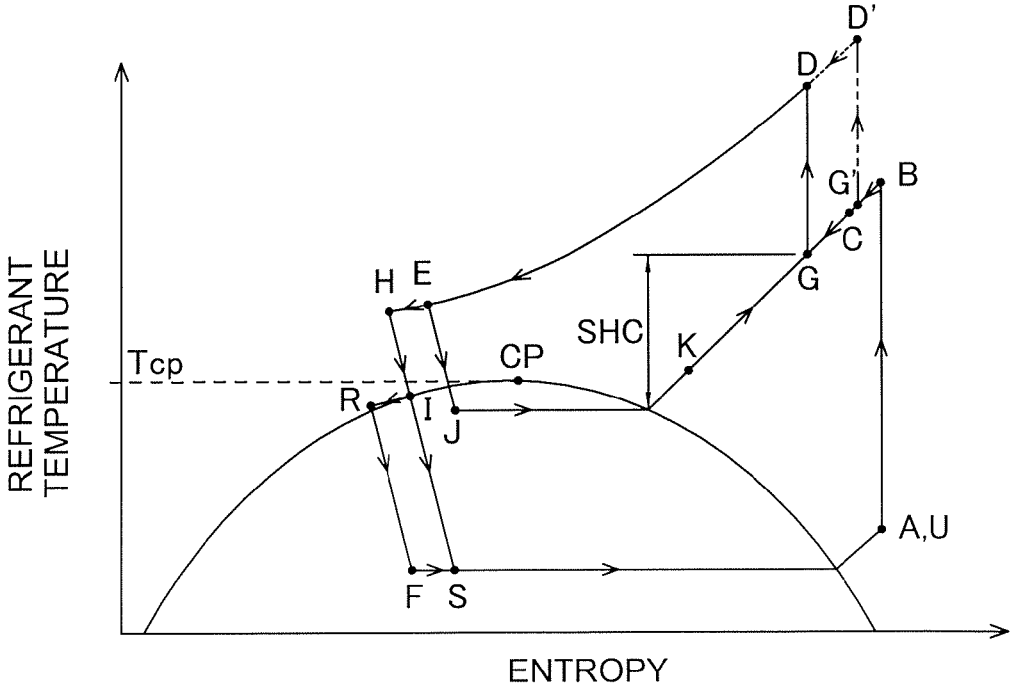
FIG. 24 is a temperature-entropy graph representing the refrigeration cycle during the air-cooling operation in the air-conditioning apparatus according to Modification 3.
Figure 25:
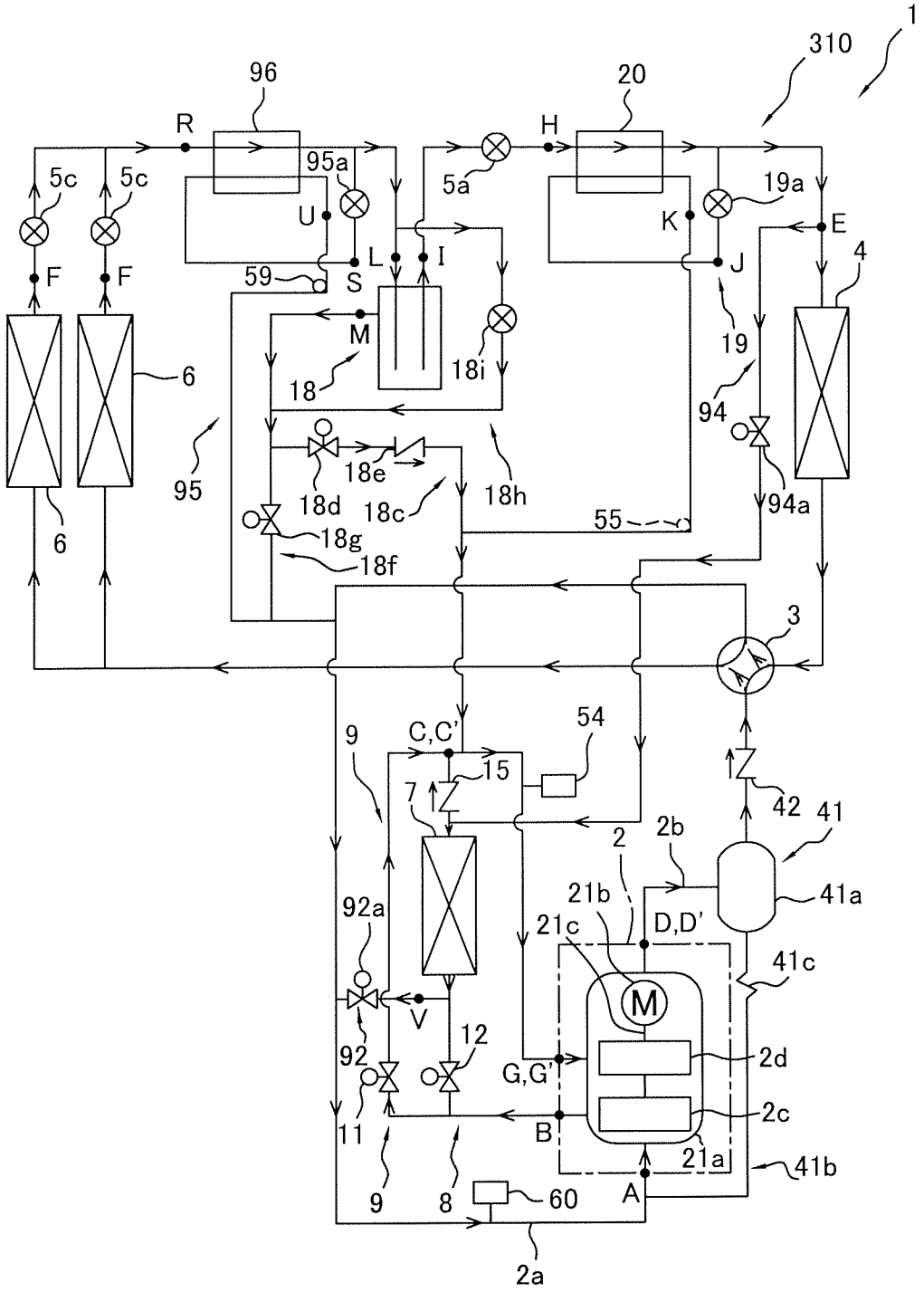
FIG. 25 is a diagram showing the flow of refrigerant within the air-conditioning apparatus during the air-warming operation.
Figure 26:
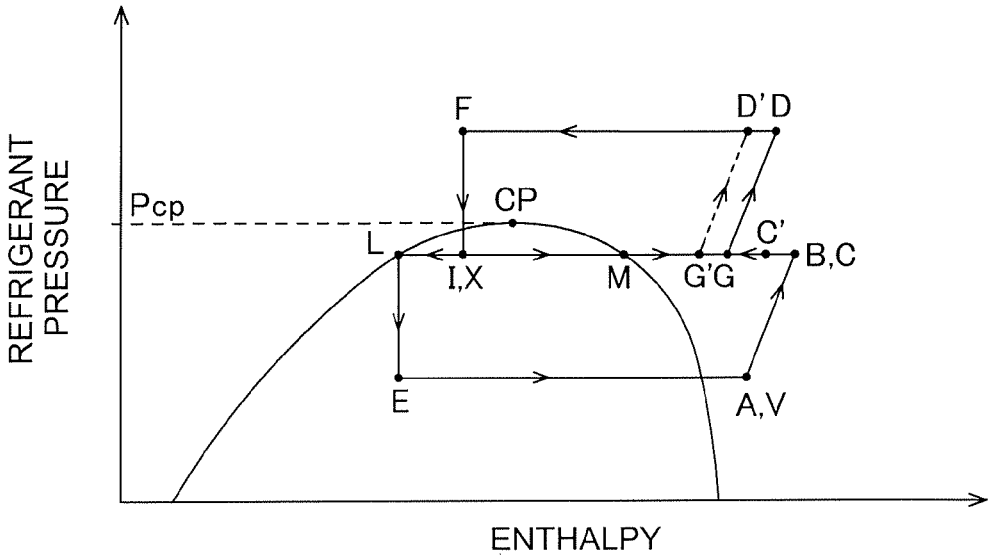
FIG. 26 is a pressure-enthalpy graph representing the refrigeration cycle during the air-warming operation in the air-conditioning apparatus according to Modification 3.
Figure 27:
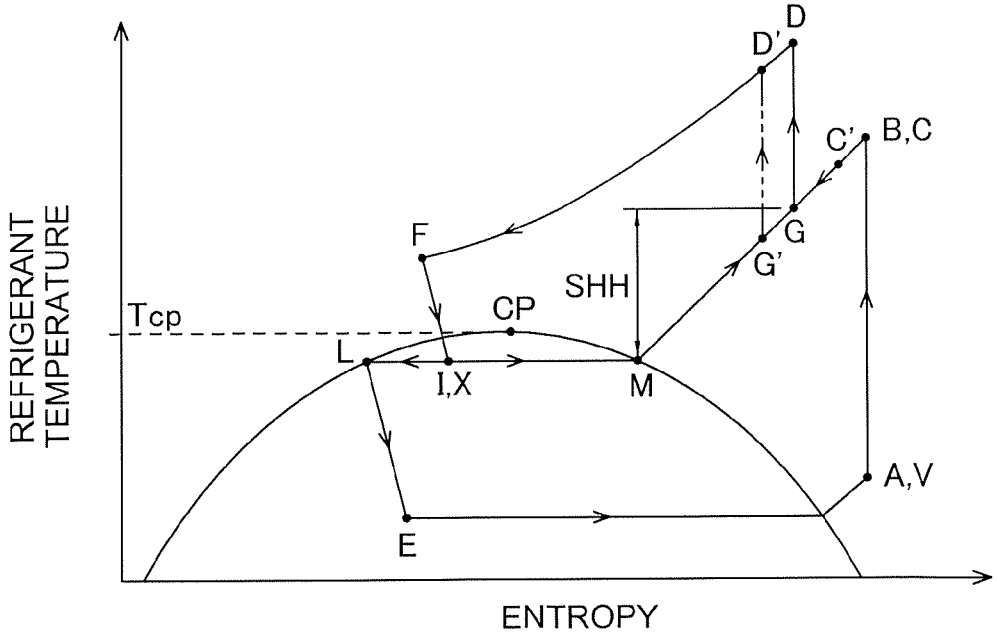
FIG. 27 is a temperature-entropy graph representing the refrigeration cycle during the air-warming operation in the air-conditioning apparatus according to Modification 3.

Next, the action of the air-conditioning apparatus 1 will be described using FIGS. 21 through 27. FIG. 22 is a diagram showing the flow of refrigerant within the air-conditioning apparatus 1 during the air-cooling operation, FIG. 23 is a pressure-enthalpy graph representing the refrigeration cycle during the air-cooling operation, FIG. 24 is a temperature-entropy graph representing the refrigeration cycle during the air-cooling operation, FIG. 25 is a diagram showing the flow of refrigerant within the air-conditioning apparatus 1 during the air-warming operation, FIG. 26 is a pressure-enthalpy graph representing the refrigeration cycle during the air-warming operation, and FIG. 27 is a temperature-entropy graph representing the refrigeration cycle during the air-warming operation. Operation controls during the following air-cooling operation and air-warming operation are performed by the aforementioned controller (not shown). In the following description, the term "high pressure" means a high pressure in the refrigeration cycle (specifically, the pressure at points D, D', E, H, I, and R in FIGS. 23 and 24, and/or the pressure at points D, D', and F in FIGS. 26 and 27), the term "low pressure" means a low pressure in the refrigeration cycle (specifically, the pressure at points A, F, S, and U in FIGS. 23 and 24, and/or the pressure at points A, E, and V in FIGS. 26 and 27), and the term "intermediate pressure" means an intermediate pressure in the refrigeration cycle (specifically, the pressure at points B, C, C', G, G', J, and K in FIGS. 23 and 24, and/or points B, C, C', G, G', I, L, M, and X in FIGS. 26 and 27).

<Air-cooling Operation>

During the air-cooling operation, the switching mechanism 3 is brought to the cooling operation state shown by the solid lines in FIGS. 21 and 22. The opening degrees of the first expansion mechanism 5*a* as the heat source-side expansion mechanism and the usage-side expansion mechanisms 5*c* are adjusted. Since the switching mechanism 3 is in the cooling operation state, the intermediate heat exchanger on/off valve 12 of the intermediate refrigerant tube 8 is opened and the intermediate heat exchanger bypass on/off valve 11 of the intermediate heat exchanger bypass tube 9 is closed, thereby creating a state in which the intermediate heat exchanger 7 functions as a cooler; the second intake return on/off valve 92*a* of the second intake return tube 92 is closed, thereby creating a state in which the intermediate heat exchanger 7 and the intake side of the compression mechanism 2 are not connected; and the intermediate heat exchanger return on/off valve 94*a* of the intermediate heat exchanger return tube 94 is closed, thereby creating a state in which the intermediate heat exchanger 7 is not connected with the portion between the usage-side heat exchangers 6 and the heat source-side heat exchanger 4. When the switching mechanism 3 is in the cooling operation state, intermediate pressure injection is not performed by the receiver 18 as a gas-liquid separator, but intermediate pressure injection is performed by the economizer heat exchanger 20 for returning the refrigerant heated in the economizer heat exchanger 20 to the second-stage compression element 2*d* through the third second-stage injection tube 19. More specifically, the first second-stage injection on/off valve 18*d* is closed, and the opening degree of the third second-stage injection valve 19*a* is adjusted in the same manner as in the air-cooling operation in Modification 2 described above (control is performed so that the degree of superheating SH of the refrigerant admitted into the second-stage compression element 2*d* reaches the target value SHC). Furthermore, when the switching mechanism 3 is in the cooling operation state, the subcooling heat exchanger 96 is used, and the opening degree of the third intake return valve 95*a* is therefore adjusted as well. More specifically, in the present modification, so-called superheat degree control is performed wherein the opening degree of the third intake return valve 19*a* is adjusted so that a target value is achieved in the degree of superheat of the refrigerant at the outlet in the third intake return tube 95 side of the subcooling heat exchanger 96. In the present modification, the degree of superheat of the refrigerant at the outlet in the third intake return tube 95 side of the subcooling heat exchanger 96 is obtained by converting the low pressure detected by the intake pressure sensor 60 to a saturation temperature and subtracting this refrigerant saturation temperature value from the refrigerant temperature detected by the subcooling heat exchanger outlet temperature sensor 59. Though not used in the present modification, another possible option is to provide a temperature sensor to the inlet in the third intake return tube 95 side of the subcooling heat exchanger 96, and to obtain the degree of superheat of the refrigerant at the outlet in the third intake return tube 95 side of the subcooling heat exchanger 96 by subtracting the refrigerant temperature detected by this temperature sensor from the refrigerant temperature detected by the subcooling heat exchanger outlet temperature sensor 59. Opening degree adjustment of the third intake return valve 95*a* is not limited to degree of superheating control, and the third intake return valve 95*a* may be opened to a predetermined opening degree in accordance with the quantity of refrigerant circulating in the refrigerant circuit 310, for example.

When the refrigerant circuit 310 is in this state, low-pressure refrigerant (refer to point A in FIGS. 21 through 24) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B in FIGS. 21 through 24). The intermediate-pressure refrigerant discharged from the first-stage compression element 2*c* is cooled by heat exchange with water or air as a cooling source in the intermediate heat exchanger 7 (refer to point C in FIGS. 21 through 24). The refrigerant cooled in the intermediate heat exchanger 7 is further cooled (refer to point G in FIGS. 21 through 24) by being mixed with refrigerant being returned from the third second-stage injection tube 19 to the compression element 2*d* (refer to point K in FIGS. 21 through 24). Next, having been mixed with the refrigerant returning from the third second-stage injection tube 19 (i.e., intermediate pressure injection is carried out by the economizer heat exchanger 20), the intermediate-pressure refrigerant is drawn into and further compressed in the compression element 2*d* connected to the second-stage side of the compression element 2*c*, and the refrigerant is discharged from the compression mechanism 2 to the discharge tube 2*b* (refer to point D in FIGS. 21 through 24). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 23). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and drawn once more into the compression mechanism 2. Next, having been separated from the refrigeration oil in the oil separation mechanism 41, the high-pressure refrigerant is passed through the non-return mechanism 42 and the switching mechanism 3, and is fed to the heat source-side heat exchanger 4 functioning as a refrigerant radiator. The high-pressure refrigerant fed to the heat source-side heat exchanger 4 is cooled in the heat source-side heat exchanger 4 by heat exchange with water or air as a cooling source (refer to point E in FIGS. 21 through 24). Some of the high-pressure refrigerant cooled in the heat source-side heat exchanger 4 is then branched off to the third second-stage injection tube 19. The refrigerant flowing through the third second-stage injection tube 19 is depressurized to a nearly intermediate pressure in the third second-stage injection valve 19*a* and is then fed to the economizer heat exchanger 20 (refer to point J in FIGS. 21 through 24). The refrigerant branched off to the third second-stage injection tube 19 then flows into the economizer heat exchanger 20, where it is cooled by heat exchange with the refrigerant flowing through the third second-stage injection tube 19 (refer to point H in FIGS. 21 to 24). The refrigerant flowing through the third second-stage injection tube 19 is heated by heat exchange with the high-pressure refrigerant cooled in the heat source-side heat exchanger 4 as a radiator (refer to point K in FIGS. 21 to 24), and is mixed with the intermediate-pressure refrigerant discharged from the first-stage compression element 2*c* as described above. The high-pressure refrigerant cooled in the economizer heat exchanger 20 is depressurized to a nearly saturated pressure by the first expansion mechanism 5*a* and is temporarily retained in the receiver 18 (refer to point I in FIGS. 21 to 24). Some of the refrigerant retained in the receiver 18 is branched off to the third intake return tube 95. The refrigerant flowing through the third intake return tube 95 is depressurized to a nearly low pressure in the third intake return valve 95*a* and is then fed to the subcooling heat exchanger 96 (refer to point S in FIGS. 21 through 24). The refrigerant branched off to the third intake return tube 95 then flows into the subcooling heat exchanger 96, where it is further cooled by heat exchange with the refrigerant flowing through the third intake return tube 95 (refer to point R in FIGS. 21 through 24). The refrigerant flowing through the third intake return tube 95 is heated by heat exchange with the high-pressure refrigerant cooled in the economizer heat exchanger 20 (refer to point U in FIGS. 21 through 24), and is mixed with the refrigerant flowing through the intake side of the compression mechanism 2 (the intake tube 2*a* here). This refrigerant cooled in the subcooling heat exchanger 96 is fed to the usage-side expansion mechanisms 5*c* and depressurized by the usage-side expansion mechanisms 5*c* to a low-pressure gas-liquid two-phase refrigerant, which is fed to the usage-side heat exchangers 6 functioning as evaporators of refrigerant (refer to point F in FIGS. 21 to 24). The low-pressure gas-liquid two-phase refrigerant fed to the usage-side heat exchanger 6 is heated by heat exchange with water or air as a heating source, and the refrigerant is evaporated as a result (refer to point A in FIGS. 21 through 24). The low-pressure refrigerant heated in the usage-side heat exchangers 6 is then drawn once more into the compression mechanism 2 via the switching mechanism 3. In this manner the air-cooling operation is performed.

Thus, in the air-conditioning apparatus 1 of the present modification, since the air-cooling operation takes place under conditions in which a high pressure is maintained in the refrigerant downstream of the heat source-side heat exchanger 4 as a radiator and upstream of the first expansion mechanism 5*a* as a heat source-side expansion mechanism, and it is possible to utilize the pressure difference between the high pressure in the refrigeration cycle and the nearly intermediate pressure of the refrigeration cycle; intermediate pressure injection by the economizer heat exchanger 20 is used, and the same operational effects as those of Modifications 1 and 2 described above can be achieved.

In the present modification, since the refrigerant fed from the receiver 18 to the usage-side expansion mechanisms 5*c* (refer to point I in FIGS. 23 and 24) can be cooled by the subcooling heat exchanger 96 to a subcooled state (refer to point R in FIGS. 23 and 24), it is possible to reduce the risk that the flows will be uneven in the distribution to each of the usage-side expansion mechanisms 5*c*.

<Air-warming Operation>

During the air-warming operation, the switching mechanism 3 is brought to the heating operation state shown by the dashed lines in FIGS. 21 and 25. The opening degrees of the first expansion mechanism 5*a* as the heat source-side expansion mechanism and the usage-side expansion mechanisms 5*c* are adjusted. Since the switching mechanism 3 is in the heating operation state, the intermediate heat exchanger on/off valve 12 of the intermediate refrigerant tube 8 is closed and the intermediate heat exchanger bypass on/off valve 11 of the intermediate heat exchanger bypass tube 9 is opened, thereby creating a state in which the intermediate heat exchanger 7 does not function as a cooler; the second intake return on/off valve 92*a* of the second intake return tube 92 is opened, thereby creating a state in which the intermediate heat exchanger 7 and the intake side of the compression mechanism 2 are connected, and the intermediate heat exchanger return on/off valve 94*a* of the intermediate heat exchanger return tube 94 is opened, thereby creating a state in which the intermediate heat exchanger 7 is connected with the portion between the usage-side heat exchangers 6 and the heat source-side heat exchanger 4. When the switching mechanism 3 is in the heating operation state, intermediate pressure injection by the economizer heat exchanger 20 is not performed, but intermediate pressure injection is performed by the receiver 18 for returning the refrigerant from the receiver 18 as a gas-liquid separator to the second-stage compression element 2*d* through the first second-stage injection tube 18*c*, and also performed is intermediate pressure injection by the liquid injection tube 18*h* for returning refrigerant to the second-stage compression element 2*d* through the liquid injection tube 18*h* as a second second-stage injection tube. More specifically, the third second-stage injection valve 19*a* is closed, the first second-stage injection on/off valve 18*d* is opened, and the opening degree of the liquid injection valve 18*i* is adjusted in the same manner as in the air-warming operation in the embodiment described above (i.e., control is performed so that the degree of superheating SH of the refrigerant admitted into the second-stage compression element 2*d* reaches the target value SHH). Furthermore, when the switching mechanism 3 is in the heating operation state, the subcooling heat exchanger 96 is not used, and the third intake return valve 95*a* is therefore fully closed.

When the refrigerant circuit 310 is in this state, low-pressure refrigerant (refer to point A in FIG. 21 and FIGS. 25 through 27) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B in FIG. 21, FIGS. 25 through 27). The intermediate-pressure refrigerant discharged from the first-stage compression element 2*c* passes through the intermediate heat exchanger bypass tube 9 (refer to point C in FIGS. 21 and 25 through 27) without passing through the intermediate heat exchanger 7 (i.e., without being cooled), unlike during the air-cooling operation described above. The intermediate-pressure refrigerant that has passed through the intermediate heat exchanger bypass tube 9 without being cooled by the intermediate heat exchanger 7 is cooled (refer to point G in FIGS. 21 and 25 through 27) by mixing with refrigerant being returned from the receiver 18 to the second-stage compression element 2*d* through the first second-stage injection tube 18*c* and the liquid injection tube 18*h* (refer to points M and X in FIGS. 21 and 25 through 27). Next, having been mixed with the refrigerant returning from the first second-stage injection tube 18*c* and the liquid injection tube 18*h* (i.e., intermediate pressure injection is carried out by the receiver 18 and the liquid injection tube 18*h* which acts as a gas-liquid separator), the intermediate-pressure refrigerant is drawn into and further compressed in the compression element 2*d* connected to the second-stage side of the compression element 2*c*, and the refrigerant is discharged from the compression mechanism 2 to the discharge tube 2*b* (refer to point D in FIGS. 21 and 25 through 27). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 26). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and drawn once more into the compression mechanism 2. Next, having been separated from the refrigeration oil in the oil separation mechanism 41, the high-pressure refrigerant is passed through the non-return mechanism 42 and the switching mechanism 3, fed to the usage-side heat exchangers 6 functioning as radiators of refrigerant, and cooled by heat exchange with the water and/or air as a cooling source (refer to point F in FIGS. 21 and 25 through 27). Some of the high-pressure refrigerant cooled in the usage-side heat exchangers 6 is then branched off to the liquid injection tube 18*h* after passing through the usage-side expansion mechanisms 5*c*. The refrigerant flowing through the liquid injection tube 18*h* is then depressurized to a nearly intermediate pressure in the liquid injection valve 18*i* (refer to point X in FIGS. 21 and 25 through 27), after which the refrigerant mixes with the intermediate-pressure refrigerant discharged from the first-stage compression element 2*c* as described above. The high-pressure refrigerant that has branched off in the liquid injection tube 18*h* is temporarily retained in the receiver 18 and subjected to gas-liquid separation (refer to points I, L, and M in FIGS. 21 and 25 through 27). The gas refrigerant resulting from gas-liquid separation in the receiver 18 is withdrawn from the top part of the receiver 18 by the first second-stage injection tube 18*c*, and is mixed with the intermediate-pressure refrigerant discharged from the first-stage compression element 2*c* as described above. The liquid refrigerant retained in the receiver 18 is depressurized by the first expansion mechanism 5*a* to a low-pressure gas-liquid two-phase refrigerant, which is fed to the heat source-side heat exchanger 4 functioning as an evaporator of refrigerant, and is also fed through the intermediate heat exchanger return tube 94 to the intermediate heat exchanger 7 functioning as an evaporator of refrigerant (refer to point E in FIGS. 21 and 25 through 27). The low-pressure gas-liquid two-phase refrigerant fed to the heat source-side heat exchanger 4 is heated by heat exchange with water or air as a heating source, and the refrigerant evaporates as a result (refer to point A in FIGS. 21, 25 through 27). The low-pressure gas-liquid two-phase refrigerant fed to the intermediate heat exchanger 7 is also heated by heat exchange with water or air as a heating source, and the refrigerant evaporates as a result (refer to point V in FIGS. 21, 25 through 27). The low-pressure refrigerant heated and evaporated in the heat source-side heat exchanger 4 is then drawn once more into the compression mechanism 2 via the switching mechanism 3. The low-pressure refrigerant heated and evaporated in the intermediate heat exchanger 7 is then drawn once more into the compression mechanism 2 via the second intake return tube 92. In this manner the air-warming operation is performed.

Thus, in the air-conditioning apparatus 1 of the present modification, because air-warming operation takes place under conditions in which the pressure difference between the pressure of the receiver 18 and the intermediate pressure in the refrigeration cycle is small, due to the configuration having a plurality of usage-side heat exchangers 6 connected in parallel to each other and the usage-side expansion mechanisms 5*c* being provided so as to correspond to each of the usage-side heat exchangers 6 in order to make it possible to control the flow rates of refrigerant flowing through each of the usage-side heat exchangers 6 and obtain the refrigeration loads required in each of the usage-side heat exchangers 6; intermediate pressure injection by the receiver 18 as a gas-liquid separator is used, and the same operational effects as the embodiment described above can be achieved.

In the present modification, similar to Modification 2 described above, the intermediate heat exchanger 7 functions as an evaporator of refrigerant during the air-warming operation, and the intermediate heat exchanger 7 can be utilized efficiently.

Moreover, in the present modification, along with the differentiation in intermediate pressure injection between the air-cooling operation and the air-warming operation as described above, injection rate optimization control is achieved by controlling the flow rate of the refrigerant returned to the second-stage compression element 2*d* through the third second-stage injection tube 19 during the air-cooling operation so that the degree of superheating SH of the refrigerant admitted into the second-stage compression element 2*d* reaches the target value SHC, and by controlling the flow rate of the refrigerant returned to the second-stage compression element 2*d* through the liquid injection tube 18*h* as a second second-stage injection tube during the air-warming operation so that the degree of superheating SH of the refrigerant admitted into the second-stage compression element 2*d* reaches the target value SHH; wherein the target value SHH of the degree of superheating SH during the air-warming operation is set to be equal to or less than the target value SHC of the degree of superheating SH during the air-cooling operation. Therefore, the injection ratio, which is the ratio of the flow rate of the refrigerant returned to the second-stage compression element 2*d* through the second-stage injection tube (the third second-stage injection tube 19 during the air-cooling operation, and both the first second-stage injection tube 18*c* and the liquid injection tube 18*h* during the air-warming operation) relative to the flow rate of the refrigerant discharged from the compression mechanism 2, is greater during the air-warming operation than during the air-cooling operation. Thereby, in the present modification, as in the above-described embodiment and modifications thereof, since the cooling effect on the refrigerant admitted into the second-stage compression element 2*d* by intermediate pressure injection using the second-stage injection tube is greater during the air-warming operation than during the air-cooling operation, it is possible to keep the temperature of the refrigerant discharged from the compression mechanism 2 even lower while suppressing heat radiation to the exterior and to improve the coefficient of performance even during the air-warming operation in which the intermediate heat exchanger 7 has no cooling effect on the refrigerant admitted into the second-stage compression element 2*d*. Also in the present modification, as in the above-described embodiment and modifications thereof, it is preferable that the target value SHH (see FIG. 27) of the degree of superheating SH during the air-warming operation be set to the same value as the target value SHC of the degree of superheating SH during the air-cooling operation, whereby during the air-warming operation, the refrigerant admitted into the second-stage compression element 2*d* is cooled by intermediate pressure injection during the air-warming operation to the same degree of superheating SH as that of the air-cooling operation in which refrigerant is cooled by the intermediate heat exchanger 7 and by intermediate pressure injection, and the injection ratio during the air-warming operation becomes greater than during the air-cooling operation by an amount equivalent to the cooling effect by the intermediate heat exchanger 7.

(6) Modification 4

In the above-described embodiment and the modifications thereof, a two-stage compression-type compression mechanism 2 is configured such that the refrigerant discharged from the first-stage compression element of two compression elements 2*c*, 2*d* is sequentially compressed in the second-stage compression element by one compressor 21 having a single-axis two-stage compression structure, but other options include using a compression mechanism having more stages than a two-stage compression system, such as a three-stage compression system or the like; or configuring a multistage compression mechanism by connecting in series a plurality of compressors incorporated with a single compression element and/or compressors incorporated with a plurality of compression elements. In cases in which the capacity of the compression mechanism must be increased, such as cases in which numerous usage-side heat exchangers 6 are connected, for example, a parallel multistage compression-type compression mechanism may be used in which two or more multistage compression-type compression mechanisms are connected in parallel.

Figure 28:
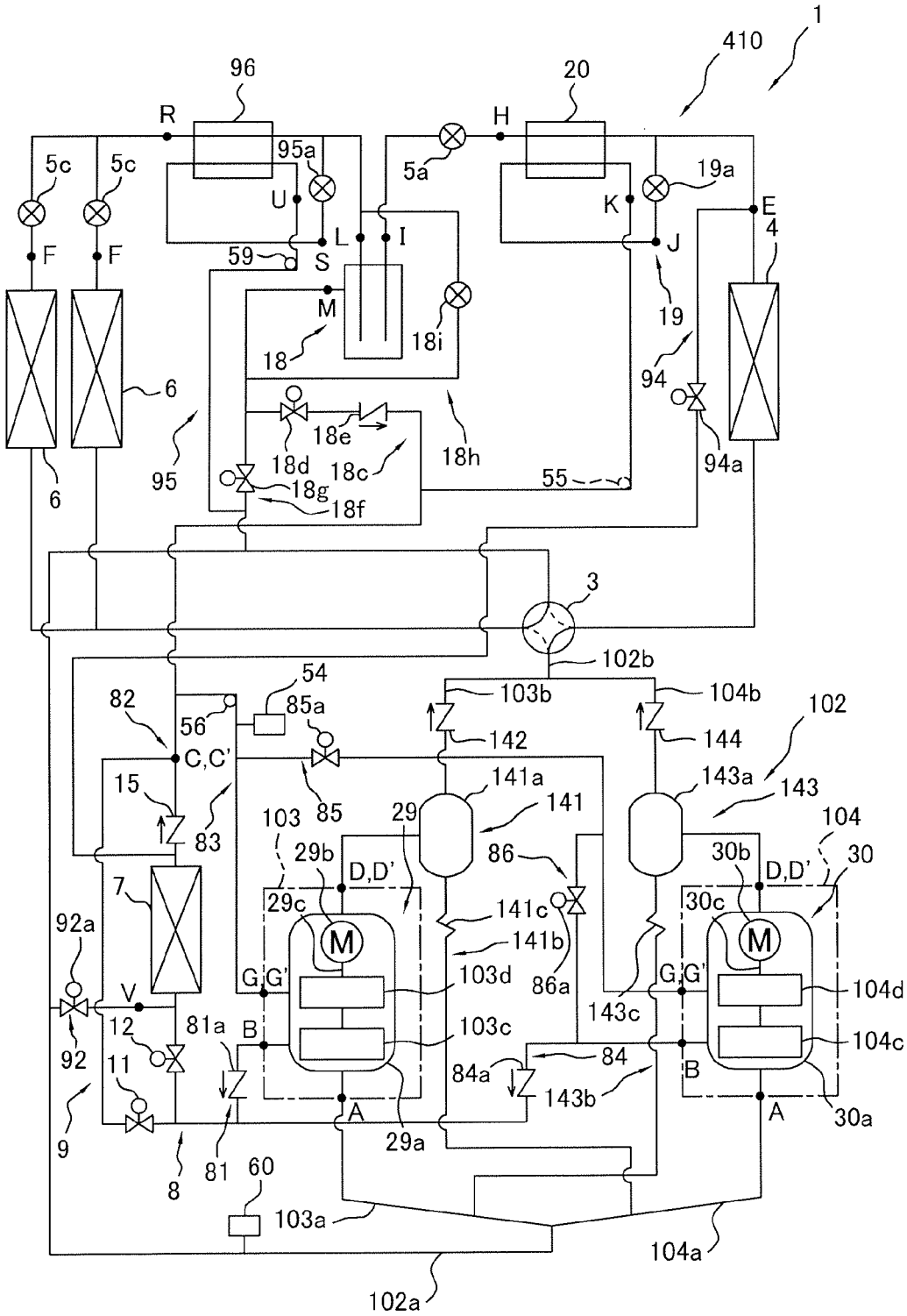
FIG. 28 is a schematic structural diagram of an air-conditioning apparatus according to Modification 4.

For example, the refrigerant circuit 310 in Modification 3 described above (see FIG. 21) may be replaced by a refrigerant circuit 410 that uses a compression mechanism 102 in which two-stage compression-type compression mechanisms 103, 104 are connected in parallel instead of the two-stage compression-type compression mechanism 2, as shown in FIG. 28.

In the present modification, the first compression mechanism 103 is configured using a compressor 29 for subjecting the refrigerant to two-stage compression through two compression elements 103*c*, 103*d*, and is connected to a first intake branch tube 103*a* which branches off from an intake header tube 102*a* of the compression mechanism 102, and also to a first discharge branch tube 103*b* whose flow merges with a discharge header tube 102*b* of the compression mechanism 102. In the present modification, the second compression mechanism 104 is configured using a compressor 30 for subjecting the refrigerant to two-stage compression through two compression elements 104*c*, 104*d*, and is connected to a second intake branch tube 104*a* which branches off from the intake header tube 102*a* of the compression mechanism 102, and also to a second discharge branch tube 104*b* whose flow merges with the discharge header tube 102*b* of the compression mechanism 102. Since the compressors 29, 30 have the same configuration as the compressor 21 in the embodiment and modifications thereof described above, symbols indicating components other than the compression elements 103*c*, 103*d*, 104*c*, 104*d* are replaced with symbols beginning with 29 or 30, and these components are not described. The compressor 29 is configured so that refrigerant is drawn from the first intake branch tube 103*a*, the refrigerant thus drawn in is compressed by the compression element 103*c* and then discharged to a first inlet-side intermediate branch tube 81 that constitutes the intermediate refrigerant tube 8, the refrigerant discharged to the first inlet-side intermediate branch tube 81 is caused to be drawn into the compression element 103*d* by way of an intermediate header tube 82 and a first outlet-side intermediate branch tube 83 constituting the intermediate refrigerant tube 8, and the refrigerant is further compressed and then discharged to the first discharge branch tube 103*b*. The compressor 30 is configured so that refrigerant is drawn in through the second intake branch tube 104*a*, the drawn-in refrigerant is compressed by the compression element 104*c* and then discharged to a second inlet-side intermediate branch tube 84 constituting the intermediate refrigerant tube 8, the refrigerant discharged to the second inlet-side intermediate branch tube 84 is drawn in into the compression element 104*d* via the intermediate header tube 82 and a second outlet-side intermediate branch tube 85 constituting the intermediate refrigerant tube 8, and the refrigerant is further compressed and then discharged to the second discharge branch tube 104*b*. In the present modification, the intermediate refrigerant tube 8 is a refrigerant tube for admitting refrigerant discharged from the compression elements 103*c*, 104*c* connected to the first-stage sides of the compression elements 103*d*, 104*d* into the compression elements 103*d*, 104*d* connected to the second-stage sides of the compression elements 103*c*, 104*c*, and the intermediate refrigerant tube 8 primarily comprises the first inlet-side intermediate branch tube 81 connected to the discharge side of the first-stage compression element 103*c* of the first compression mechanism 103, the second inlet-side intermediate branch tube 84 connected to the discharge side of the first-stage compression element 104*c* of the second compression mechanism 104, the intermediate header tube 82 whose flow merges with both inlet-side intermediate branch tubes 81, 84, the first discharge-side intermediate branch tube 83 branching off from the intermediate header tube 82 and connected to the intake side of the second-stage compression element 103*d* of the first compression mechanism 103, and the second outlet-side intermediate branch tube 85 branching off from the intermediate header tube 82 and connected to the intake side of the second-stage compression element 104*d* of the second compression mechanism 104. The discharge header tube 102*b* is a refrigerant tube for feeding refrigerant discharged from the compression mechanism 102 to the switching mechanism 3. A first oil separation mechanism 141 and a first non-return mechanism 142 are provided to the first discharge branch tube 103*b* connected to the discharge header tube 102*b*. A second oil separation mechanism 143 and a second non-return mechanism 144 are provided to the second discharge branch tube 104*b* connected to the discharge header tube 102*b*. The first oil separation mechanism 141 is a mechanism whereby refrigeration oil that accompanies the refrigerant discharged from the first compression mechanism 103 is separated from the refrigerant and returned to the intake side of the compression mechanism 102. The first oil separation mechanism 141 mainly has a first oil separator 141*a* for separating from the refrigerant the refrigeration oil that accompanies the refrigerant discharged from the first compression mechanism 103, and a first oil return tube 141*b* that is connected to the first oil separator 141*a* and that is used for returning the refrigeration oil separated from the refrigerant to the intake side of the compression mechanism 102. The second oil separation mechanism 143 is a mechanism whereby refrigeration oil that accompanies the refrigerant discharged from the second compression mechanism 104 is separated from the refrigerant and returned to the intake side of the compression mechanism 102. The second oil separation mechanism 143 mainly has a second oil separator 143*a* for separating from the refrigerant the refrigeration oil that accompanies the refrigerant discharged from the second compression mechanism 104, and a second oil return tube 143*b* that is connected to the second oil separator 143*a* and that is used for returning the refrigeration oil separated from the refrigerant to the intake side of the compression mechanism 102. In the present modification, the first oil return tube 141*b* is connected to the second intake branch tube 104*a*, and the second oil return tube 143*c* is connected to the first intake branch tube 103*a*. Accordingly, a greater amount of refrigeration oil returns to the compression mechanism 103, 104 that has the lesser amount of refrigeration oil even when there is an imbalance between the amount of refrigeration oil that accompanies the refrigerant discharged from the first compression mechanism 103 and the amount of refrigeration oil that accompanies the refrigerant discharged from the second compression mechanism 104, which is due to the imbalance in the amount of refrigeration oil retained in the first compression mechanism 103 and the amount of refrigeration oil retained in the second compression mechanism 104. The imbalance between the amount of refrigeration oil retained in the first compression mechanism 103 and the amount of refrigeration oil retained in the second compression mechanism 104 is therefore resolved. In the present modification, the first intake branch tube 103*a* is configured so that the portion leading from the flow juncture with the second oil return tube 143*b* to the flow juncture with the intake header tube 102*a* slopes downward toward the flow juncture with the intake header tube 102*a*, while the second intake branch tube 104*a* is configured so that the portion leading from the flow juncture with the first oil return tube 141*b* to the flow juncture with the intake header tube 102*a* slopes downward toward the flow juncture with the intake header tube 102*a*. Therefore, even if either one of the two-stage compression-type compression mechanisms 103, 104 is stopped, refrigeration oil being returned from the oil return tube corresponding to the operating compression mechanism to the intake branch tube corresponding to the stopped compression mechanism is returned to the intake header tube 102*a*, and there will be little likelihood of a shortage of oil supplied to the operating compression mechanism. The oil return tubes 141*b*, 143*b* are provided with depressurization mechanisms 141*c*, 143*c* for depressurizing the refrigeration oil that flows through the oil return tubes 141*b*, 143*b*. The non-return mechanism 142, 144 are mechanisms for allowing refrigerant to flow from the discharge side of the compression mechanisms 103, 104 to the switching mechanism 3, and for cutting off the flow of refrigerant from the switching mechanism 3 to the discharge side of the compression mechanisms 103, 104.

Thus, in the present modification, the compression mechanism 102 is configured by connecting two compression mechanisms in parallel; namely, the first compression mechanism 103 having two compression elements 103*c*, 103*d* and configured so that refrigerant discharged from the first-stage compression element of these compression elements 103*c*, 103*d* is sequentially compressed by the second-stage compression element, and the second compression mechanism 104 having two compression elements 104*c*, 104*d* and configured so that refrigerant discharged from the first-stage compression element of these compression elements 104*c*, 104*d* is sequentially compressed by the second-stage compression element.

In the present modification, the intermediate heat exchanger 7 is provided to the intermediate header tube 82 constituting the intermediate refrigerant tube 8, and the intermediate heat exchanger 7 is a heat exchanger for cooling the conjoined flow of the refrigerant discharged from the first-stage compression element 103*c* of the first compression mechanism 103 and the refrigerant discharged from the first-stage compression element 104*c* of the second compression mechanism 104 during the air-cooling operation. Specifically, the intermediate heat exchanger 7 functions as a shared cooler for two compression mechanisms 103, 104 during the air-cooling operation. Accordingly, the circuit configuration is simplified around the compression mechanism 102 when the intermediate heat exchanger 7 is provided to the parallel-multistage-compression-type compression mechanism 102 in which a plurality of multistage-compression-type compression mechanisms 103, 104 are connected in parallel.

The first inlet-side intermediate branch tube 81 constituting the intermediate refrigerant tube 8 is provided with a non-return mechanism 81*a* for allowing the flow of refrigerant from the discharge side of the first-stage compression element 103*c* of the first compression mechanism 103 toward the intermediate header tube 82 and for blocking the flow of refrigerant from the intermediate header tube 82 toward the discharge side of the first-stage compression element 103*c*, while the second inlet-side intermediate branch tube 84 constituting the intermediate refrigerant tube 8 is provided with a non-return mechanism 84*a* for allowing the flow of refrigerant from the discharge side of the first-stage compression element 104*c* of the second compression mechanism 103 toward the intermediate header tube 82 and for blocking the flow of refrigerant from the intermediate header tube 82 toward the discharge side of the first-stage compression element 104*c*. In the present modification, non-return valves are used as the non-return mechanisms 81*a*, 84*a*. Therefore, even if either one of the compression mechanisms 103, 104 is stopped, there are no instances in which refrigerant discharged from the first-stage compression element of the operating compression mechanism passes through the intermediate refrigerant tube 8 and travels to the discharge side of the first-stage compression element of the stopped compression mechanism. Therefore, there are no instances in which refrigerant discharged from the first-stage compression element of the operating compression mechanism passes through the interior of the first-stage compression element of the stopped compression mechanism and exits out through the intake side of the compression mechanism 102, which would cause the refrigeration oil of the stopped compression mechanism to flow out, and it is thus unlikely that there will be insufficient refrigeration oil for starting up the stopped compression mechanism. In the case that the compression mechanisms 103, 104 are operated in order of priority (for example, in the case of a compression mechanism in which priority is given to operating the first compression mechanism 103), the stopped compression mechanism described above will always be the second compression mechanism 104, and therefore in this case only the non-return mechanism 84*a* corresponding to the second compression mechanism 104 need be provided.

In cases of a compression mechanism which prioritizes operating the first compression mechanism 103 as described above, since a shared intermediate refrigerant tube 8 is provided for both compression mechanisms 103, 104, the refrigerant discharged from the first-stage compression element 103*c* corresponding to the operating first compression mechanism 103 passes through the second outlet-side intermediate branch tube 85 of the intermediate refrigerant tube 8 and travels to the intake side of the second-stage compression element 104*d* of the stopped second compression mechanism 104, whereby there is a danger that refrigerant discharged from the first-stage compression element 103*c* of the operating first compression mechanism 103 will pass through the interior of the second-stage compression element 104*d* of the stopped second compression mechanism 104 and exit out through the discharge side of the compression mechanism 102, causing the refrigeration oil of the stopped second compression mechanism 104 to flow out, resulting in insufficient refrigeration oil for starting up the stopped second compression mechanism 104. In view of this, an on/off valve 85*a* is provided to the second outlet-side intermediate branch tube 85 in the present modification, and when the second compression mechanism 104 is stopped, the flow of refrigerant through the second outlet-side intermediate branch tube 85 is blocked by the on/off valve 85*a*. The refrigerant discharged from the first-stage compression element 103*c* of the operating first compression mechanism 103 thereby no longer passes through the second outlet-side intermediate branch tube 85 of the intermediate refrigerant tube 8 and travels to the intake side of the second-stage compression element 104*d* of the stopped second compression mechanism 104; therefore, there are no longer any instances in which the refrigerant discharged from the first-stage compression element 103*c* of the operating first compression mechanism 103 passes through the interior of the second-stage compression element 104*d* of the stopped second compression mechanism 104 and exits out through the discharge side of the compression mechanism 102 which causes the refrigeration oil of the stopped second compression mechanism 104 to flow out, and it is thereby made even more unlikely that there will be insufficient refrigeration oil for starting up the stopped second compression mechanism 104. An electromagnetic valve is used as the on/off valve 85*a* in the present modification.

In the case of a compression mechanism which prioritizes operating the first compression mechanism 103, the second compression mechanism 104 is started up in continuation from the starting up of the first compression mechanism 103, but at this time, since a shared intermediate refrigerant tube 8 is provided for both compression mechanisms 103, 104, the starting up takes place from a state in which the pressure in the discharge side of the first-stage compression element 104*c* of the second compression mechanism 104 and the pressure in the intake side of the second-stage compression element 104*d* are greater than the pressure in the intake side of the first-stage compression element 103*c* of the first compression mechanism 103 and the pressure in the discharge side of the second-stage compression element 103*d*, and it is difficult to start up the second compression mechanism 104 in a stable manner. In view of this, in the present modification, there is provided a startup bypass tube 86 for connecting the discharge side of the first-stage compression element 104*c* of the second compression mechanism 104 and the intake side of the second-stage compression element 104*d*, and an on/off valve 86*a* is provided to this startup bypass tube 86. In cases in which the second compression mechanism 104 is stopped, the flow of refrigerant through the startup bypass tube 86 is blocked by the on/off valve 86*a* and the flow of refrigerant through the second outlet-side intermediate branch tube 85 is blocked by the on/off valve 85*a*. When the second compression mechanism 104 is started up, a state in which refrigerant is allowed to flow through the startup bypass tube 86 can be restored via the on/off valve 86*a*, whereby the refrigerant discharged from the first-stage compression element 104*c* of the second compression mechanism 104 is drawn into the second-stage compression element 104*d* via the startup bypass tube 86 without being mixed with the refrigerant discharged from the first-stage compression element 104*c* of the second compression mechanism 104, a state of allowing refrigerant to flow through the second outlet-side intermediate branch tube 85 can be restored via the on/off valve 85*a* at a point in time when the operating state of the compression mechanism 102 has been stabilized (e.g., a point in time when the intake pressure, discharge pressure, and intermediate pressure of the compression mechanism 102 have been stabilized), the flow of refrigerant through the startup bypass tube 86 can be blocked by the on/off valve 86*a*, and operation can transition to the normal air-cooling operation or air-warming operation. In the present modification, one end of the startup bypass tube 86 is connected between the on/off valve 85*a* of the second outlet-side intermediate branch tube 85 and the intake side of the second-stage compression element 104*d* of the second compression mechanism 104, while the other end is connected between the discharge side of the first-stage compression element 104*c* of the second compression mechanism 104 and the non-return mechanism 84*a* of the second inlet-side intermediate branch tube 84, and when the second compression mechanism 104 is started up, the startup bypass tube 86 can be kept in a state of being substantially unaffected by the intermediate pressure portion of the first compression mechanism 103. An electromagnetic valve is used as the on/off valve 86*a* in the present modification.

The actions of the air-conditioning apparatus 1 of the present modification during the air-cooling operation and the air-warming operation, and the like are essentially the same as the actions in the above-described Modification 3 (FIGS. 21 through 27 and the relevant descriptions), except that the points modified by the circuit configuration surrounding the compression mechanism 102 are somewhat more complex due to the compression mechanism 102 being provided instead of the compression mechanism 2, for which reason the actions are not described herein.

The same operational effects as those of Modification 3 described above can also be achieved with the configuration of the present modification.

(7) Other Embodiments

Embodiments of the present invention and modifications thereof are described above with reference to the drawings, however the specific configuration is not limited to these embodiments or their modifications, and can be changed within a range that does not deviate from the scope of the invention.

For example, in the above-described embodiment and modifications thereof, the present invention may be applied to a so-called chiller-type air-conditioning apparatus in which water or brine is used as a heating source or cooling source for conducting heat exchange with the refrigerant flowing through the usage-side heat exchanger 6, and a secondary heat exchanger is provided for conducting heat exchange between indoor air and the water or brine that has undergone heat exchange in the usage-side heat exchanger 6.

The present invention can also be applied to other types of refrigeration apparatuses besides the above-described chiller-type air-conditioning apparatus, as long as the apparatus performs a multistage compression refrigeration cycle by using a refrigerant that operates in a supercritical range as its refrigerant.

The refrigerant that operates in a supercritical range is not limited to carbon dioxide; ethylene, ethane, nitric oxide, and other gases may also be used.

Industrial Applicability

The present invention is widely applicable in refrigeration apparatuses for performing a multi-stage compression-type refrigeration cycle using a refrigerant circuit which can switch between a cooling operation and a heating operation and which is capable of intermediate pressure injection.

What is claimed is:

1. A refrigeration apparatus comprising:

a compression mechanism having a plurality of compression elements arranged and configured so that refrigerant discharged from a first-stage compression element of the plurality of compression elements is sequentially compressed by a second-stage compression element;

a heat source-side heat exchanger arranged and configured to operate as a radiator or an evaporator of refrigerant;

a usage-side heat exchanger arranged and configured to operate as an evaporator or a radiator of refrigerant;

a switching mechanism arranged and configured to switch between a cooling operation state, in which refrigerant is circulated through the compression mechanism, the heat source-side heat exchanger, and the usage-side heat exchanger in order and a heating operation state, in which refrigerant is circulated through the compression mechanism, the usage-side heat exchanger, and the heat source-side heat exchanger in order;

a second-stage injection tube arranged and configured to branch off refrigerant, which has radiated heat in the heat source-side heat exchanger or the usage-side heat exchanger, and to return the refrigerant to the second-stage compression element;

an intermediate heat exchanger connected to an intermediate refrigerant tube to draw refrigerant discharged from the first-stage compression element into the second-stage compression element, and arranged and configured to cool refrigerant discharged from the first-stage compression element and drawn into the second-stage compression element during a cooling operation in which the switching mechanism is in the cooling operation state; and an intermediate heat exchanger bypass tube connected to the intermediate refrigerant tube so as to bypass the intermediate heat exchanger, the intermediate heat exchanger bypass tube being arranged and configured to ensure that refrigerant discharged from the first-stage compression element and drawn into the second-stage compression element is not cooled by the intermediate heat exchanger during a heating operation in which the switching mechanism is in the heating operation state, and an injection rate optimization control being performed to control a flow rate of refrigerant returned to the second-stage compression element through the second-stage injection tube on that an injection ratio is greater during the heating operation than during the cooling operation, the injection ratio being a ratio of flow rate of refrigerant returned to the second-stage compression element through the second-stage injection tube relative to flow rate of refrigerant discharged from the compression mechanism.

2. The refrigeration apparatus according to claim 1, wherein when the injection rate optimization control is performed, flow rate of refrigerant returned to the second-stage compression element through the second-stage injection tube is controlled so that a degree of superheating of refrigerant drawn into the second-stage compression element after being mixed with refrigerant returning to the second-stage compression element through the second-stage injection tube reaches a target value, and the target value of the degree of superheating during the heating operation is set to be equal to or less than the target value of the degree of superheating during the cooling operation.

3. A refrigeration apparatus comprising:

a compression mechanism having a plurality of compression elements arranged and configured so that refrigerant discharged from a first-stage compression element of the plurality of compression elements is sequentially compressed by a second-stage compression element;

a heat source-side heat exchanger arranged and configured to operate as a radiator or an evaporator of refrigerant;

a usage-side heat exchanger arranged and configured to operate as an evaporator or a radiator of refrigerant;

a switching mechanism arranged and configured to switch between a cooling operation state, in which refrigerant is circulated through the compression mechanism, the heat source-side heat exchanger, and the usage-side heat exchanger in order and a heating operation state, in which refrigerant is circulated through the compression mechanism, the usage-side heat exchanger, and the heat source-side heat exchanger in order;

a second-stage injection tube arranged and configured to branch off refrigerant, which has radiated heat in the heat source-side heat exchanger or the usage-side heat exchanger, and to return the refrigerant to the second-stage compression element;

an intermediate heat exchanger connected to an intermediate refrigerant tube to draw refrigerant discharged from the first-stage compression element into the second-stage compression element, and arranged and configured to cool refrigerant discharged from the first-stage compression element and drawn into the second-stage compression element during a cooling operation in which the switching mechanism is in the cooling operation state;

an intermediate heat exchanger bypass tube connected to the intermediate refrigerant tube so as to bypass the intermediate heat exchanger; and a gas-liquid separator arranged and configured to perform gas-liquid separation on refrigerant, which has radiated heat in the heat source-side heat exchanger or the usage-side heat exchanger, the intermediate heat exchanger bypass tube being arranged and configured to ensure that refrigerant discharged from the first-stage compression element and drawn into the second-stage compression element is not cooled by the intermediate heat exchanger during a heating operation in which the switching mechanism is in the heating operation state, and an injection rate optimization control being performed to control a flow rate of refrigerant returned to the second-stage compression element through the second-stage injection tube so that an injection ratio is greater during the heating operation than during the cooling operation, the injection ratio being a ratio of flow rate of refrigerant returned to the second-stage compression element through the second-stage injection tube relative to flow rate of refrigerant discharged from the compression mechanism, the second-stage injection tube having a first second-stage injection tube arranged and configured to return gas refrigerant resulting from gas-liquid separation in the gas-liquid separator to the second-stage compression element, and a second second-stage injection tube arranged and configured to branch off refrigerant from between the gas-liquid separator and the heat source-side heat exchanger or the usage-side heat exchanger, functioning as a radiator, and to return the refrigerant to the second-stage compression element, and when the injection rate optimization control is performed, flow rate of refrigerant returned to the second-stage compression element through the second second-stage injection tube being controlled so that a degree of superheating of refrigerant admitted into the second-stage compression element reaches a target value, the target value of the degree of superheating during the heating operation being set so as to be equal to or less than the target value of the degree of superheating during the cooling operation.

4. The refrigeration apparatus according to claim 2, wherein the target value of the degree of superheating during the heating operation is set o the same value as the target value of the degree of superheating during the cooling operation.

5. The refrigeration apparatus according to claim 1. further comprising an economizer heat exchanger arranged and configured to perform heat exchange between refrigerant, which has radiated heat in the heat source-side heat exchanger or the usage-side heat exchanger, and refrigerant flowing through the second-stage injection tube, when the injection rate optimization control is performed, flow rate of refrigerant returned to the second-stage compression element through the second-stage injection tube being controlled so that a degree of superheating of refrigerant in a second-stage injection tube-side outlet of the economizer heat exchanger reaches a target value, the target value of the degree of superheating during the heating operation being set so as to be less than the target value of the degree of superheating during the cooling operation.

6. The refrigeration apparatus according to claim 5, wherein the target value of the degree of superheating during the heating operation is set to a value which is 5° C. to 10° C. less than the target value of the degree of superheating during the cooling operation.

7. A refrigeration apparatus comprising:

a compression mechanism having a plurality of compression elements arranged and configured so that refrigerant discharged from a first-stage compression element of the plurality of compression elements is sequentially compressed by a second-stage compression element;

a heat source-side heat exchanger arranged and configured to operate as a radiator or an evaporator of refrigerant;

a usage-side heat exchanger arranged and configured to operate as an evaporator or a radiator of refrigerant;

a switching mechanism arranged and configured to switch between a cooling operation state, in which refrigerant is circulated through the compression mechanism, the heat source-side heat exchanger, and the usage-side heat exchanger in order and a heating operation state, in which refrigerant is circulated through the compression mechanism the usage-side heat exchanger and the heat source-side heat exchanger in order;

a second-stage injection tube arranged and configured to branch off refrigerant, which has radiated heat in the heat source-side heat exchanger or the usage-side heat exchanger, and to return the refrigerant to the second-stage compression element;

an intermediate heat exchanger connected to an intermediate refrigerant tube to draw refrigerant discharged from the first-stage compression element into the second-stage compression. element, and arrange and configured to cool refrigerant discharged from the first-stage compression element and drawn into the second-stage compression element during a cooling operation in which the switching mechanism is in the cooling operation state;

an intermediate heat exchanger bypass tube connected to the intermediate refrigerant tube so as to bypass the intermediate heat exchanger;

a gas-liquid separator arranged and configured to perform gas-liquid separation on refrigerant, which has radiated heat in the usage-side heat exchanger during a heating operation in which the switching mechanism is in the heating operation state; and an economizer eat exchanger, the intermediate heat exchanger bypass tube being arranged and configured to ensure that refrigerant discharged from the first-stage compression element and drawn into the second-stage compression element is not cooled by the intermediate heat exchanger during the heating operation, and an injection rate optimization control being performed to control a flow rate of refrigerant returned to the second-stage compression element through the second-stage injection tube so that an injection ratio is greater during the heating operation than during the cooling operation, the injection ratio being a ratio of flow rate of refrigerant returned to the second-stage compression element through the second-stage injection tube relative to flow rate of refrigerant discharged from the compression mechanism, the second-stage injection tube having a first second-stage injection tube arranged and configured to return gas refrigerant resulting from gas-liquid separation in the gas-liquid separator to the second-stage compression element during the heating operation, a second second-stage injection tube arranged and configured to branch off refrigerant from between the usage-side heat exchanger and the gas-liquid separator and to return the refrigerant to the second-stage compression element during the heating operation, and a third second-stage injection tube arranged and configured to branch off refrigerant, which has radiated heat in the heat source-side heat exchanger and to return the refrigerant to the second-stage compression element during the cooling operation, and the economizer heat exchanger being arranged and configured to perform heat exchange between refrigerant, which has radiated heat in the heat source-side heat exchanger, and refrigerant flowing through the third second-stage injection tube during the cooling operation, when the injection rate optimization control is performed, flow rate of refrigerant returned to the second-stage compression element through the third second-stage injection tube during the cooling operation being controlled so that a degree of superheating of refrigerant drawn into the second-stage compression element reaches a target value, and flow rate of refrigerant returned to the second-stage compression element through the second second-stage injection tube during the heating operation being controlled so that the degree of superheating of refrigerant drawn into the second-stage compression element reaches a target value, with the target value of the degree of superheating during the heating operation being set so as to be equal to or less than the target value of the degree of superheating during the cooling operation.

8. The refrigeration apparatus according to claim 7, wherein the target value of the degree of superheating during the heating operation is set to the same value as the target value of the degree of superheating during the cooling operation.

9. The refrigeration apparatus according to claim 3, wherein the target value of the degree of superheating during the heating operation is set to the same value as the target value of the degree of superheating during the cooling operation.

* * * * *